US007552602B2

(12) United States Patent
Knight, Sr. et al.

(10) Patent No.: US 7,552,602 B2
(45) Date of Patent: Jun. 30, 2009

(54) FORMING A TUBULAR KNIT FABRIC FOR A PAINT ROLLER COVER

(75) Inventors: John Cecil Knight, Sr., North, SC (US); Daniel L. Sinykin, Bayside, WI (US)

(73) Assignee: Seamless Technologies, LLC, Janesville, WI (US)

( * ) Notice: Subject to any disclaimer, the term of this patent is extended or adjusted under 35 U.S.C. 154(b) by 0 days.

(21) Appl. No.: 12/249,455

(22) Filed: Oct. 10, 2008

(65) Prior Publication Data

US 2009/0095025 A1 Apr. 16, 2009

Related U.S. Application Data

(63) Continuation-in-part of application No. 11/871,307, filed on Oct. 12, 2007, now Pat. No. 7,503,190, and a continuation-in-part of application No. 12/116,022, filed on May 6, 2008.

(51) Int. Cl.
*D04B 9/12* (2006.01)

(52) U.S. Cl. ..... 66/9 R; 66/191; 66/194

(58) Field of Classification Search ..... 66/191, 66/190, 194, 195, 9 R, 10–12; 442/312, 442/313

See application file for complete search history.

(56) References Cited

U.S. PATENT DOCUMENTS 1,012,966 A 12/1911 Ballard
1,791,741 A 2/1931 Moore
1,801,167 A 4/1931 McAdams
1,849,466 A 3/1932 Moore
2,087,888 A 7/1937 Adams
2,368,513 A 1/1945 Adams
2,600,955 A 6/1952 Barnes et al.
2,704,877 A 3/1955 Schmidt
2,737,702 A 3/1956 Schmidt et al.
2,752,953 A 7/1956 Schmidt
2,920,372 A 1/1960 Sannipoli et al.
2,944,588 A 7/1960 Sannipoli et al.
3,010,867 A 1/1961 Sannipoli et al.
3,181,233 A 5/1965 Sannipoli et al.
3,226,952 A 1/1966 Cassady
3,299,672 A 1/1967 Schmidt
3,732,135 A 5/1973 Ernst et al.
3,820,358 A 6/1974 Frishman
3,853,680 A 12/1974 Daniel
3,874,197 A 4/1975 Plath (Continued)

OTHER PUBLICATIONS

U.S. Appl. No. 11/871,307, filed Oct. 12, 2007, Knight, Sr. et al.

*Primary Examiner*—Danny Worrell
(74) *Attorney, Agent, or Firm*—Reinhart Boerner Van Deuren P.C.

(57) ABSTRACT

A method and apparatus are provided for forming a tubular-shaped knitted covering for a paint roller, or the like, having a pile extending from an outer surface of the covering, through use of a dial needle knitting arrangement. A cylinder needle knitting arrangement may be utilized in conjunction with the dial needle knitting arrangement for forming a tubular-shaped knitted covering for a paint roller having a pile formed from a combination of sliver and yarn fibers in successive courses of the tubular-shaped knitted covering.

58 Claims, 33 Drawing Sheets

U.S. PATENT DOCUMENTS 3,894,407 A 7/1975 Clingan et al.
3,894,409 A 7/1975 Clingan et al.
3,896,637 A 7/1975 Thore
3,990,268 A 11/1976 Smith
4,006,609 A 2/1977 Abler
4,026,126 A 5/1977 Nuber
4,236,286 A 12/1980 Abler et al.
4,245,487 A 1/1981 Schaab et al.
4,409,800 A 10/1983 Gutschmit et al.
4,415,611 A 11/1983 Yamagata et al.
4,466,151 A 8/1984 Barch et al.
4,513,042 A 4/1985 Lumb
4,532,780 A 8/1985 Tilson et al.
4,537,048 A 8/1985 Gutschmit et al.
4,546,020 A 10/1985 Sakai et al.
4,554,801 A 11/1985 Thore
4,563,884 A 1/1986 Kunde et al.
4,592,212 A 6/1986 Schmidt
4,592,213 A 6/1986 Tilson et al.
4,633,683 A 1/1987 Schmidt
4,692,975 A 9/1987 Garcia
4,798,748 A 1/1989 Kitamura et al.
5,016,450 A 5/1991 Pernick
5,134,863 A 8/1992 Hanna
5,206,968 A 5/1993 Bower et al.
5,294,276 A 3/1994 Linn et al.
5,431,029 A 7/1995 Kuhrau et al.
5,546,768 A 8/1996 Kuhrau et al.
5,572,790 A 11/1996 Sekar
5,577,402 A 11/1996 Kuhrau et al.
RE35,526 E 6/1997 Alvarez Garcia
5,685,176 A 11/1997 Kuhrau et al.
5,694,688 A 12/1997 Musch et al.
5,809,804 A 9/1998 Kuhrau et al.
6,016,670 A 1/2000 Kuhrau et al.
6,151,920 A 11/2000 Schindler et al.
6,159,320 A 12/2000 Tams et al.
6,203,648 B1 3/2001 Barton et al.
6,247,335 B1 6/2001 Schaeberle et al.
6,324,717 B1 12/2001 Sekar
6,502,779 B1 1/2003 Jelinek et al.
6,615,490 B2 9/2003 Polzin
6,685,121 B1 2/2004 Jelinek et al.
6,766,668 B2 7/2004 Sinykin
6,902,131 B1 6/2005 Jelinek et al.
6,918,552 B2 7/2005 Jelinek et al.
6,929,203 B1 8/2005 Jelinek et al.
6,993,941 B2 2/2006 Yamaguchi
2002/0042331 A1 4/2002 Fortner et al.
2002/0091051 A1 7/2002 Sekar
2003/0213083 A1 11/2003 Yamaguchi
2008/0263792 A1 10/2008 Knight et al.
2008/0263802 A1 10/2008 Knight et al.
2008/0264110 A1 10/2008 Sinykin
2008/0265468 A1 10/2008 Sinykin
2008/0269033 A1 10/2008 Sinykin

236

FORMING A TUBULAR KNIT FABRIC FOR A PAINT ROLLER COVER

CROSS-REFERENCE TO RELATED PATENT APPLICATIONS

This patent application is a continuation-in-part of co-pending U.S. patent application Ser. No. 11/871,307, filed Oct. 12, 2007, the entire teachings and disclosure of which are incorporated herein by reference thereto, and also claims priority to co-pending U.S. patent application Ser. No. 12/116,022, filed May 6, 2008, the entire teachings and disclosures of which are also incorporated herein by reference.

FIELD OF THE INVENTION

This invention relates generally to the manufacture of knitted fabric having a pile extending from a surface thereof, and more particularly to the manufacture of a tubular-shaped knitted fabric having a pile extending from an outer surface thereof in small diameters suitable for use as a covering for a paint roller.

BACKGROUND OF THE INVENTION

Since the 1930s, rollers have been utilized for applying paint and other coatings to walls, ceilings, floors, and other surfaces. Typically, a roller includes two components, in the form of a handle assembly and a roller cover for installation onto the handle assembly. The handle assembly typically consists of a grip element having a generally L-shaped metal frame extending therefrom, with the free end of the metal frame having a rotatable support for the roller cover to be mounted thereon. The roller cover typically consists of a thin, hollow cylindrical core which fits onto the rotatable support of the handle, with a plush pile fabric being secured to the outer periphery of the roller cover. The core may be made of any appropriate material, such as cardboard or plastic. The pile fabric has traditionally been applied as a strip of fabric which is helically wound onto the outer surface of the core, with adjacent windings of the fabric strip being located as closely adjacent as possible to each other to provide the appearance of a single continuous pile fabric covering on the core.

The use of helically wound strips to provide the pile on roller covers is undesirable because, even where great care is taken in precisely cutting and winding the strips of fabric onto the core, the resulting juncture between two adjacent strips still sometimes results in noticeable marks being left on the surface being painted or otherwise coated by the roller cover. Even where the resulting juncture is initially carefully made, the pile fibers along the sides of the juncture are sometimes lost during use of the roller cover, as a result of the fabric being cut into strips. The precise cutting and winding operations required to produce a roller cover giving satisfactory performance can substantially increase the cost of manufacturing a roller cover.

The use of helically wound coverings on prior rollers has been necessary primarily due to the fact that the pile fabrics suitable for use as roller coverings could only be knitted in a tubular form having large diameters, such as 24 inches for example, having a circumference far larger than the outer periphery of the core of a typical roller. These large diameter knitted fabrics were then slit to form a flat sheet of fabric having a pile extending from one surface thereof. The large sheet of fabric was then cut into strips for winding about the core to form the completed roller.

For the most popular type of knitted fabric for roller covers, having a pile formed from small tufts, known as slivers, of fabric knitted into a knitted backing, another drawback existed in prior methods and apparatuses which were only capable of producing tubular-shaped knitted coverings having the pile extending from an inner surface of the tubular-shaped length of knitted covering. As a result, even if the tubular-shaped covering could have been produced in a diameter small enough to be simply slipped over the core of a roller, it would have been necessary to first turn the entire length of tubular knitted covering inside-out in order to move the pile from the inside to the outside of the tube of fabric.

In a commonly assigned U.S. patent application bearing Ser. No. 11/740,119, titled "Tubular Sliver Knit Fabric For Paint Roller Covers," the disclosure and teachings of which are incorporated herein in their entireties by reference, the inventor of the present invention discloses a tubular sliver knit fabric for a roller cover having the pile extending from the outer surface of the knitted fabric and an inner diameter defined by the base fabric which is small enough in diameter to be slipped over the core of a roller, thereby eliminating the operations of cutting and helically winding strips of fabric onto a core as was required for fabrication of prior roller covers.

It is desirable, therefore, to provide an improved method and apparatus for knitting material having a pile extending therefrom, in a form which is more amendable for use as a covering for a core of a paint roller. It is also desirable to provide an improved method and apparatus for knitting the covering of a roller without having to resort to the traditional practice of helically winding strips of the knitted fabric onto a core. It is particularly desirable to provide a method and apparatus for knitting the covering of a roller in accordance with the inventor's commonly assigned U.S. patent application Ser. No. 11/740,119 referenced above.

BRIEF SUMMARY OF THE INVENTION

The invention provides a method and apparatus for forming a tubular-shaped knitted covering for a paint roller, or the like, having a pile extending from an outer surface of the covering, through use of a dial needle knitting arrangement. The dial needle knitting arrangement includes a dial, a plurality of dial needles operatively disposed in the dial, a dial cam box disposed adjacent to the dial and operatively connected to the dial needles, a backing yarn feeding arrangement, and a pile yarn feeding arrangement.

Using the dial needle knitting arrangement, a length of tubular-shaped fabric can be provided with the dial needles in such a manner that the backing yarn is exposed on an interior surface of the length of tubular-shaped fabric, and the pile extends outward from an exterior surface of the length of tubular-shaped fabric. The invention allows a tubular-shaped knitted covering having pile extending from an outer surface thereof to be knitted in a small enough diameter that the covering may be simply pulled over and attached to the outer periphery of the core of a roller, to form a completed roller, without having to helically wind strips of the pile covered fabric onto the core in the manner required by prior methods and apparatuses for forming a roller cover.

In one form of the invention, a knitting apparatus for forming a tubular-shaped knitted covering for a paint roller having a pile extending from an outer surface of the covering, includes a dial knitting arrangement having a dial, a plurality of dial needles operatively disposed in the dial, a cam box disposed adjacent to the dial and operatively connected to the dial needles, a backing yarn feeding arrangement and a pile yarn feeding arrangement. The dial is rotatably mounted for rotation about a vertical axis of rotation, and has a periphery of the dial disposed about the axis of rotation. The dial further has a plurality of substantially radially directed dial needle slots opening in an upward direction. The dial cam box is non-rotatably mounted above the dial, and has a downwardly-facing and opening dial needle cam track therein. The dial needles each have a body thereof disposed in a respective dial needle slot, of the plurality of dial needle slots. The dial needles have hooked ends thereof that are outwardly extendable beyond the periphery of the dial, and a dial needle cam lobe extending upward from the dial needle body beyond the dial needle slot and into sliding engagement with the dial needle cam track. The dial needle cam lobes and the dial needle slots are configured such that rotation of the dial causes the dial needles to be selectively moveable radially within the dial needle slots through interaction of the dial needle cam lobes with the dial needle cam track. The backing yarn and pile yarn feeding arrangements are operatively disposed adjacent the periphery of the dial and are adapted for feeding the backing yarn and pile yarn to the dial needles along selected segments of the periphery of the dial.

In some forms of the invention, where the pile yarn is a sliver fiber, the pile yarn feeding arrangement includes a doffer arrangement having a doffer wheel including a sliver feeding surface thereof which is operatively disposed adjacent to a sliver-feed segment of the periphery of the dial, in such a manner that the hooked ends of the dial needles are adapted to receive sliver fiber from the sliver feeding surface of the doffer wheel during operation of the knitting apparatus. The dial needles may be configured to be moveable radially to a tuck position in which the hooks of the dial needles are extended beyond the periphery of the dial, but the previous loop of the backing is not cast off, and the sliver feeding surface is disposed such that the hooks of the dial needles can receive the sliver fiber from the sliver feeding surface while the dial needles are in the tuck position. Because the dial needles need to move radially outward only to the tucked position, rather than a fully extended position, they are better supported within the dial needle slots than they would be in a fully extended position, thereby providing enhanced durability and robustness to the dial knitting arrangement, according to the invention.

The invention is also applicable to knitted fabrics having a pile formed from a length of face yarn, rather than from slivers, wherein the pile yarn feeding arrangement is a face yarn feeder having an output thereof operatively disposed adjacent to a face-yarn-feed segment of the periphery of the dial, in such a manner that the hooked ends of the needles are adapted to pull loops of the face yarn from the output of the face yarn feeder during operation of the knitting apparatus. A cutting arrangement may be operatively disposed for cutting the loops of face yarn to form a pile on the outside of the tubular-shaped knitted covering.

In some forms of the invention, an apparatus or method is provided for knitting a covering including multiple successively knitted courses, with two adjacent courses being knitted simultaneously, and the pile yarn being sliver fibers in one course of the two simultaneously knitted courses and the pile yarn being a face yarn in the other course of the two simultaneously knitted courses. For use of the invention in knitting such a fabric, the pile yarn feeding arrangement may include a doffer arrangement and a face yarn feeder. The doffer arrangement may include a doffer wheel having a sliver feeding surface thereof operatively disposed adjacent to a sliver-feed segment of the periphery of the dial in such a manner that the hooked ends of the dial needles can receive the sliver fiber from the sliver feeding surface of the doffer wheel during operation of the knitting apparatus for knitting one of the two simultaneously knitted courses. The face yarn feeder may have an output thereof operatively disposed adjacent to a face-yarn-feed segment of the periphery of the dial in such a manner that the hooked ends of the dial needles can pull loops of the face yarn fiber from the output of the face yarn feeder during operation of the knitting apparatus. A cutting arrangement may also be provided for cutting the loops of face yarn to form a portion of the pile on the outside of the tubular-shaped knitted covering.

A method and/or apparatus, according to the invention, may be utilized for forming a roller covering having multiple successively knitted courses with two or more adjacent courses being knitted simultaneously, and the pile yarn being sliver fibers in the two or more simultaneously knitted courses. The pile yarn feeding arrangement, in these forms of the invention, may include a separate doffer arrangement for each of the two or more simultaneously knitted courses, with each doffer arrangement including a doffer wheel having a sliver feeding surface thereof operatively disposed adjacent to a sliver-feed segment of the periphery of the dial, in such a manner that the hooked ends of the dial needles can receive the sliver fibers from the sliver feeding surface of the doffer wheel during operation of the knitting apparatus for knitting one of the two simultaneously knitted courses.

In forms of the invention utilized for forming a covering having multiple successively knitted courses with two or more adjacent courses being knitted simultaneously, the backing yarn feeding arrangement may include a first and second backing yarn feeder operatively disposed adjacent the periphery of the dial and adapted for feeding the backing yarn to the dial needles along selected segments of the periphery of the dial for supplying backing yarn for each of the two simultaneously knitted courses.

Some forms of the invention may further include a take-down arrangement disposed below the dial for urging the tubular-shaped knitted covering having outwardly extending pile to move substantially downward along the rotational axis from the dial. Some forms of an apparatus, according to the invention, may include a main bed disposed below and supporting the dial, the dial cam box and the take-down arrangement. The take-down arrangement may be disposed below the main bed.

A take-down arrangement, according to the invention, may include a powered drive roller for urging movement of the tubular-shaped knitted covering with outwardly extending pile, with the powered drive roller being operatively connected to be driven in synchronization with the dial by a common drive motor. In some forms of the invention, a take-down arrangement, according to the invention, rotates about the axis of rotation in synchronization with the dial, and is operatively connected to be rotated about the rotational axis by the common drive motor.

Some forms of the invention may also include a cylinder needle knitting arrangement having a cylinder, a plurality of cylinder needles operatively disposed in the cylinder, and a cylinder cam box disposed adjacent the cylinder and operatively connected to the needles. The cylinder may be rotatably mounted for rotation about the vertical axis of rotation and have a radially outer periphery thereof disposed about the axis of rotation. The cylinder may further include a plurality of substantially axially directed needle slots opening in an upward direction at an upper end of the cylinder. The cylinder cam box may be non-rotatably mounted about the cylinder and have a radially inward facing and opening cylinder needle cam track therein. The cylinder needles may each have a body thereof disposed in a respective cylinder needle slot of the plurality of cylinder needles slots, and a hooked end thereof that is upwardly extendable beyond the upper end of the cylinder. The body of the cylinder needles may further include a cam lobe extending radially outward beyond the cylinder needle slot and into sliding engagement with the cylinder needle cam track, such that rotation of the cylinder causes the cylinder needles to be selectively moveable axially within the cylinder needle slots through interaction of the cylinder needle cam lobes with the cylinder needle cam track. The cylinder and dial are operatively connected for synchronized rotation with respect to one another about the axis of rotation. The dial is disposed axially along the axis of rotation above the upper end of the cylinder. In embodiments of the invention wherein the cylinder needle knitting arrangement is utilized in conjunction with the dial for forming loops of face yarn during formation of the pile, the vertical spacing between the dial and the upper end of the cylinder may be adjustable to thereby allow for adjustment of the length of the pile fibers.

In some forms of the invention having a cylinder needle knitting arrangement, the cylinder needles and cylinder cam box are removable, to allow operation of the knitting machine with only the dial, dial needles and dial cam box. In other forms of the invention, the dial, dial needles and dial cam box are removable, to allow operation of the knitting machine with only the cylinder, cylinder needles and cylinder cam box. In some forms of the invention, the components of both the dial needle knitting arrangement and the cylinder needle knitting arrangement are selectively removable, to thereby allow practice of the invention in a variety of forms.

In forms of the invention utilizing a dial knitting arrangement, a cylinder knitting arrangement, and a take-down arrangement, the dial and cylinder knitting arrangements and the take-down arrangement may all be operatively interconnected to a common drive motor to be rotated about the axis of rotation by the common drive motor.

Forms of the invention utilizing both a dial needle knitting arrangement and a cylinder needle knitting arrangement may be configured such that knitting of the base fabric is carried out totally by the dial knitting arrangement, and both the dial and cylinder knitting arrangements being utilized for knitting the pile yarn into the base fabric. For example, where a roller covering is manufactured according to the invention to include multiple successively knitted courses, with two adjacent courses being knitted simultaneously, and the pile yarn being sliver fibers in one course of the two simultaneously knitted courses and the pile yarn being a face yarn and the other course of the two simultaneously knitted courses, the knitting apparatus may be configured such that knitting of the base fabric and the sliver fibers is carried out totally by the dial knitting arrangement, with both the dial and cylinder knitting arrangements being utilized for knitting the face yarn.

Other aspects, objects and advantages of the invention will be apparent from the following detailed description of exemplary embodiments considered in conjunction with the accompanying drawings of those exemplary embodiments.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
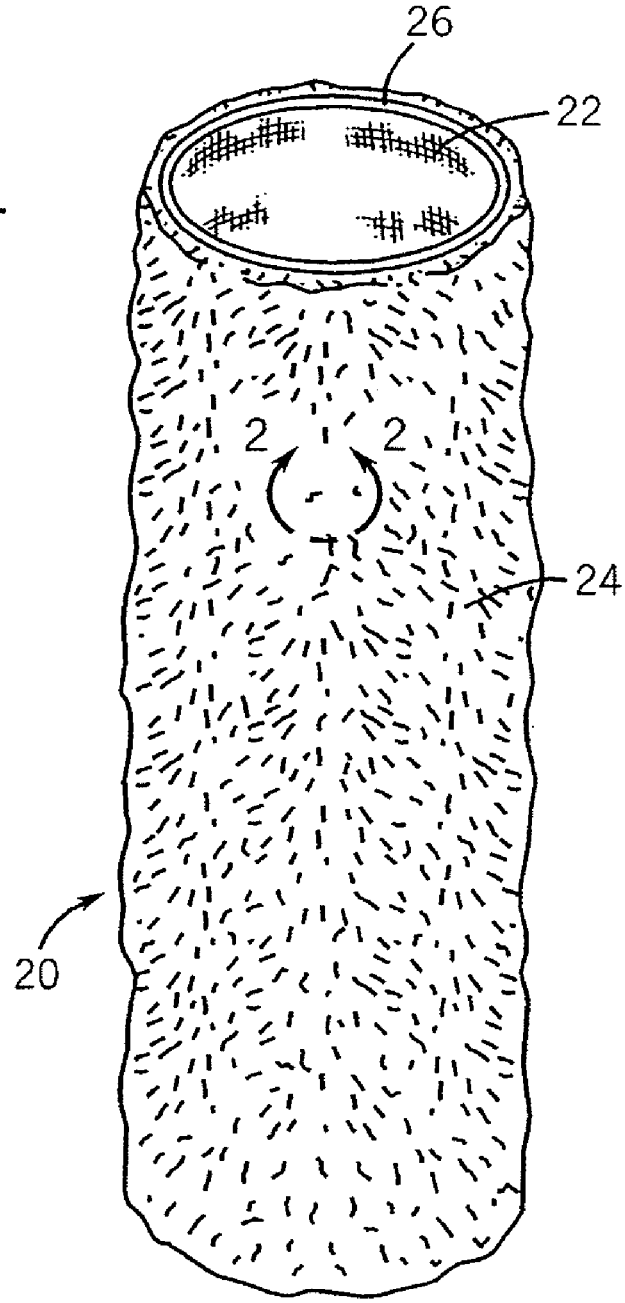
FIG. 1 is an isometric view of a segment of tubular paint roller fabric made according to the teachings of the present invention with the pile extending outwardly, showing a tubular knit base having pile fibers extending outwardly therefrom.

FIG. 1 shows a first exemplary embodiment of a tubular-shaped sliver-knitted covering 20 for a paint roller having pile fibers 24 extending from a lightweight knit backing or base material 22, that is knitted according to a method illustrated in FIGS. 2 through 9, on a first embodiment of a knitting apparatus 100 shown in FIGS. 10 through 13. As will be readily understood by those having skill in the art, the tubular sliver knit segment 20 may be readily pulled over and affixed to a core (not shown) to form a completed roller cover according to one of the methods shown in the inventor's commonly assigned U.S. patent application Ser. No. 11/740,119 or another appropriate manner, without the necessity for resorting to helically wrapping a strip of sliver-knitted fabric about the core as was required in prior roller covers.

A tubular sliver knit segment 20 of the type shown in FIG. 1 may be continuously knitted in an extended length using the exemplary embodiment of the invention described below. The tubular sliver knit segment 20 consists of a lightweight knit backing or base material 22 having pile fibers 24 extending from the knit base material 22 on the outer surface of the tubular sliver knit segment 20. It may be seen from a top edge 26 of the knit base material 22 that the tubular sliver knit segment 20 has an essentially circular cross section. The tubular sliver knit segment 20 may be knitted in as long a length as desired, notwithstanding that FIG. 1 only shows a relatively short segment of the tubular sliver knit segment 20.

Figure 2:
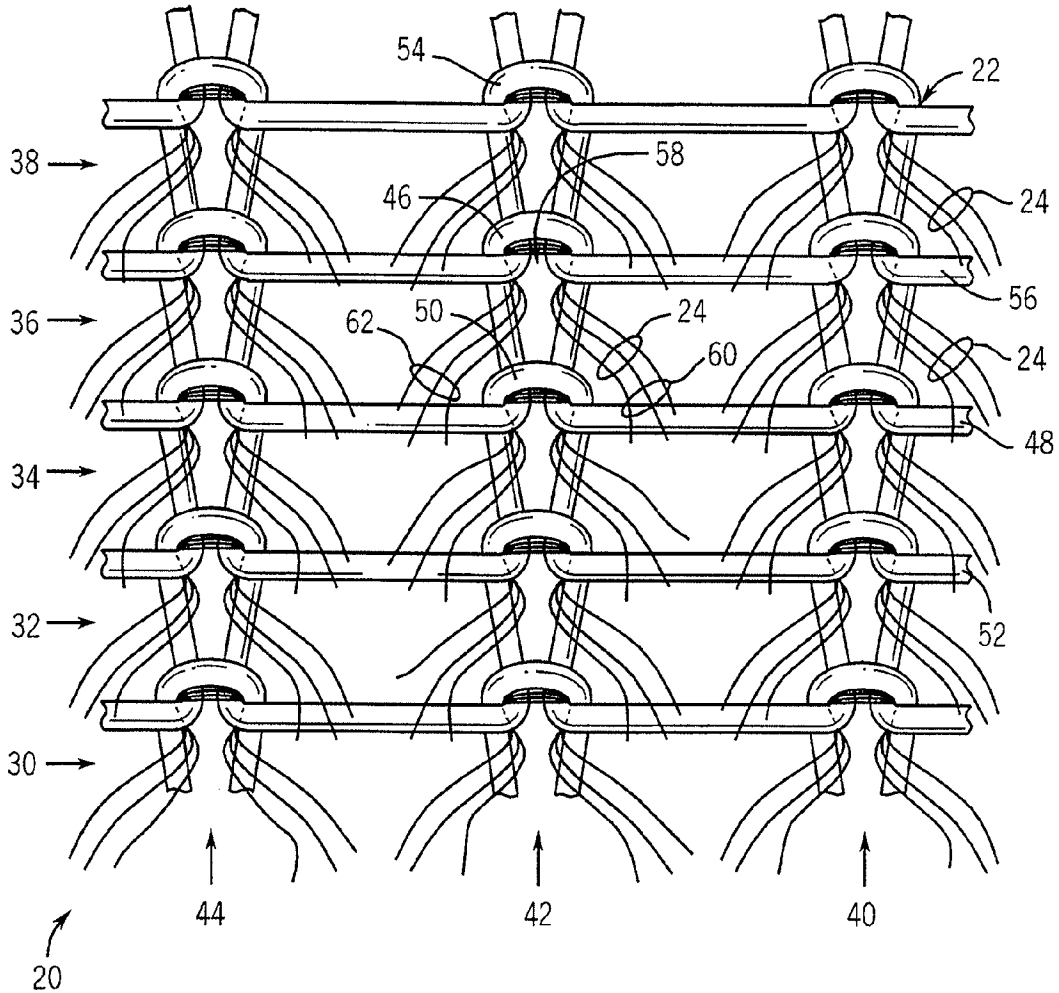
FIG. 2 is a schematic view of a portion of the tubular paint roller fabric illustrated in FIG. 1 from the outside, showing the knitting pattern of the base yarn and the placement of pile fibers from the sliver into the knit base.

Referring next to FIG. 2, a segment of the tubular sliver knit segment 20 is shown in schematic form from the outside thereof to illustrate the knit of the knit base material 22, and the manner in which tufts of the pile fibers 24 are woven into the knit base material 22. Those skilled in the art will at once realize that while the tufts of the pile fibers 24 shown in FIG. 2 include only a few fibers each for added clarity and understanding of the construction of the pile fabric 20, tufts of the pile fibers 24 in the tubular sliver knit segment 20 will actually include sufficient pile fibers 24 to make a pile that is sufficiently dense for the intended use of the tubular sliver knit segment 20 in the manufacture of a paint roller cover.

The foundation of the tubular sliver knit segment 20 is the knit base material 22, which may be knit in a highly modified single jersey circular knitting process on a radically redesigned circular knitting machine, according to the invention, such as one of the exemplary embodiments described below. The knit base material 22 has a plurality of courses (which are rows of loops of stitches which run across the knit fabric), five of which are shown and designated by the reference numerals 30, 32, 34, 36, and 38, and a plurality of wales (which are vertical chains of loops in the longitudinal direction of the knit fabric), three of which are shown and designated by the reference numerals 40, 42, and 44. The respective courses 30, 32, 34, 36, and 38 are knitted sequentially from the lowest course number to the highest course number.

By way of example, the construction of the portion of the tubular sliver knit segment 20 in the area of the course 36 and the wale 42 will be discussed herein. A loop 46 formed in a yarn segment 48 is located in this area, with a loop 50 formed in a yarn segment 52 being located in the course 34 below the loop 46, and a loop 54 formed in a yarn segment 56 being located in the course 38 above the loop 46. The loop 46 extends through the loop 50 from the outside to the inside of the tubular sliver knit segment 20 (shown in FIG. 2), and the loop 54 also extends through the loop 46 from the outside to the inside. It will at once be appreciated by those skilled in the art that this arrangement of loops in sequentially knitted courses is completely opposite to the way in which sliver knit fabrics have been knitted on known circular knitting machines.

A tuft of pile fibers 24 having a loop portion 58 and opposite end portions 60 and 62 is knitted into the knit base material 22 together with the loop 46. The loop portion 58 of that particular tuft of pile fibers 24 is located adjacent the top of the loop 46, and the opposite end portions 60 and 62 of that particular tuft of pile fibers 24 extend outwardly from the interior of the loop 46, above the loop 50 and below the loop 54. In a similar manner, each of the other tufts of the pile fibers 24 is knitted into the knit base material 22 with a different loop.

Figure 3:
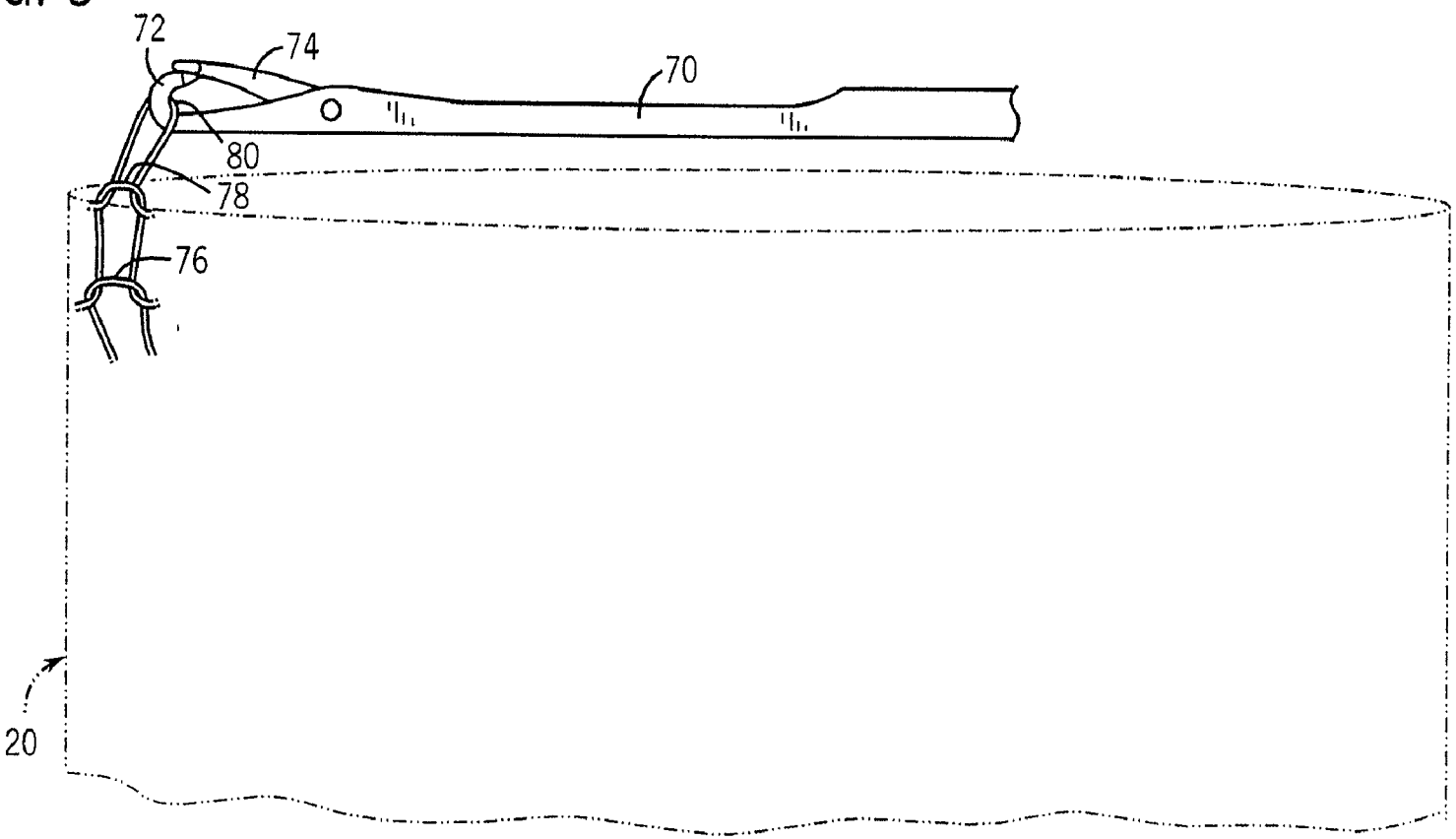
FIG. 3 is a schematic view of a knitting needle having a hook located at the distal end thereof and a latch pivotally mounted at a position proximal from the hook, the knitting needle being used to knit a tubular paint roller fabric similar to the one illustrated in FIGS. 1 and 2, with the needle being in a resting position with regard to an old loop.
Figure 4:
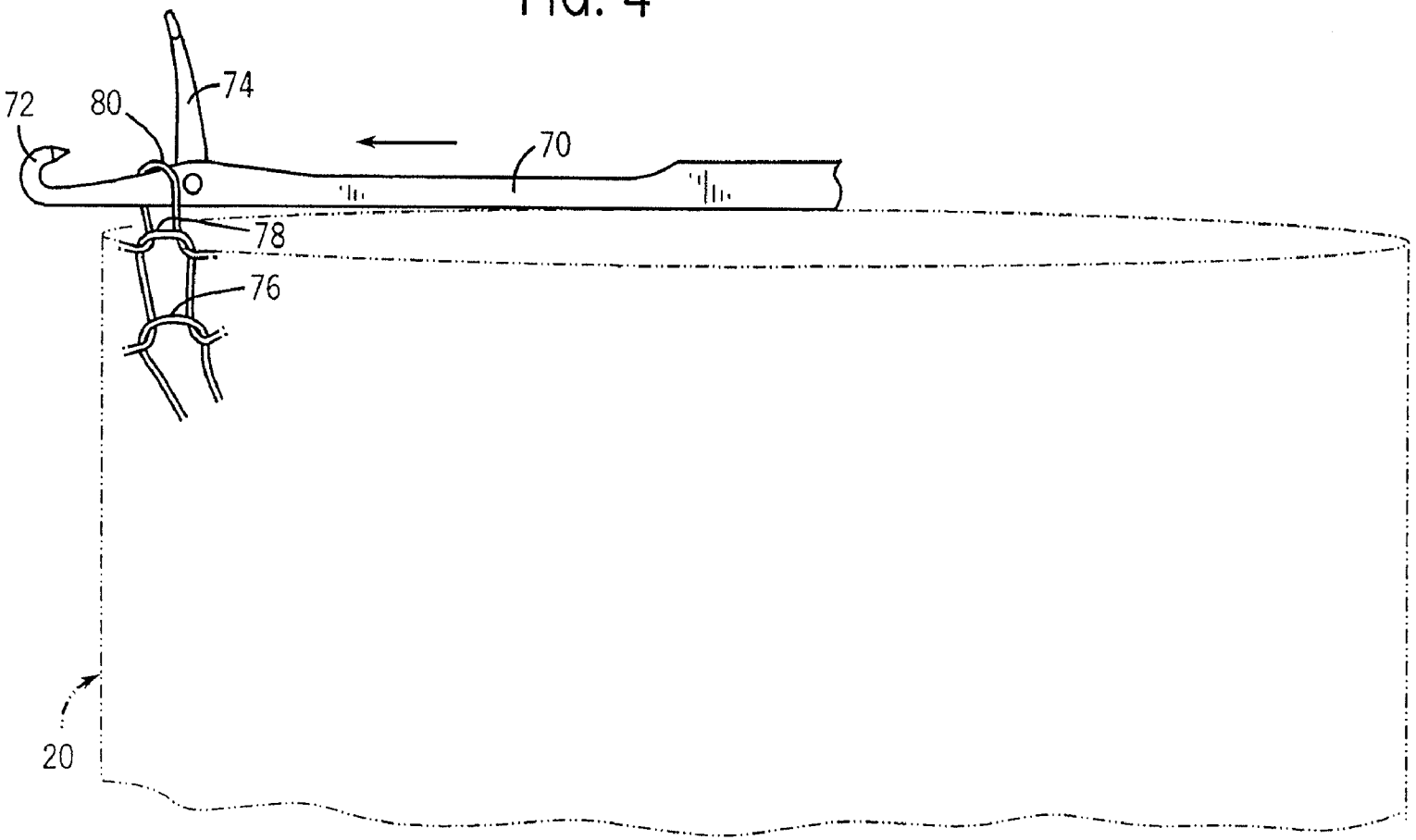
FIG. 4 is a schematic view of the knitting needle and the tubular paint roller fabric shown in FIG. 3, with the needle moving in a distal direction and the old loop opening the latch of the needle.
Figure 5:
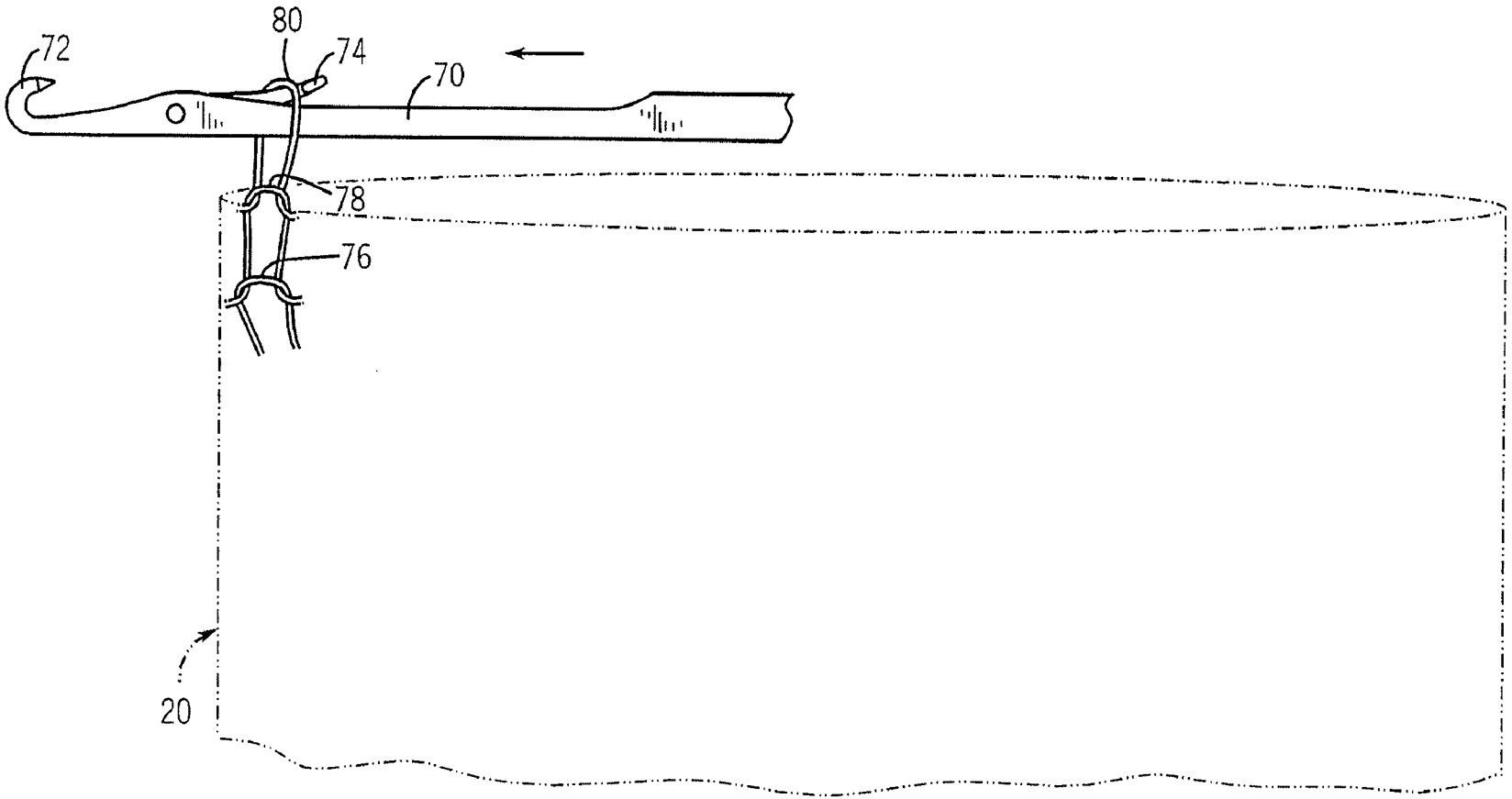
FIG. 5 is a schematic view of the knitting needle and the tubular paint roller fabric shown in FIGS. 3 and 4, with the needle continuing to move in a distal position and the latch being in a tuck position.
Figure 6:
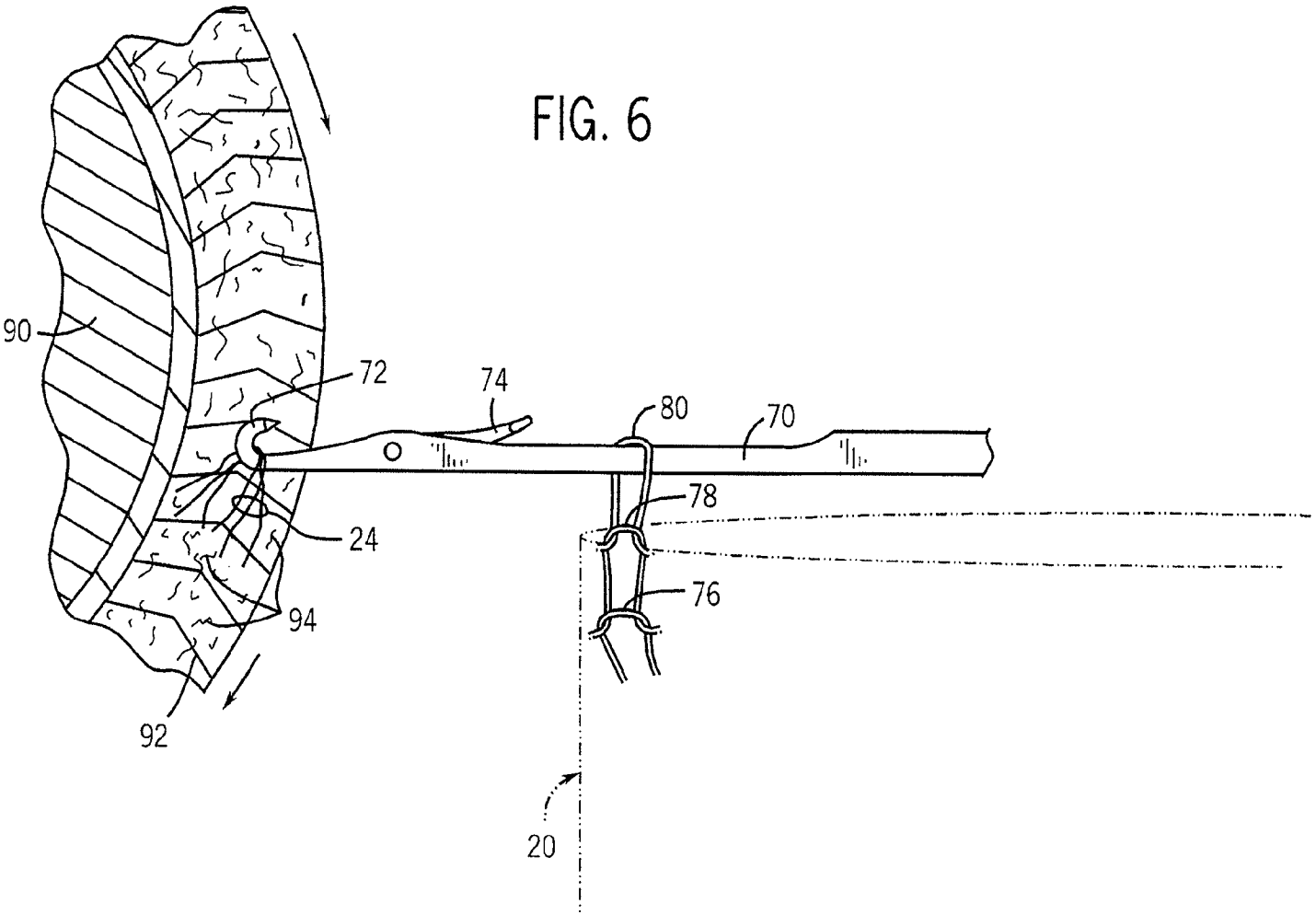
FIG. 6 is a schematic view of the knitting needle and the tubular paint roller fabric shown in FIGS. 3 through 5 and also showing a doffer roll having a wire face with sliver fibers thereon, with the needle being in a doff position (its fully distal position) and sliver fiber from the doffer roll being received on the hook of the needle.
Figure 7:
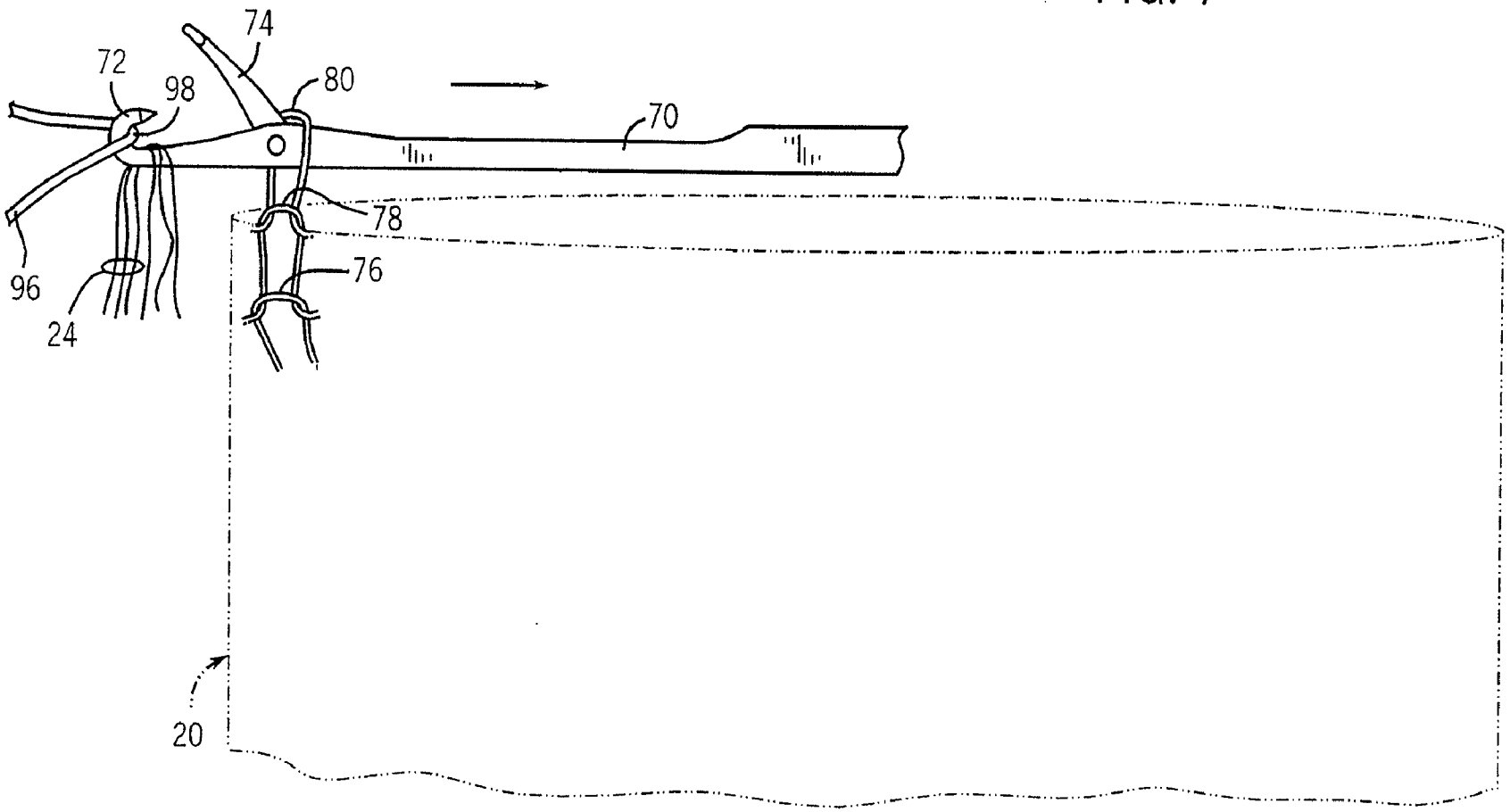
FIG. 7 is a schematic view of the knitting needle and the tubular paint roller fabric shown in FIGS. 3 through 6, with the needle moving in a proximal direction and the hook capturing the base yarn for a new loop in the vertical chain of loops, and with the latch being closed by the old loop as the needle moves in the proximal direction.

FIGS. 3 through 9 illustrate a sliver knitting process which may be used to knit the tubular sliver knit segment 20 shown in FIGS. 1 and 2. These figures show in sequential fashion how a stitch is formed. Each of these figures shows a needle 70 having a hook 72 located at the distal end thereof and a latch 74 that has a proximal end that is pivotally mounted at a location on the needle 70 that is proximal of the hook 72. The latch 74 can pivot between a closed position (shown in FIGS. 3, 8, and 9) in which the distal end of the latch 74 contacts the end of the hook 72 to form an enclosed area with the hook 72, and an opened position (shown in FIGS. 5 and 6) in which the distal end of the latch 74 forms a small acute angle with the proximal end of the needle 70. FIGS. 4 and 7 show the latch 74 in intermediate positions.

FIGS. 3 through 9 also show the tubular sliver knit segment 20 in phantom lines, with only several loops in a single wale being shown in solid lines. Specifically, sequential loops 76, 78, and 80 are shown in each of FIGS. 3 through 9, with the loops 76, 78, and 80 being in courses that are knitted sequentially from the course containing the lowest loop number to the course containing the highest loop number. The knitting process shown in FIGS. 3 through 9 shows the knitting of a new loop 98 in a new course being knit above the loop 80.

Note that in each of FIGS. 3 through 9, the needle 70 is generally located inside the tubular sliver knit segment 20 with its distal end (the end with the hook 72) extending from the interior of the tubular sliver knit segment 20 outwardly. Thus, movement of the needle 70 in a proximal direction is defined as movement radially inwardly with respect to the tubular sliver knit segment 20, and movement of the needle 70 in a distal direction is defined as movement radially outwardly with respect to the tubular sliver knit segment 20. Those skilled in the art will at once appreciate that the location, orientation, and movement of the needle 70 is radically different from the location, orientation, and movement of needles in currently known circular knitting machines. (The needles in currently known circular knitting machines are typically oriented essentially parallel to the axis of the tubular segment being knit, with the hooks of the needles located above the top end of the tubular segment being knit.)

Referring first to FIG. 3, the needle 70 is in its fully proximal or resting position, with the loop 80 engaged by the hook 72 of the needle 70 (near the distal-most end of the needle 70) and with the latch 74 in its closed position with the distal end of the latch 74 adjacent the distal end of the hook 72.

Referring next to FIG. 4 in contrast with FIG. 3, it may be seen that the needle 70 has moved in a distal direction, and the loop 80 has opened the latch 74 and caused the latch 74 to move to a position approximately midway between its closed and opened positions. Note that the loop 80 is adjacent the proximal end of the latch 74.

Referring now to FIG. 5 in contrast with FIG. 4, it may be seen that the needle 70 has continued to move in a distal direction, and the loop 80 is located nearly at the distal end of the latch 74 with the latch 74 remaining in the opened position. In this position, the loop 80 is about to fall off of the latch 74, although the loop 80 will remain on the needle 70.

Referring next to FIG. 6, another element of the circular knitting machine of which the needle 70 is a part is shown for the first time—a doffer roll 90 having a wire face 92. The doffer roll 90 is part of a doffer arrangement of the circular knitting machine the construction and operation of which are well known to those skilled in the art. Those skilled in the art will immediately appreciate that the location and orientation of the doffer roll 90 is also radically different from the location and orientation of doffer rolls in currently known circular knitting machines. (The doffer rolls in currently known circular knitting machines are located above the hooks of the needles, which needles, as mentioned above, are oriented parallel to the axis of the tubular segment being knit, with the hooks of the needles being located above the top end of the tubular segment being knit.)

The doffer roll 90 is rotating in a clockwise direction, and it carries sliver fibers 94 in the wire face 92, the sliver fibers 94 being supplied from a sliver rope (not shown) being fed into the head (not shown) that contains the doffer roll 90 and the wire face 92. As may be seen in FIG. 6 in contrast with FIG. 5, the needle 70 has moved to its fully distal position, which places the hook 72 of the needle 70 into the wire face 92 of the doffer roll 90. The rotation of the doffer roll 90 causes some of the sliver fibers 94 in the wire face 92 to become engaged by the hook 72, forming a tuft of pile fibers 24 on the hook 72. It may also be noted that with the needle 70 in its fully distal position, the loop 80 has slipped entirely off of the latch 74, and is located on the needle 70 in a position that is proximal to the latch 74. It is noted, however, that in some embodiments, such as those forming a pile from a yarn rather than sliver fibers, for example, the needles 70 may only need to move outward to a "tuck" position, as shown in FIG. 5, to have the hook 72 receive a tuft of sliver fibers 24. Having the needles 70 move outward to only the tuck position provides more support for the needles 70, and may provide a more robust design.

Referring now to FIG. 7 in contrast with FIG. 6, it may be seen that the needle 70 has begun to move in a proximal direction with the tuft of the pile fibers 24 still being located on the hook 72 of the needle 70. The hook 72 is now located away from the wire face 92 of the doffer roll 90 (not shown in FIG. 7), and the hook 72 has also engaged a backing yarn segment 96 and begun to form a new loop 98 of the backing fabric 22. As the needle 70 has moved distally, the loop 80 has moved in a proximal direction on the needle 70 and has engaged the latch 74, causing it to move from its opened position toward its closed position (it is shown in FIG. 7 as having moved slightly past its midway position).

Figure 8:
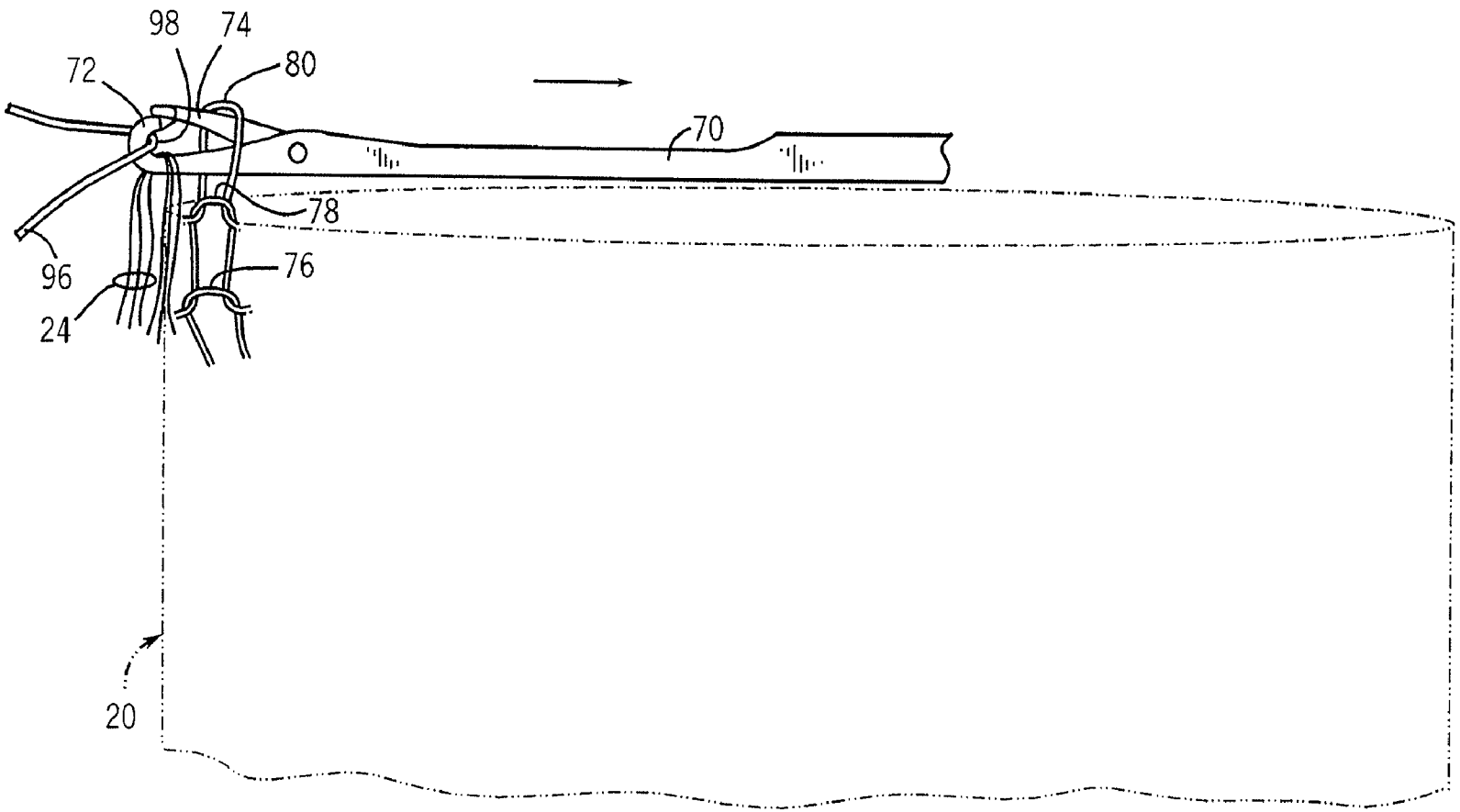
FIG. 8 is a schematic view of the knitting needle and the tubular paint roller fabric shown in FIGS. 3 through 7, with the needle continuing to move in a proximal direction and the latch being completely closed.

Referring next to FIG. 8 in contrast with FIG. 7, it may be seen that the needle 70 has continued to move in a proximal direction, with both the tuft of the pile fibers 24 and the loop 98 of the backing yarn segment 96 still being located on the hook 72 of the needle 70. As the needle 70 has continued to move distally, the loop 80 has moved in a proximal direction on the needle 70 and has begun to slide over the latch 74, which is now in its closed position. The fact that the latch 74 is closed also assists in retaining both the tuft of the pile fibers 24 and the loop 98 of the yarn segment 96 on the hook 72 of the needle 70.

Figure 9:
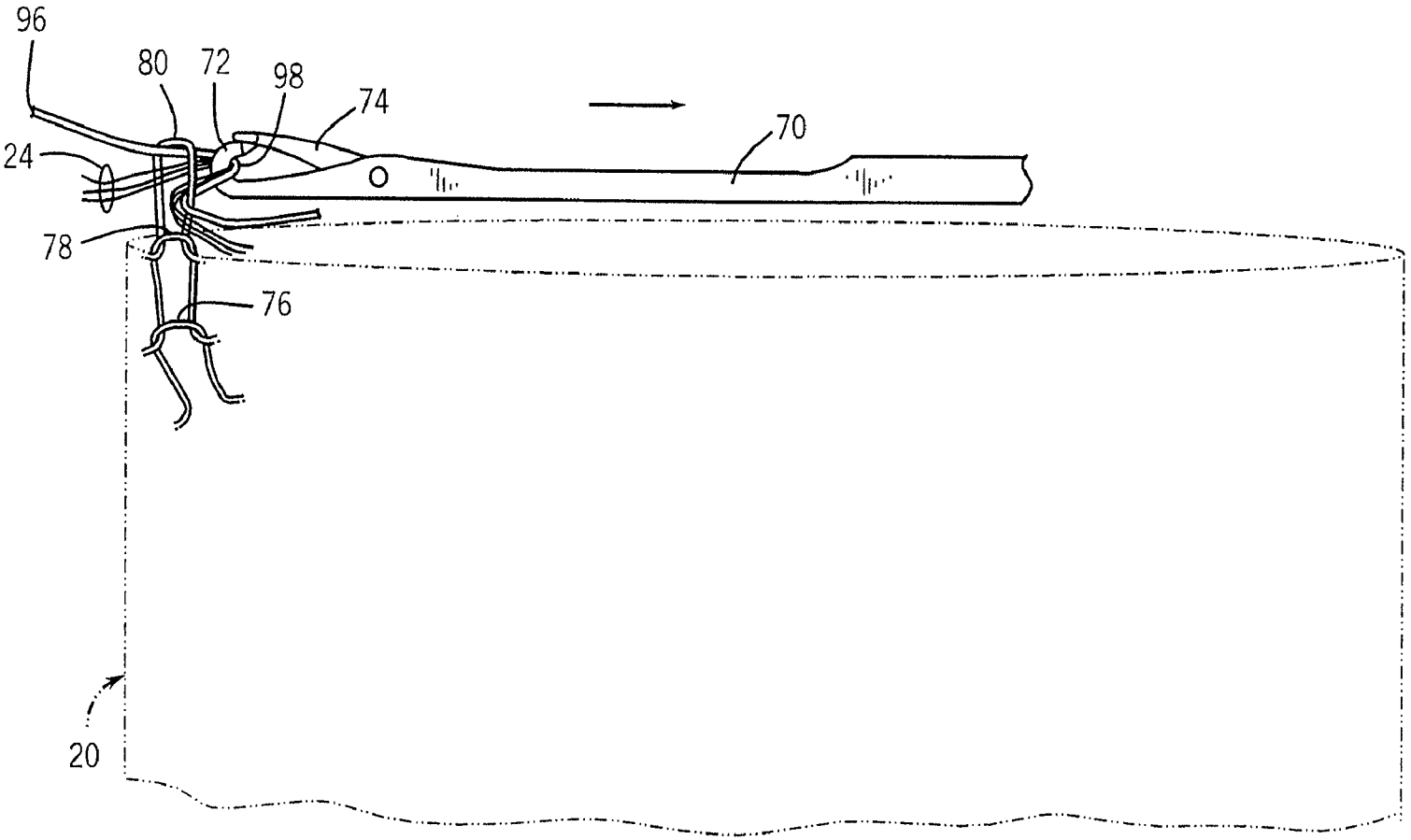
FIG. 9 is a schematic view of the knitting needle and the tubular paint roller fabric shown in FIGS. 3 through 8, with the needle in its fully proximal direction and with the old loop having been cast off and the new loop having been formed.

Referring next to FIG. 9 in contrast with FIG. 8, it may be seen that the needle 70 has moved nearly to its fully proximal or resting direction, and has pulled the loop 98 of the backing yarn segment 96 and the loop of the tuft of the pile fibers 24 through the loop 80. As this happened, the loop 80 slipped off of the hook 72 and the latch 74 of the needle 70. This is referred as the loop 80 having been "cast off" the needle 70. Thus, the loop 98 has been knitted through the loop 80, with the tuft of the pile fibers 24 having their midpoints adjacent the top of the loop 98, and their ends extending outwardly from the tubular sliver knit segment 20. Thus, the tubular sliver knit segment 20 is knitted with the pile fibers 24 extending outwardly.

Those skilled in the art will appreciate that while the process shown in FIGS. 3 through 9 has been depicted with only a single needle 70, a plurality of needles may be used in practicing the invention, all located, oriented, and moving in a manner similar to that described with reference to the needle 70. In various embodiments, for example, it is contemplated that between forty and one hundred needles may be used, with the exemplary embodiment 100 described below in relation to FIGS. 10 through 13 having approximately fifty-six needles. It will be appreciated by those skilled in the art that the number of wales produced by a circular knitting machine is the same as the number of needles used by the circular knitting machine.

A wide variety of materials may be used to knit the tubular sliver knit segment 20, and the tubular sliver knit paint roller cover fabric of the present invention may be made of virtually any of the materials used for knitting sliver knit fabrics in the past. For example, the yarn may be made of synthetic yarns, with the pile being made of natural or synthetic fibers, or a blend of natural and synthetic fibers. Synthetic fibers used in the knit base may be, for example, polyester, acrylic, polypropylene, aramid, and spandex, or a blend of any of the aforementioned. Fibers used in the pile may be, for example, wool, polyester, acrylic, nylon, modacrylic, rayon, polypropylene, and aramid, or a blend of any of the aforementioned. Experience has shown that the invention may be practiced with efficacy using yarn deniers as high as 900, and fiber lengths between approximately three-eighths of an inch (nine and one-half millimeters) and four inches (one hundred two millimeters), although yarn deniers and fiber lengths outside these ranges may be useable as well. It will be understood, by those having skill in the art, that the aforestated values and ranges of yarn denier and length are provided solely for purposes of explanation and illustration of exemplary embodiments of the invention and are not to be taken as limitations on the scope or practice of the invention.

As shown in FIGS. 10 through 13, the first exemplary embodiment of a knitting apparatus 100, for forming a tubular-shaped knitted covering for a paint roller, or the like, having a pile extending from an outer surface of the covering includes a dial knitting arrangement 102, having: a dial 104; a plurality of dial needles 106 operatively disposed in the dial 104; a dial cam box 108 disposed adjacent to the dial 104 and operatively connected to the dial needles 106; a backing yarn feeding arrangement 110; a pile yarn feeding arrangement 112; and a take-down arrangement 114; all operatively mounted on a frame 116 and driven through a drive arrangement 118 by a common drive motor 120.

The frame 116 defines a main vertical axis of rotation 122 and includes an upper main bed 124 and a lower main bed 126. The upper and lower main beds 124, 126 are connected to, and spaced axially from, one another by three main bed supports 130, 132, 134.

The drive arrangement 118 includes an upper rotatable plate, in the form of an upper large gear 136 which is operatively attached by an upper large gear bearing 138 to the upper main bed 124 for rotation about the main axis of rotation 122 within a cavity inside of the upper main bed 124. In similar fashion, a lower rotatable plate, in the form of a lower large gear 140 is operatively attached by a lower large gear bearing 142 to the lower main bed 126 for rotation about the main axis of rotation 122 within a cavity inside of the lower main bed 126.

The drive arrangement 118 also includes a main drive shaft 144 which is rotatably mounted for rotation about a second axis of rotation 146 which extends substantially parallel to the main vertical axis of rotation 122. The main drive shaft 144 is operatively connected to the upper and lower large gears respectively through upper and lower gear trains 148, 150, each of which has a drive gear fixedly attached to the main drive shaft 144 connected in a gear mesh relationship through an idler gear to the upper and lower large gears 136, 140 respectively. By virtue of this arrangement, rotation of the upper and lower large gears 136, 140 are synchronized to one another in a fixed relationship to rotation of the main drive shaft 144. The common drive motor 120 is operatively coupled, through a cogged belt drive arrangement 152 to the main drive shaft 144, for rotatably driving the main drive shaft 144 about the second axis of rotation 146.

The dial 104 is attached to and axially disposed below the upper large gear 136 by a dial drive shaft 154 for rotation about the main vertical axis of rotation 122. Specifically, an upper end of the dial drive shaft 154 is fixedly attached to the upper large gear 136, and the dial 104 is fixedly attached to the lower, distal, end of the dial drive shaft 154.

Figure 12:
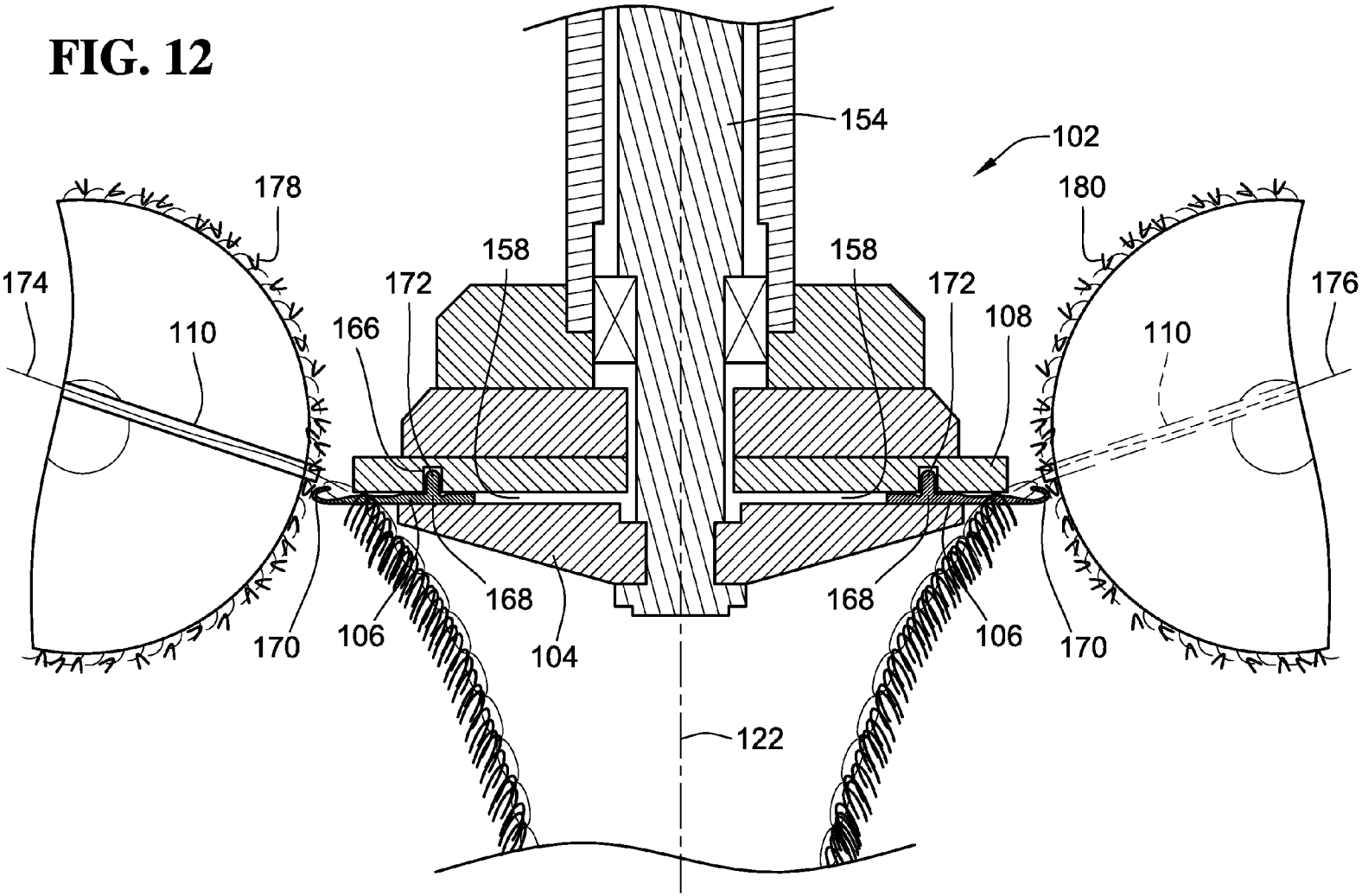
FIG. 12 is an enlarged, partially cut-away view of a dial knitting arrangement, of the exemplary embodiment of the knitting apparatus shown in FIGS. 10 and 11.
Figure 13:
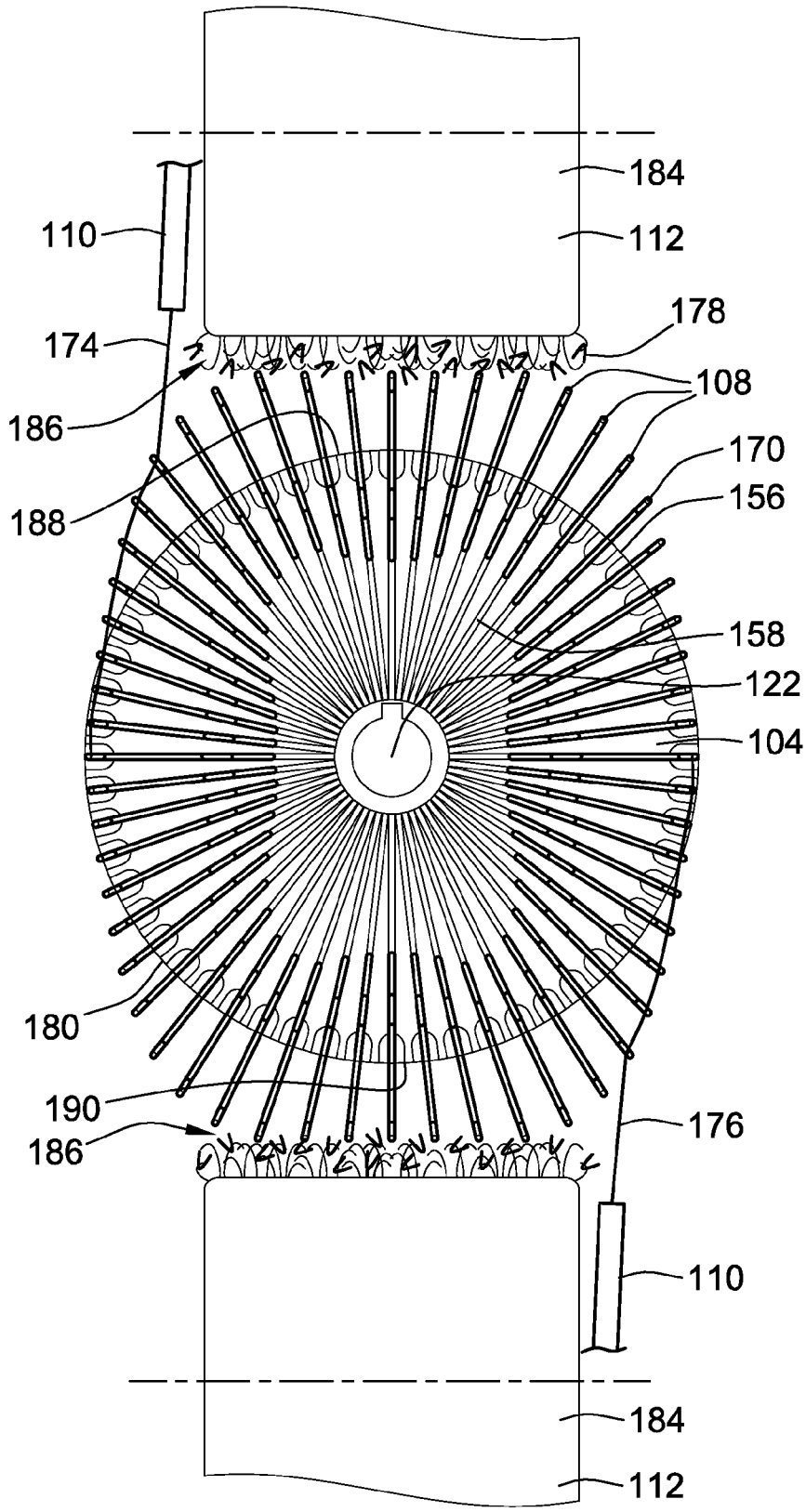
FIG. 13 is a schematic illustration, looking down on the top of a dial of the dial knitting arrangement of FIG. 12.

As shown in FIGS. 12 and 13, the dial 104 has a periphery 156 thereof, which is substantially circular in the exemplary embodiment of the dial 104, and disposed about the main vertical axis of rotation 122. The dial 104, in the exemplary embodiment of the knitting apparatus 100, also has 56 substantially radially directed dial needle slots 158 opening in an upward direction, with each dial needle slot 158 being configured for slidably receiving one of the dial needles 106.

Figure 11:
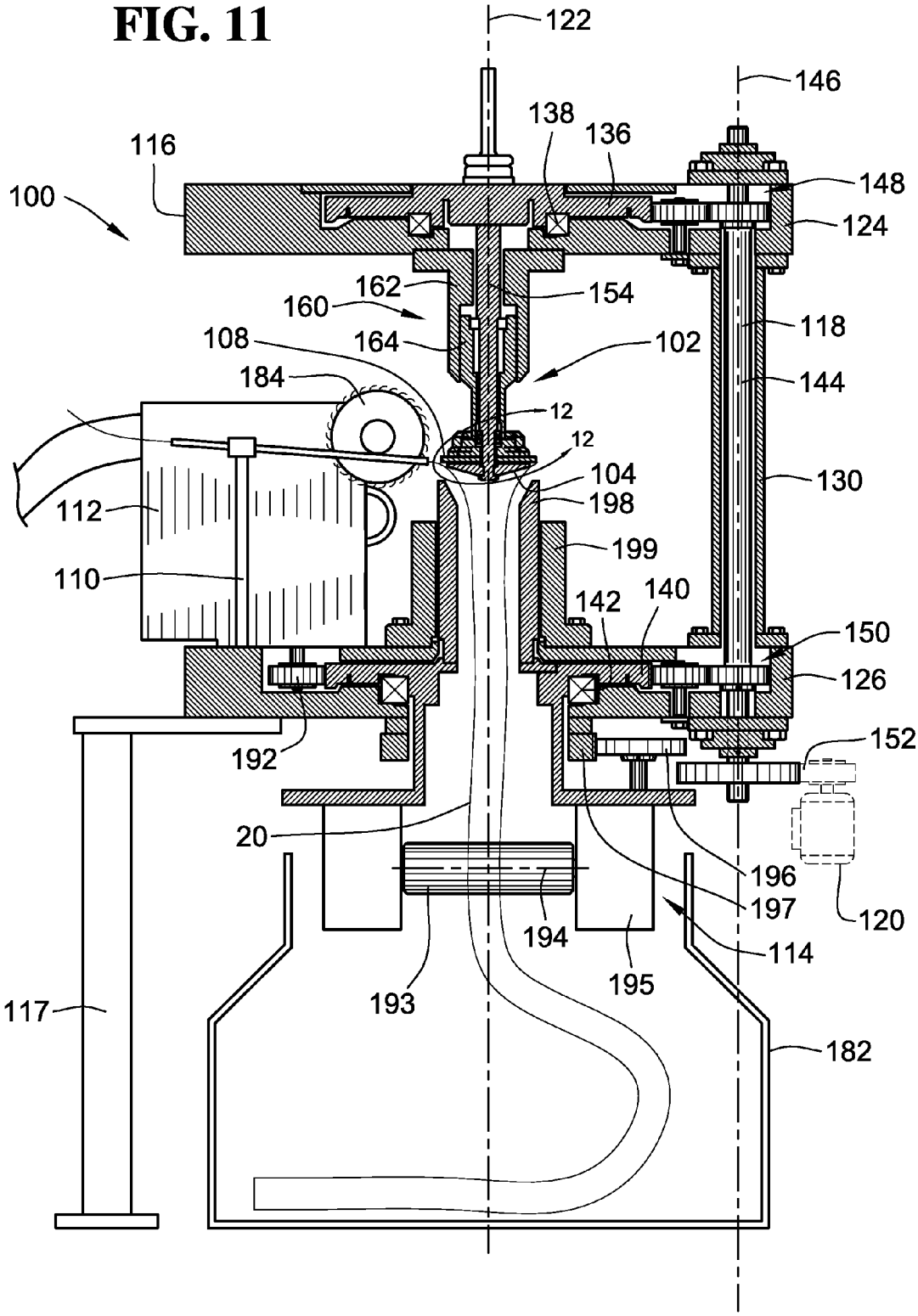
FIG. 11 is a partially cut-away sectional view of the first exemplary embodiment of the knitting apparatus shown in FIG. 10.

As best seen in FIG. 11, the dial cam box 108 is non-rotatably mounted to the upper main bed 124 through a two-part adjustment pedestal arrangement 160, having an upper fixed pedestal 162 fixedly attached to the upper main bed 124, and a lower moveable pedestal element 164 which is telescopically inserted into the upper fixed pedestal element 162 for movement along the vertical main axis of rotation 122 for adjusting the vertical location of the dial 104 and dial cam box 108, in a manner described in further detail below. The pedestal mounting arrangement 160 supports the dial cam box 108 above the dial 104. The dial cam box 108 includes a downwardly-facing and opening dial cam box cam track 166 therein.

The dial needles 106 each have a body 168 thereof disposed in a respective dial needle slot 158. Each of the dial needles 106 also has a hooked end 170 that is outwardly extendable beyond the periphery 156 of the dial 104, and a needle cam lobe 172 extending upward beyond the dial needle slot 158 and into sliding engagement with the dial cam box needle track 166, in such a manner that rotation of the dial 104 causes the dial needles to be selectively moveable radially within the dial needle slots 158 through interaction of the dial needle cam lobes 172 with the dial needle cam track 166. Each dial needle also includes a latch 173 (see FIG. 19) pivotably attached to the body 168 of the needle 106 adjacent the hooked end 170, and operable in the same manner as the latches 74 shown in FIGS. 3 through 9.

As schematically illustrated in FIGS. 12 and 13, the backing yarn and pile feeding arrangements 110, 112 are operatively disposed adjacent the periphery 156 of the dial 104, and adapted for feeding the backing yarn 174, 176 and pile sliver fibers 178, 180 to the dial needles 106 along selected segments of the periphery 156 of the dial 104, in such a manner that an extended length of tubular-shaped knitted covering 20 for a paint roller having a pile 24 extending from an outer surface of the covering 20 may be knitted with the first exemplary embodiment of the knitting apparatus 100, according to the method laid out in detail above with reference to FIGS. 1 through 9, and collected in a container 182 disposed below the lower main bed 126 of the knitting apparatus 100.

As will be understood by those having skill in the art, and as illustrated schematically in FIGS. 12 and 13, the first exemplary embodiment of the knitting apparatus 100 described above is adapted for producing a knitted covering 20 wherein the pile yarn 178, 180 is a sliver fiber and the pile yarn feeding arrangement 112 takes the form of a doffer arrangement. The doffer arrangement includes a doffer wheel 184 which has a sliver feeding surface 186 thereof that is operatively disposed adjacent to one or the other of two sliver/feed segments 188, 190 of the periphery 156 of the dial 104 in such a manner that the hooked ends 170 of the dial needles 106 can receive the sliver fiber 24 from metal hooks on the sliver feeding surface 186 of the doffer wheel 184 during operation of the knitting apparatus 100 in the manner described in greater detail above with regard to FIGS. 1 through 9.

It will be noted that, the exemplary embodiment of the knitting apparatus 100, described above and shown in FIGS. 10 through 13 includes two doffer arrangements 112, for feeding the pile yarn in the form of sliver fibers 24 to the hooked ends 170 of the dial needles 106, and two backing yarn feeding arrangements 110 for feeding two separate strands of backing yarn 174, 176 to backing yarn receiving segments of the periphery 156 of the dial 104, such that two courses of knitted fabric are produced for each rotation of the dial 104 about the vertical axis of rotation, with the first course being formed by loops of backing yarn 174 and containing sliver fibers 186 from a first corresponding pair of the backing yarn and pile yarn feeders 110, 112 and the second, successive, course having loops formed from a second strand of backing yarn 176 and a second set of sliver fibers 180 provided by the second backing yarn and pile yarn feeding arrangements 110, 112. It will be further noted that, although not shown in the drawings, of the exemplary embodiments described herein for purposes of simplifying the explanation of the invention, any of the exemplary embodiments or other embodiments of the invention may include additional elements known in the art, such as a blower mechanism for aiding formation and directing orientation of the pile.

As shown in FIG. 11, in the first exemplary embodiment of the knitting apparatus 100, the doffer arrangements 112 are mounted on an upper side of the lower main bed 126 and include a drive arrangement having a doffer drive gear 192 which operatively engages with the lower large gear 140, in such a manner that the doffer wheels 184 of the doffer arrangements 112 are driven ultimately by the same common drive motor 12 which drives the remainder of the components of the first exemplary embodiment of the knitting apparatus 100. In this manner, the rotation and speed of the doffer wheels 184 are synchronized with rotation of the dial 104 about the main vertical axis of rotation 122.

Figure 10:
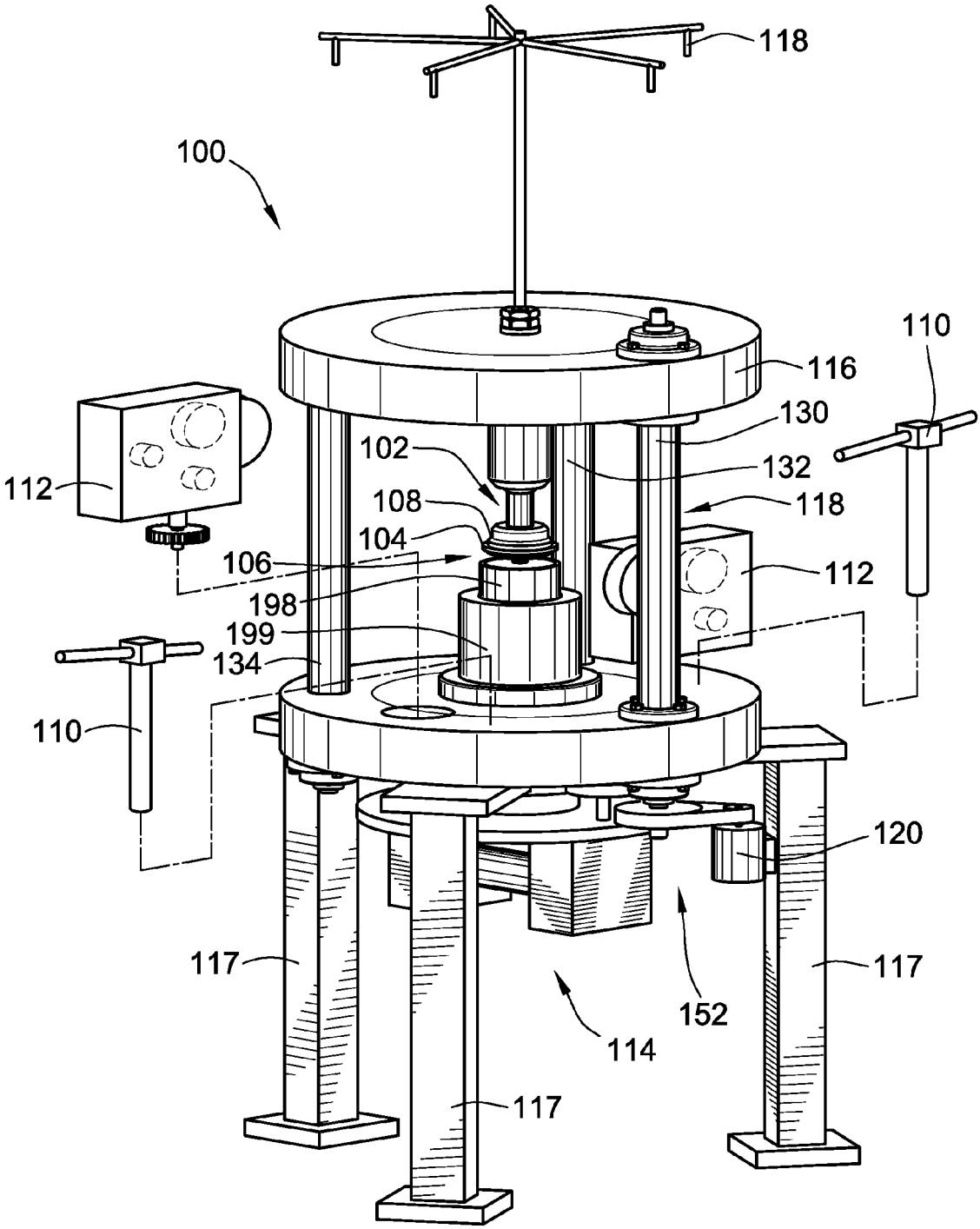
FIG. 10 is a perspective, partially exploded, view of a first exemplary embodiment of a knitting apparatus, according to the invention, for forming a tubular-shaped knitted covering for a paint roller having a pile of sliver fibers extending from an outer surface of the covering.

As shown in FIGS. 10 and 11, the take-down arrangement 114, in the first exemplary embodiment of the knitting machine 100, according to the invention, is mounted below the lower main bed 126 and is fixedly attached to the lower large gear 140 in such a manner that the entire take-down arrangement 114 rotates with the lower large gear 140 about the main vertical axis of rotation 122. The take-down arrangement 114 includes a take-down drive roller 193 which is positioned to rotate substantially about a take-down drive roller axis 194 that intersects and extends substantially perpendicular to the main vertical axis 122. The take-down drive roller 193 is driven about its rotational axis 194 by a take-down gear-drive arrangement 195 having an input gear 196 thereof arranged in a gear mesh relationship with a ring gear 197 disposed about the main vertical axis 122 and fixedly attached to the lower main bed 126 in such a manner that, as the take-down arrangement 114 is rotated about the main vertical axis 122 by the lower large gear 140, the gear mesh relationship between gears 196 and 197 is converted into rotary motion of the take-down roller 193 about its axis 194. As is illustrated in FIG. 11, the elongated tubular knitted roller covering 20 is fed through the take-down arrangement 114 in such a manner that as the tubular covering 20 is continuously knitted, it is continually pulled downward by the drive roller 193 of the take-down arrangement to be deposited within the container 182.

Figure 14:
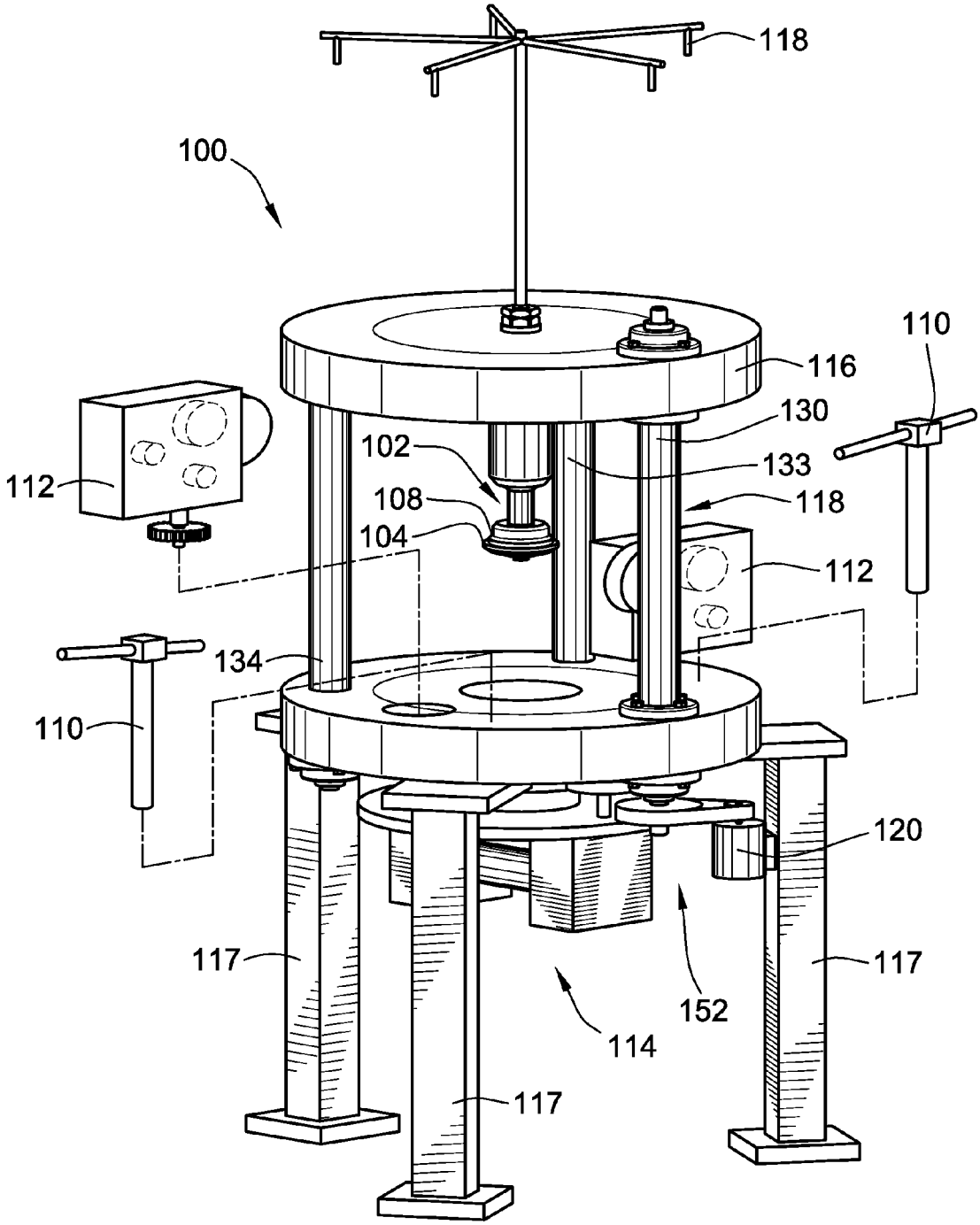
FIG. 14 is a perspective partially exploded illustration of a variation of the first exemplary embodiment of the knitting machine shown in FIG. 10 configured for operation without a needle-less cylinder and cylinder cam box to better accommodate some knitting processes carried out by the first exemplary embodiment of the knitting machine according to the invention.

As shown in FIG. 11, the first exemplary embodiment of the knitting apparatus 100 also includes a cylinder 198 disposed about the main vertical axis 122 and having a lower end thereof affixed to the lower main gear 140, for rotation therewith, and an upper end thereof disposed closely adjacent and below the lower surface of the dial 104. The first exemplary embodiment of the knitting machine 100 further includes a cylinder cam box 199 which is fixedly attached to an upper surface of the lower main bed 126 and disposed about the cylinder 198. The cylinder 198 and cylinder cam box 199 are provided, in the first exemplary embodiment of the knitting apparatus 100, to allow the apparatus 100 to be used for knitting roller coverings having pile fibers formed from a continuous length of pile yarn, in a manner described in more detail below with regard to other exemplary embodiments of knitting apparatuses in accordance with the invention. The cylinder and cylinder cam box 198, 199 are not necessarily required for forming the roller covering 20 having an outwardly extending pile formed entirely of sliver fibers 24, as described herein above thus far with respect to FIGS. 1 through 13. In fact, in some forms of an apparatus or method, according to the invention, it may be desirable to remove the cylinder and cylinder cam box 198, 199 and configure the knitting apparatus 100 in the manner illustrated in FIG. 14, when knitting a tubular roller covering 20 having a pile surface on the outside thereof totally formed from sliver fibers 24.

The first exemplary embodiment of the knitting apparatus 100, according to the invention, also includes a machine support structure extending below the lower main bed 126 and adapted for supporting the knitting apparatus 100 on a support surface external to the knitting apparatus 100, as illustrated by the legs 117 in FIGS. 10 and 11, or any other appropriate support structure. The backing yarn 174, 176 may be supplied to the backing yarn feeding apparatuses 110 through any appropriate manner, such as being supplied by spools or cones suspended from the hanging arrangement 118 shown in FIGS. 10 and 14, or from free-standing creels disposed adjacent to the knitting apparatus 100.

Figure 15:
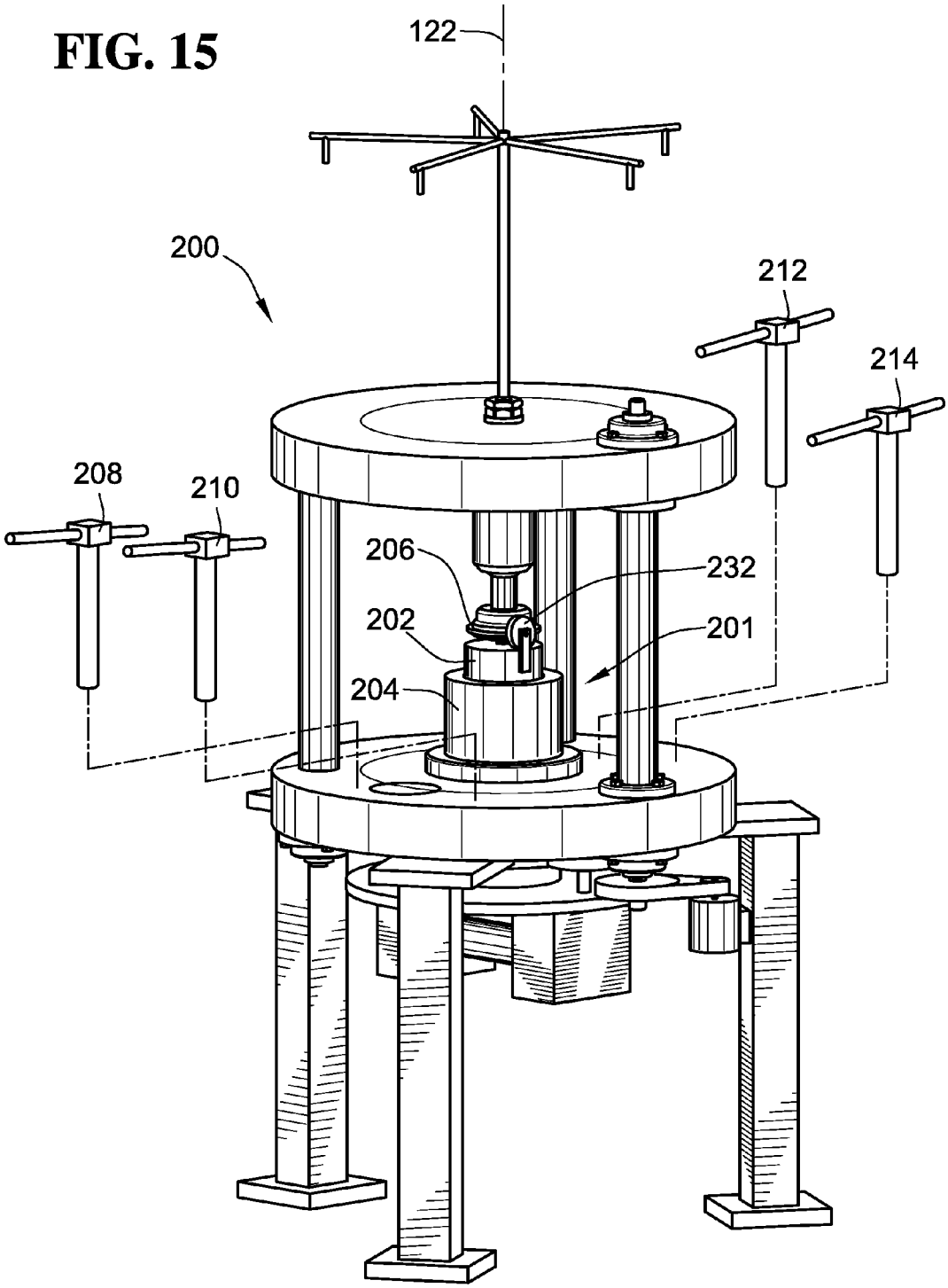
FIG. 15 is a perspective, partially exploded, illustration of a second exemplary embodiment of a knitting machine, according to the invention, which utilizes both a dial knitting arrangement and a cylinder knitting arrangement for forming a tubular-shaped knitted covering for a roller having a pile of pile yarn fibers extending from an outer surface of the covering.
Figure 16:
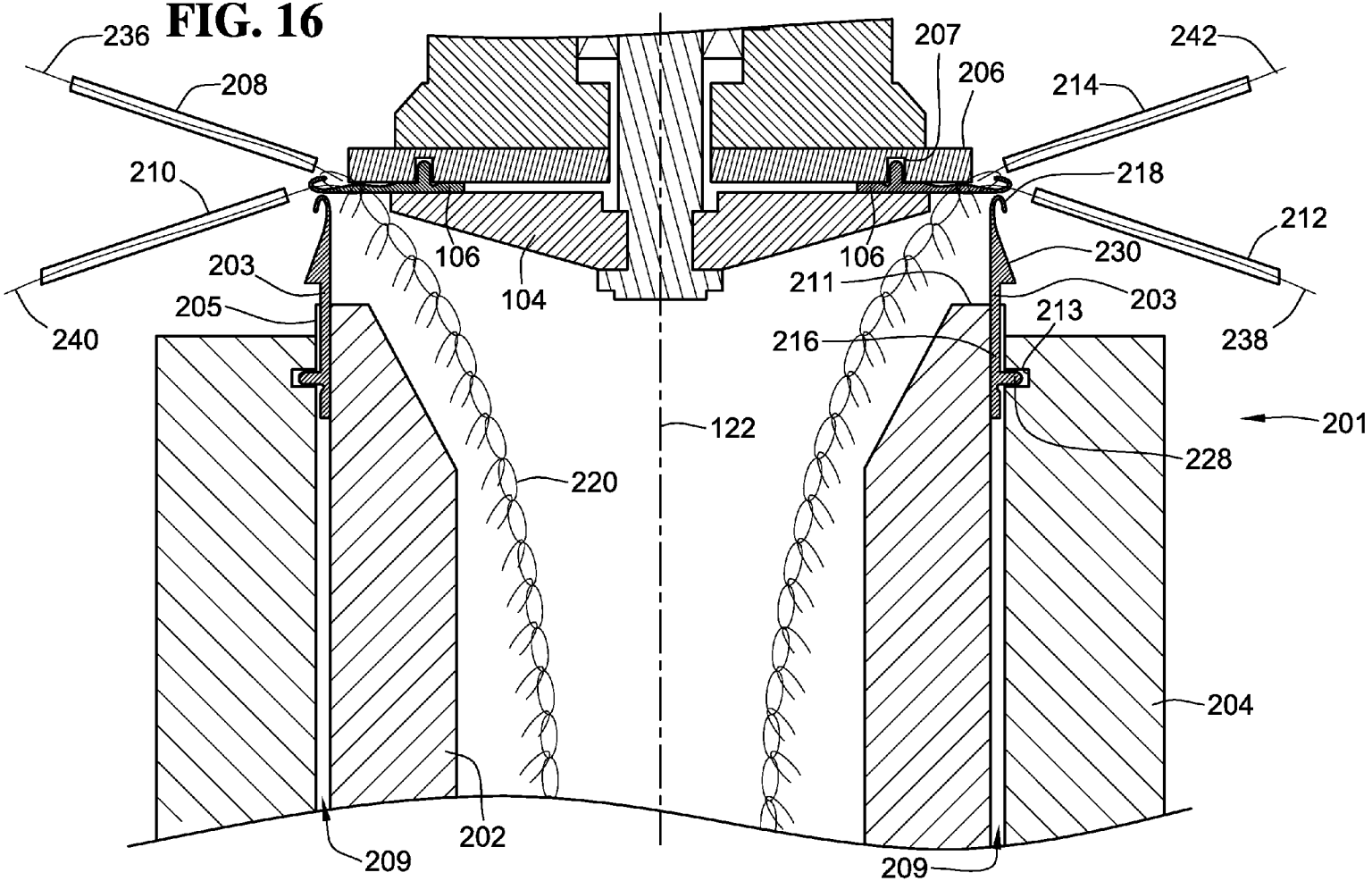
FIG. 16 is an enlarged partial cross-sectional view of a portion of the second exemplary embodiment of the knitting machine shown in FIG. 15, illustrating the configuration and relative location of a number of the working components of the dial and cylinder knitting arrangements.
Figure 17:
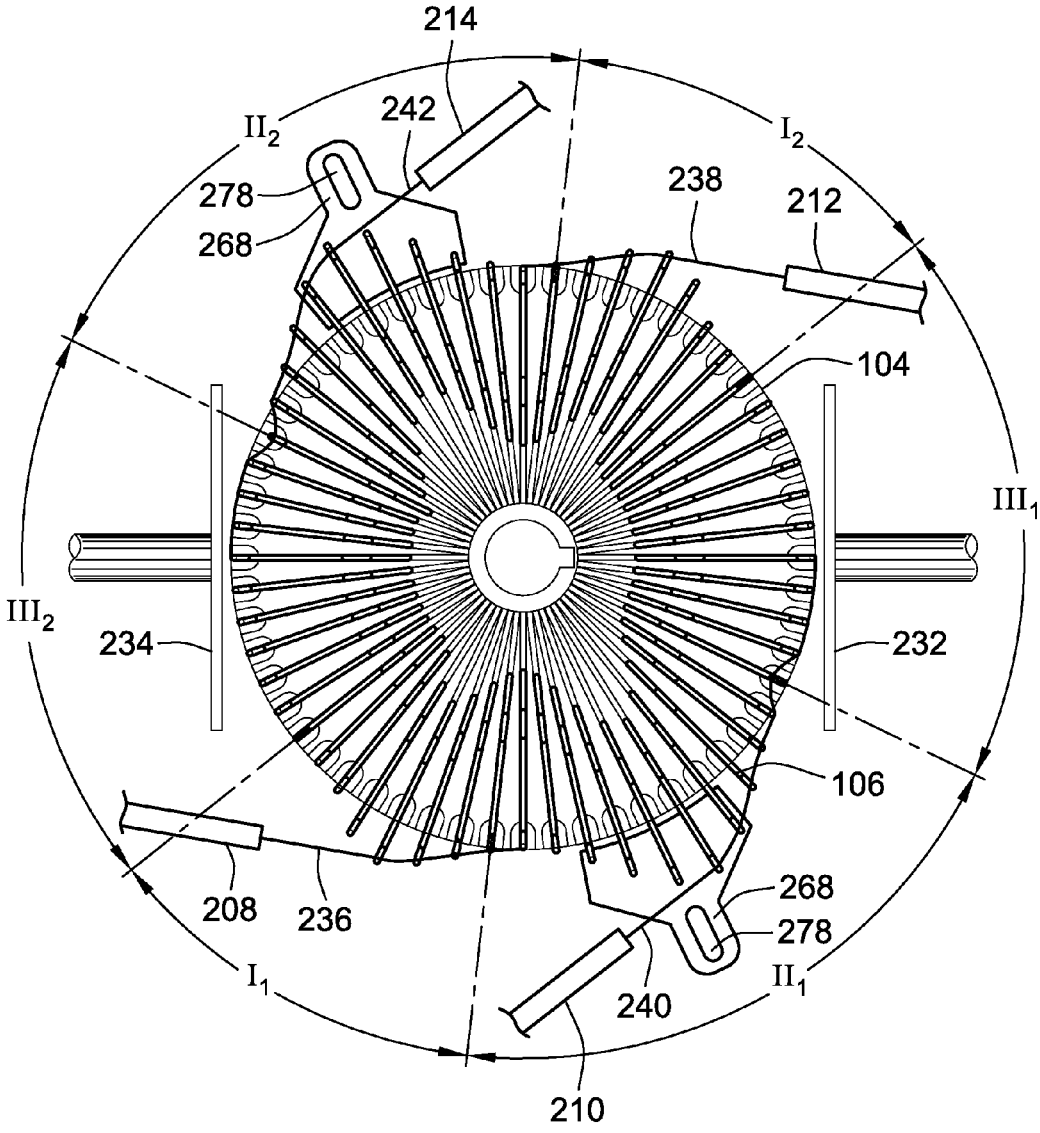
FIG. 17 is a semi-schematic top view of the dial of the dial knitting arrangement shown in FIG. 16, illustrating the location and interaction of a number of components of the dial and cylinder knitting arrangements of the second exemplary embodiment of the knitting machine shown in FIG. 15.
Figure 18:
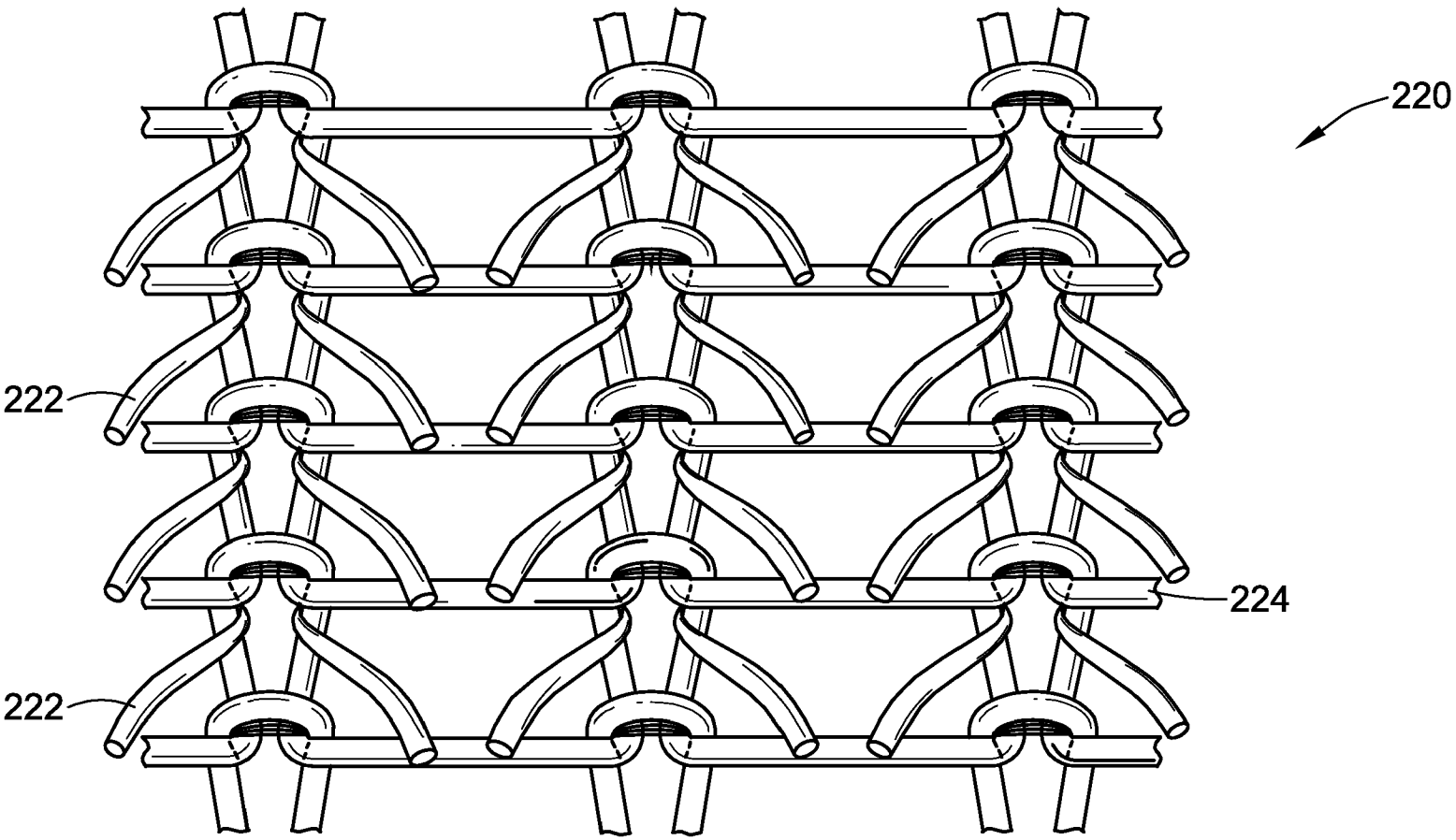
FIG. 18 is an enlarged schematic illustration showing a portion of a second exemplary embodiment of a roller covering, as produced with the knitting apparatus shown in FIGS. 15 through 17.

FIGS. 15 through 17 show a second exemplary embodiment of a knitting apparatus 200, according to the invention, which is used for knitting a second exemplary embodiment of an elongated tubular-shaped knitted covering 220 (see FIG. 18) for a paint roller cover, using the method illustrated in FIGS. 19 through 25. As illustrated in FIG. 18, the second exemplary embodiment of the tubular-shaped knitted covering 220 differs from the first embodiment of a tubular-shaped knitted covering 20 in that the pile of the first exemplary embodiment of the covering 20 is formed completely from sliver fibers, whereas the pile of the second exemplary embodiment of the covering 220 is formed completely by individual yarn fibers 222 locked into a backing yarn 224 knitted in a single jersey pattern, in the same manner as the single jersey knitted backing 22 of the first exemplary embodiment of the covering 20.

The second exemplary embodiment of the knitting apparatus 200 is identical in all respects to the first exemplary embodiment of the knitting apparatus 100 described above, except that the second exemplary embodiment of the knitting apparatus 200 includes a cylinder needle knitting arrangement 201 and replacement of the doffer-type pile yarn feeding arrangement 112 of the first exemplary embodiment 100 with a different type of pile yarn feeding arrangement 208 for feeding the pile yarn 222 to the dial and cylinder knitting arrangements 102, 201. It may also be necessary to replace the dial cam box 108 with a different dial cam box 206 having a cam track 207 defining a different shape than the dial cam track 166 of the first exemplary embodiment 100 described above.

As shown in FIGS. 15 through 17, the cylinder needle knitting arrangement 201 includes a cylinder 202, a plurality of cylinder needles 203 operatively disposed in the cylinder 202, a cylinder cam box 204 disposed adjacent to the cylinder 202 and operatively connected to the cylinder needles 203. The cylinder 202 has a lower end thereof fixedly attached to the lower large gear 140 (in the same manner shown in FIG. 11 with regard to cylinder 198) for rotation with the lower large gear 140 about the main vertical axis of rotation 122. The cylinder 202 has a radially outer periphery 205 thereof, disposed about the axis of rotation 122, and having a plurality of substantially axially directed needle slots 209 opening in a radially outward direction and also in an upward direction at an upper end 211 of the cylinder 202.

The cylinder cam box 204 is non-rotatably mounted to the lower main bed 126 (in the same manner as shown in FIG. 11 with regard to cam box 199) and includes a radially inward facing an opening cylinder needle cam track 213 therein.

As shown in FIG. 16, the cylinder needles 203 each have a body 216 thereof which is disposed in a respective cylinder needle slot 209 of the plurality of cylinder needle slots 209, and a hooked end 218 that is upwardly extendable beyond the upper end 211 of the cylinder 202. Each of the cylinder needles 203 also includes a cylinder needle cam lobe 228 which extends radially outward beyond the cylinder needle slot 209 and into sliding engagement with the cylinder needle cam track 213, such that rotation of the cylinder 202 causes the cylinder needles 203 to be selectively moveable axially within the cylinder needle slots 209 through interaction of the cylinder needle cam lobes 228 with the cylinder needle cam track 209. By virtue of this arrangement, the cylinder 202 and dial 104 and their respective dial and cylinder needles 106, 203 are operatively connected for synchronized rotation with respect to one another about the axis of rotation 122.

It will be further noted, that the cylinder needles 203 each include a cutting blade portion 230 disposed adjacent the hooked end 218 of the needle 203 rather than having the pivoting latches 173 (see FIG. 19) of the dial needles 106.

Figure 22A:
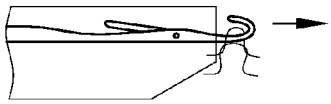
Figure 22B:
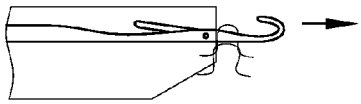
Figure 22C:
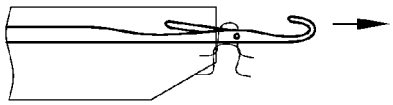
Figure 22D:
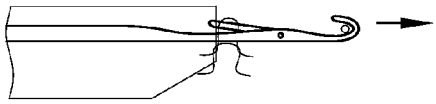
Figure 22E:
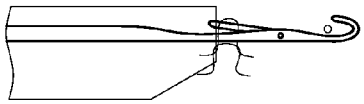
Figure 22I:
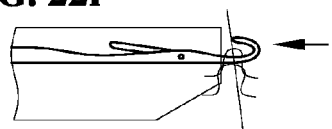
Figure 22H:
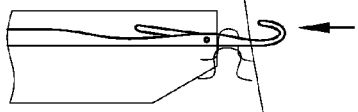
Figure 22G:
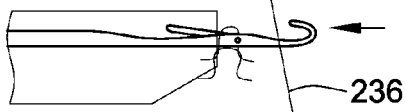
Figure 22F:
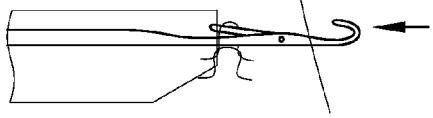
Figure 23:
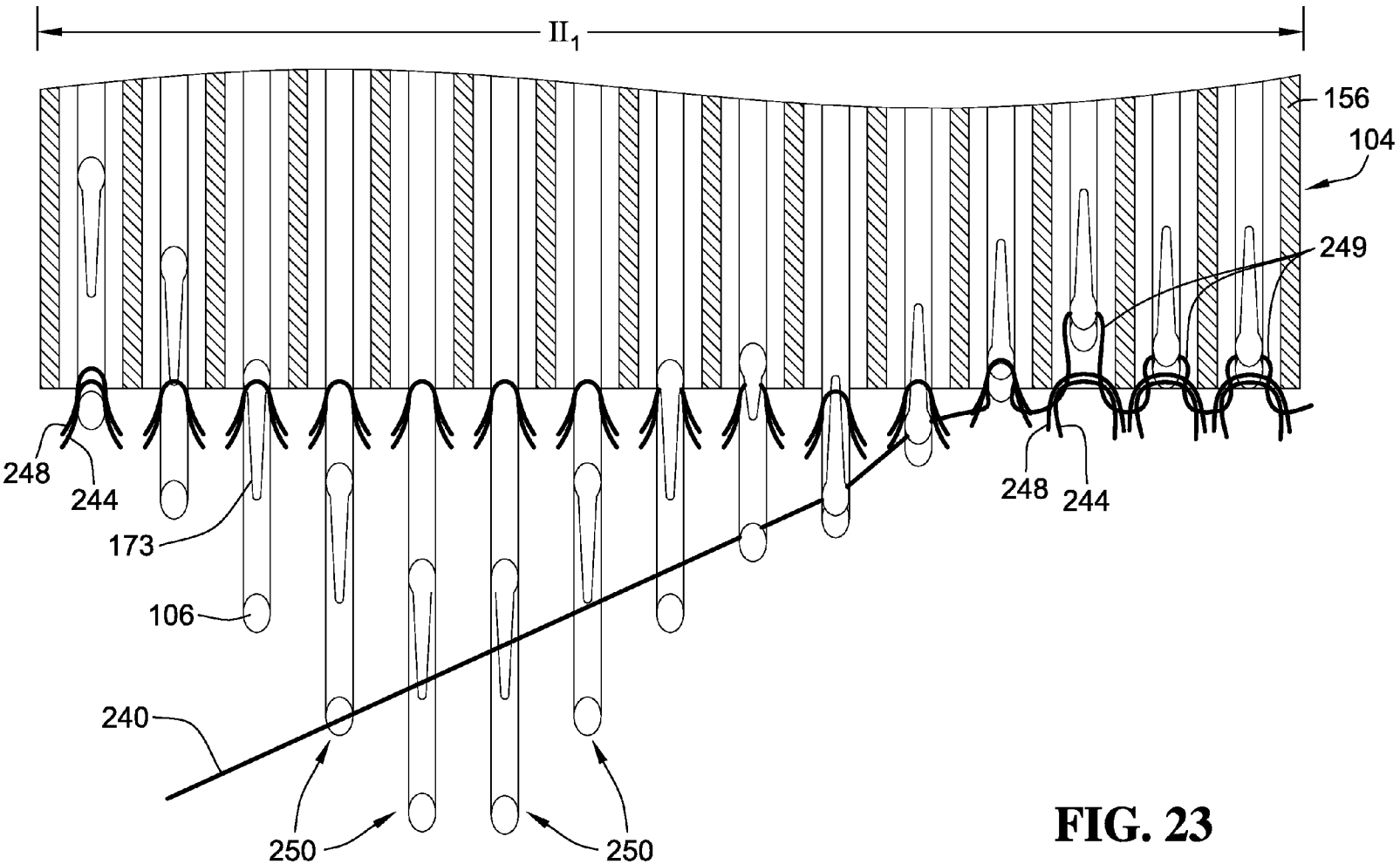
Figure 24:
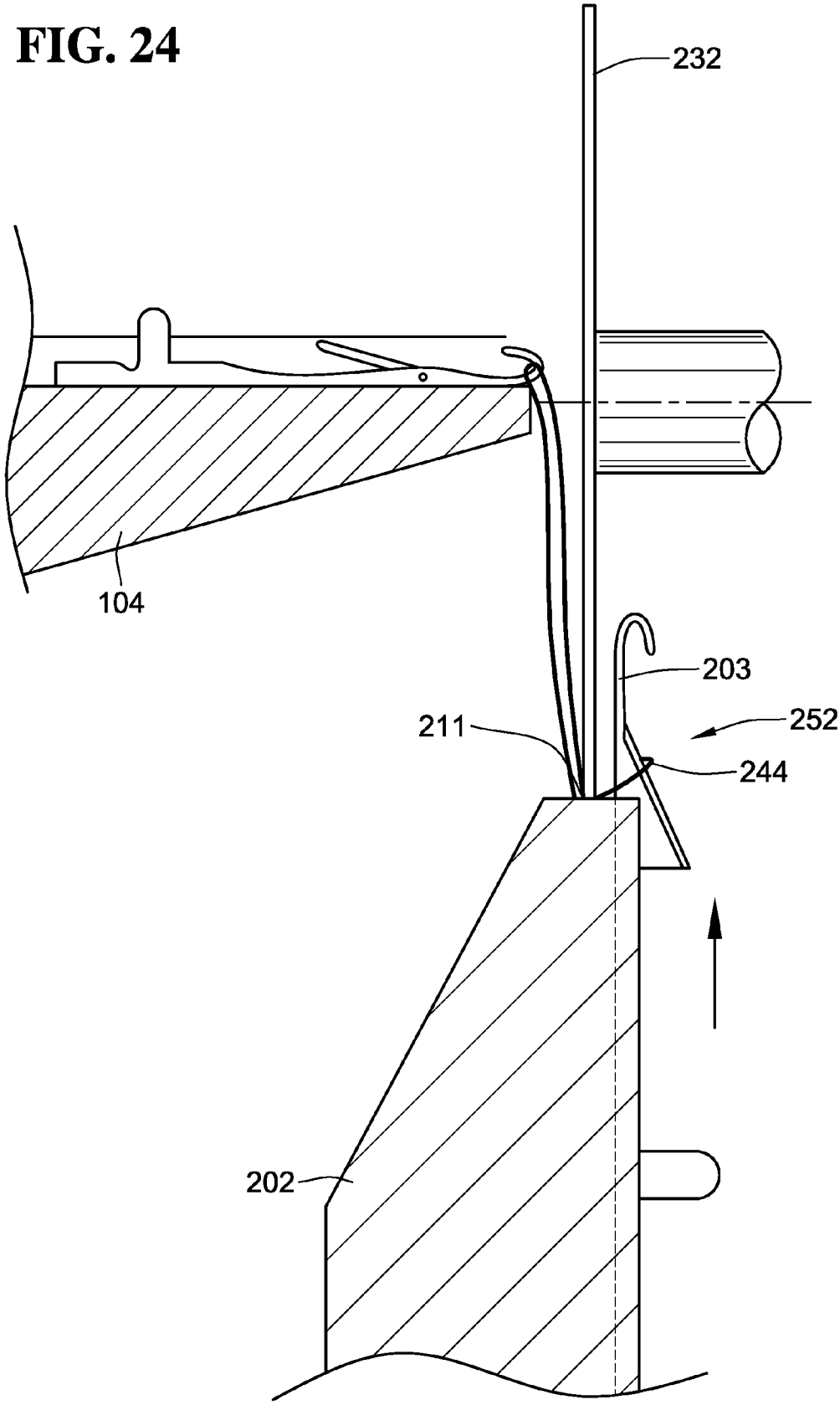

As shown in FIGS. 15, 17 and 24, the cylinder needle knitting arrangement 201 also includes a pair of pile yarn cutting wheels 232, 234, for use in a manner described in greater detail below, for assisting in cutting of the first and second pile fibers 236, 238 as they are knitted in place in successive alternating courses of the backing yarn 240, 242 in the manner described in detail below with reference to FIGS. 17 and 19 through 25.

As shown in FIG. 17, the pile fiber 236, 238 is knitted into the backing fiber 240, 242 in each of two adjacent courses knitted in each revolution of the dial 104 and cylinder 202.

It will be noted, by those skilled in the art, that, in the following description, reference is made only to the knitting process occurring in three phases $I_1$, $II_1$, $III_1$, for the first pile and backing yarns 236, 240, but it will be understood by those having skill in the art that an identical process is being carried out in three steps $I_2$, $II_2$, $III_2$, during a single rotation of the dial 104 and cylinder 202 about the main vertical axis of rotation 122.

Figure 19:
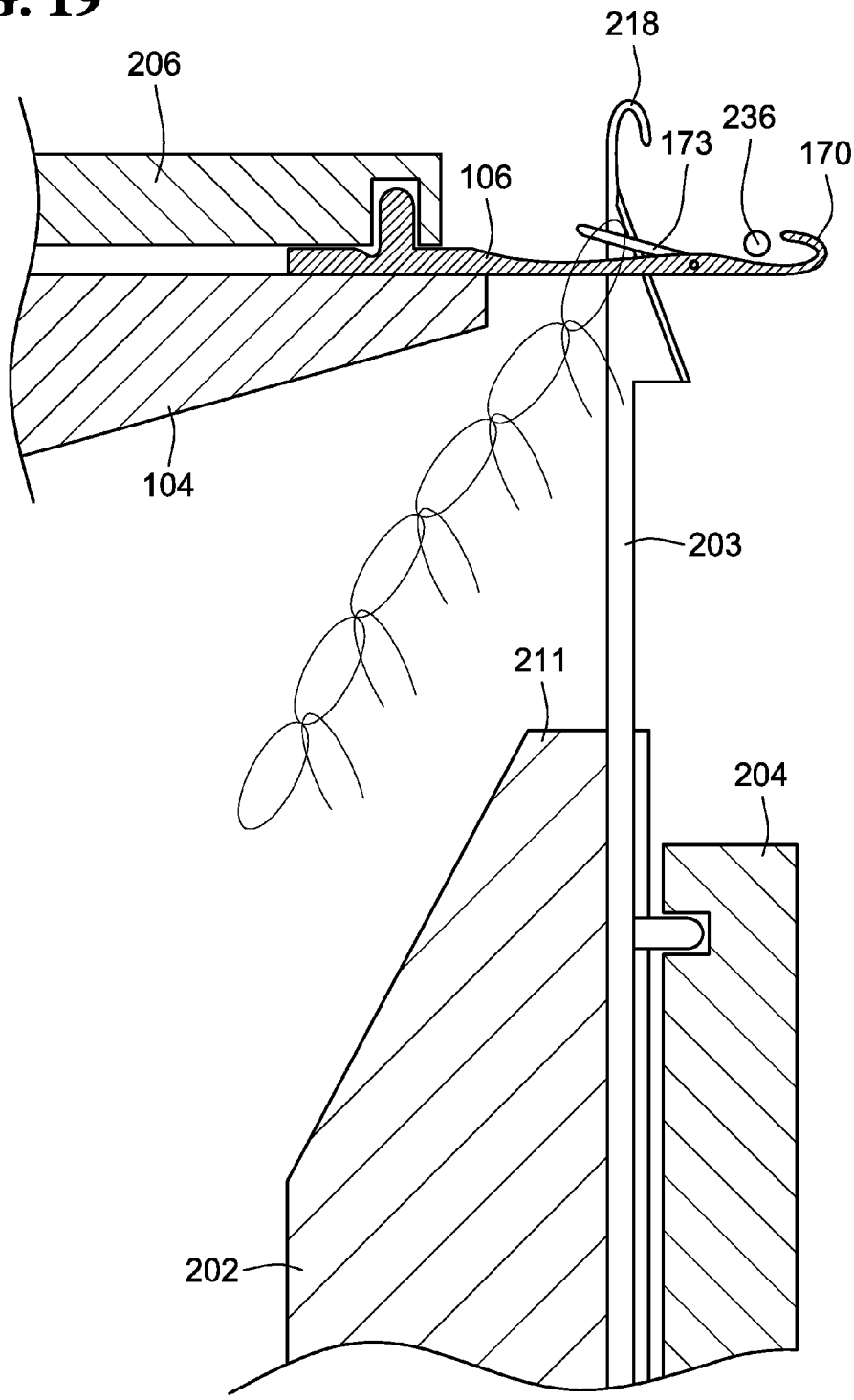
FIGS. 19 through 25 are a series of schematic illustrations which sequentially show the knitting apparatus of FIGS. 15 through 17 to produce the roller covering fabric shown in FIG. 18.

FIG. 19 shows the position of the dial and cylinder needles 106, 203 during the first stage $I_1$ in knitting the second exemplary embodiment of the tubular roller covering 220. It will be noted that during this first stage $I_1$ of the knitting process both the dial and cylinder needles 106, 203 are utilized for creating loops of the first pile yarn 236, which are later cut to form the pile 222. Specifically, as shown in FIG. 19, the dial needle 106 is extended radially outward to a tuck position, whereat a preceding loop of the backing yarn has not been cast off the latch 173 of the dial needle and the cylinder needle has been extended to place the hook 218 of the cylinder needle 203 above the pile yarn 236 as it is fed to the needles 106, 203 of the dial 104 and cylinder 202 simultaneously by the first pile yarn feeding arrangement 208, in the manner shown in FIGS. 15 and 16. With the dial and cylinder needles 106, 203 thus positioned in stage $I_1$, the hooked end 170 of the dial needle 106 receives the pile yarn 236 and draws it back toward the cylinder needle 203 and the dial 104 as the dial needle 106 is drawn back into the dial 104 by virtue of the dial 104 being rotated about the axis 122 with respect to the stationary dial cam box 206. Simultaneously, rotation of the cylinder 202 about the axis of rotation 122, in synchronization with the dial 104, causes the cylinder needles 203 to be drawn downward toward the upper end 211 of the cylinder in such a manner that the hooked ends 218 of the cylinder needles 203 also grasp the pile yarn 236 simultaneously with the hooked ends 170 of the dial needles 106 on either side of the cylinder needle 203.

Figure 20:
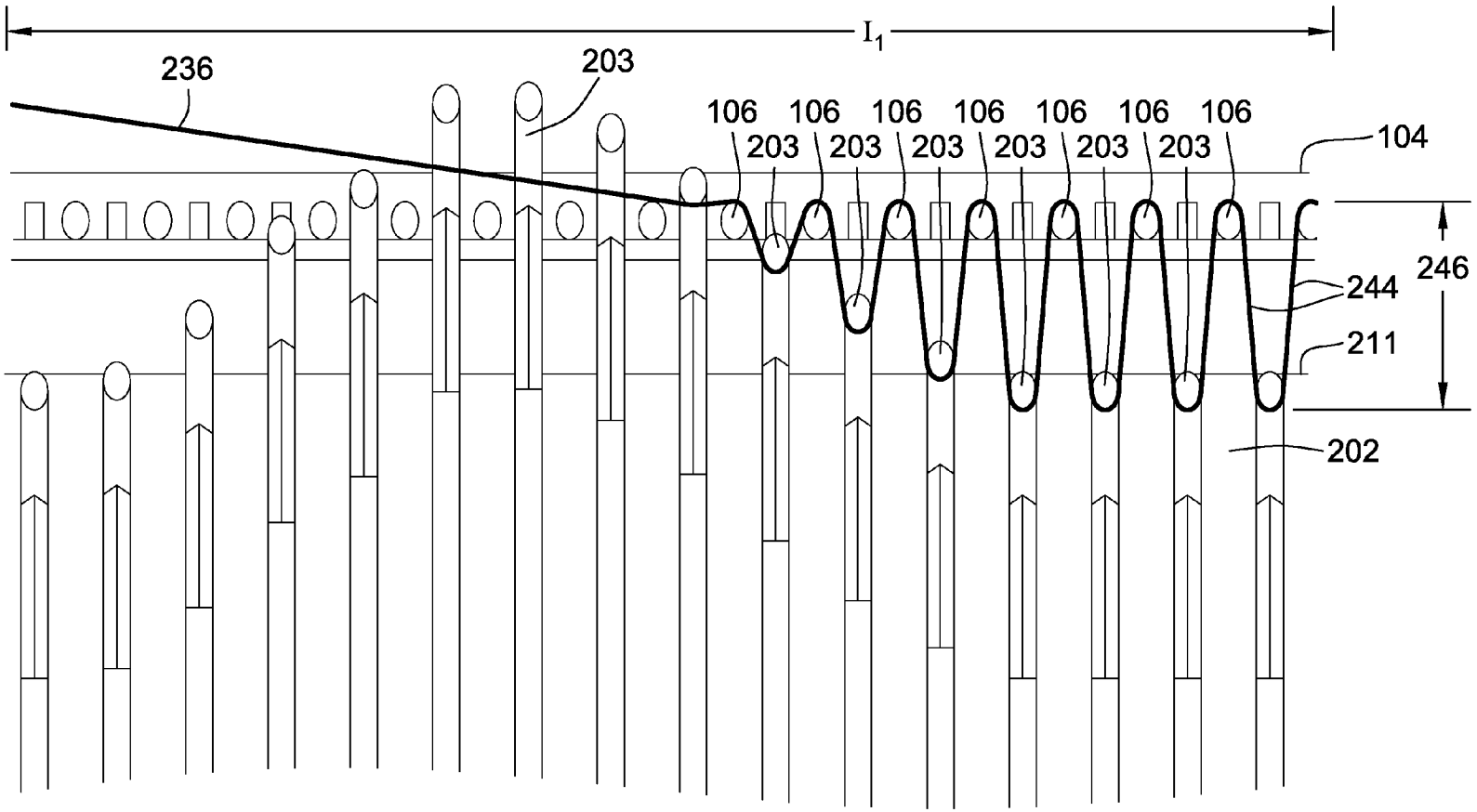

As shown in FIG. 20, which is a rolled-out side view of the dial 104 and cylinder 202, continued rotation of the dial 104 and cylinder 202 during the first stage 11 causes the first pile yarn 236 to be pulled downward into a series of loops 244 as the dial needles 106 and cylinder needles 203 retract radially inward and axially downward, respectively. As shown in FIG. 20, the cylinder needles 203 retract to a point that the hooked ends 170 no longer protrude above the upper end 211 of the cylinder 202. It will further be appreciated that the overall length 246 of the loops 244 will be determined by the axial spacing between the dial 104 and the upper end 211 of the cylinder 202. In some forms of the invention, this length 246 of the loops 244 may be adjusted by raising or lowering the dial 104 through use of the two-part pedestal arrangement 160, in the manner shown in FIG. 30.

Figure 30:
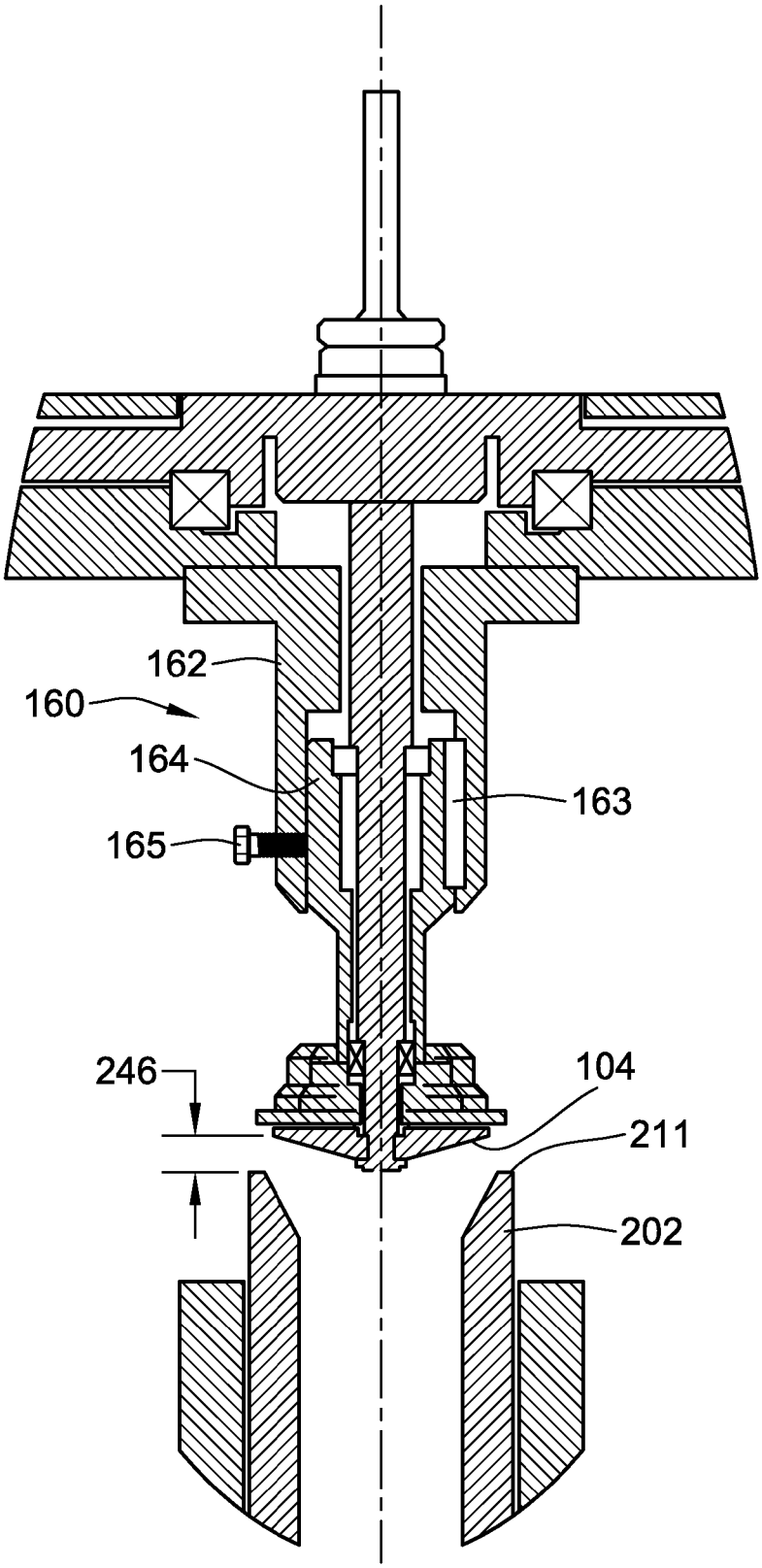
FIG. 30 is a partial, cut-away section of a portion of a tubular knitting apparatus, according to the invention, illustrating adjustment of the apparatus to adjust the length of the pile on cut pile products made in accordance with the invention.

Specifically, as illustrated in FIG. 30, the upper fixed pedestal 162 and lower movable pedestal 164 of the two-part pedestal arrangement 160 slidingly engage each other, so that the lower pedestal 164 may be moved vertically to adjust the distance between the top end 211 of the cylinder 202 and the dial 104, to thereby adjust the length 246 of the loops 244 (see FIG. 20). The two-part pedestal arrangement 160 includes an anti-rotation arrangement, such as a key 163, which precludes relative rotation between the upper and lower pedestals 162 and 164. The two-part pedestal arrangement 160 also includes an axial locking arrangement, such as a set screw 165, which is used to lock the pedestal arrangement 160 to retain the dial 104 at a desired distance above the upper end 211 of the cylinder 202, to thereby produce a desired loop length 246.

Figure 21:
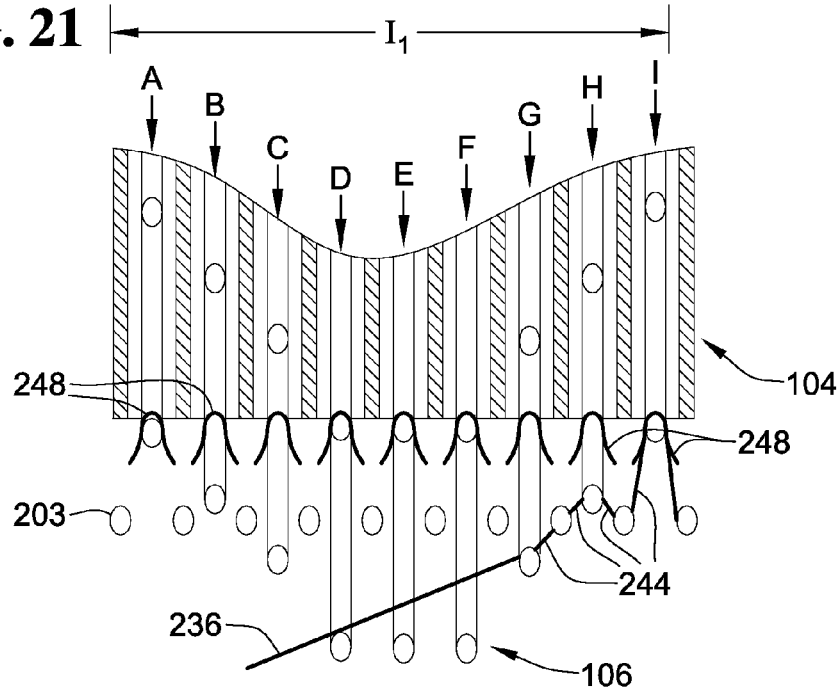

FIG. 21 is a top, rolled-out, view showing the relative radial position of a series of dial needles 106 as they are rotated through the process of engaging the pile yarn 236 during the first stage $I_1$ of the process of forming the knitted fabric 220. FIGS. 22A-221 are individual side views corresponding to needle locations A-I as shown in FIG. 21, to further illustrate the motion of each dial needle 106 as it is rotated about the axis 122 through the first stage $I_1$ of the manufacturing process.

As shown in FIG. 23, during the second stage $II_1$, the cylinder needles 203 are inactive, with only the dial needles 106 being used to form new stitches in the jersey backing fabric of the tubular knitted covering 220, as shown in FIG. 18. As shown in FIG. 23, during the second stage $II_1$, the dial needles 106 move radially outward from the periphery 156 of the dial 104 to a clearing position, as shown at 250 in FIG. 23, whereat the latches 173 on the needles 106 have cleared the old loops 248. As the needles 106 retract from their maximum extended position, the hooked ends 170 of the dial needles 106 receive the backing yarn 240 and the old loops 248 close the latches 173 on the dial needles 106 and pull the newly grasped backing yarn 240 through the old loop 248 to thus create a new stitch 249. Because the pile yarn 236 is in the same position on the dial needles 106 as the old stitch 244, the loops of pile yarn 236 are locked into the stitch when the new stitch is made. As previously stated, the cylinder needles 203 are inactive during this stage $II_1$ of the knitting process and remain in their maximum down position in order to maintain the length 246 of the loops 244 of pile yarn 236.

Figure 25:
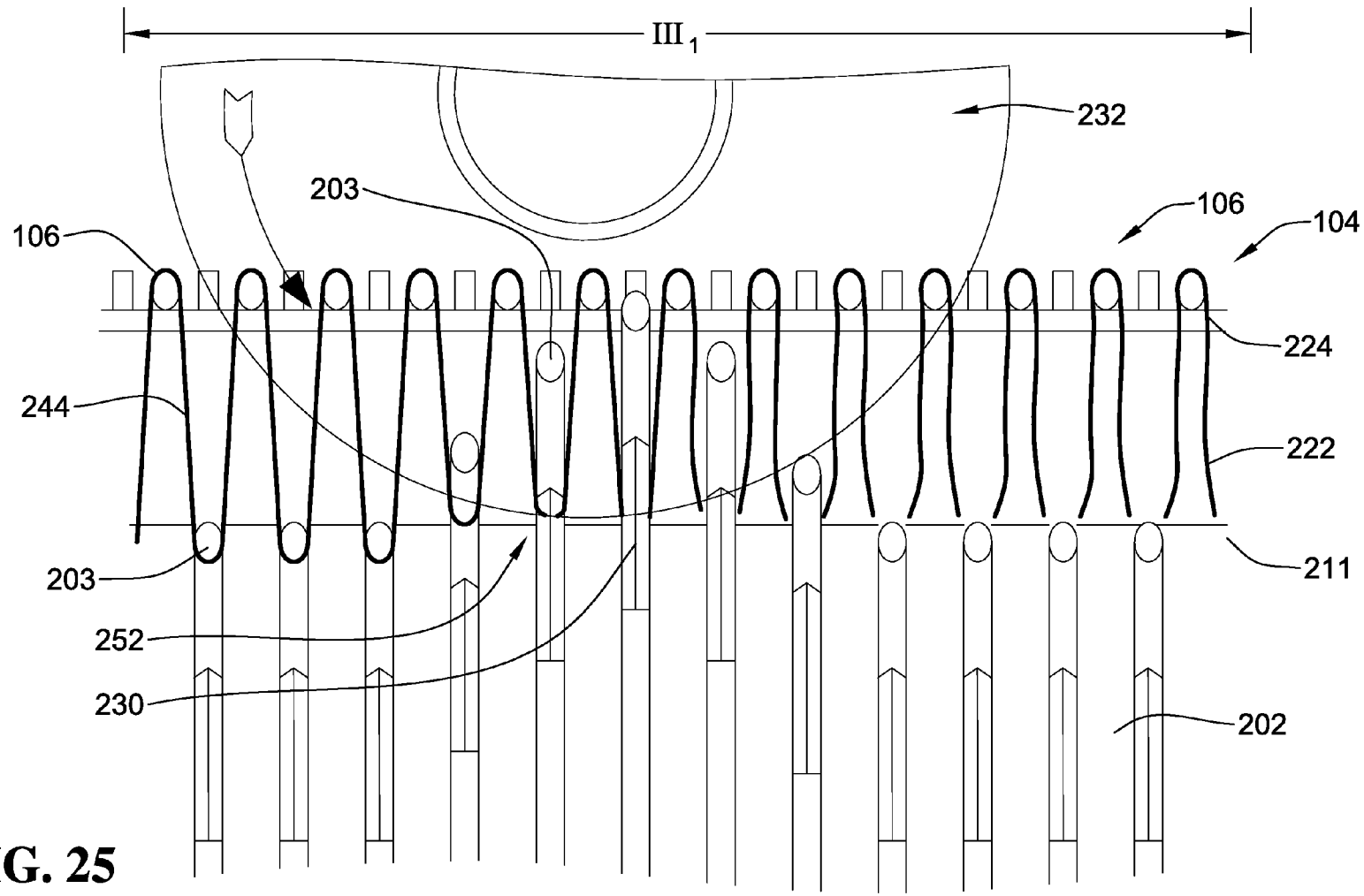

As shown in FIGS. 24 and 25, in the third stage $III_1$, the loops 244 of pile fiber 236 are cut to form the pile 222 extending outward from the backing fabric 224, in the manner shown in FIG. 18. As shown in FIGS. 24 and 25, as the dial 104 and cylinder 202 continue to rotate about the axis 122, the dial needles 104 remain stationery during the third stage $III_1$ as the cylinder needles 203 are moved upward. The cutting wheel 232 does not actually cut the loops 244, but rather holds them in place against the upper end 211 of the cylinder. Upward motion of the cylinder needles 203 is coordinated by the cylinder cam box cam track 213 (see FIG. 16) in such a manner that at a point, indicated by reference numeral 252 and an arrow in FIGS. 24 and 25, the cutting blade portion 230 of the needle 203 passes through and severs the lower end of each of the pile loops 244 as the lower end of the pile loop 244 is held in place against the upper end 211 of the cylinder 202. It is noted that during the third stage $III_1$ of the knitting process, the dial needles 106 are substantially inactive, except for holding the upper ends of the pile loops 244 and the stitch to which they are locked into in place on the dial 104.

Those having skill in the art will recognize that, although only the process of knitting the first pile and backing yarns 236, 240 have been described, and illustrated in FIGS. 19 through 25, simultaneous to the process described above, an identical process would be carried out by the dial and cylinder needles 106, 203 for forming the successive next course of fabric using the second pile and backing yarns 238, 242.

Those having skill in the art will recognize that, although the first and second exemplary embodiment of the knitting machines 100, 200 described hereinabove have both been configured for knitting of a tubular-shaped roller covering 20, 220, having two courses of the backing knitted on a single rotation of the dial 104, in other embodiments of the invention, fewer or more courses of the knitted fabric can be formed in a single rotation of the dial 104. In similar fashion, it will be recognized that in the exemplary embodiments of the invention presented herein, both the dial and the cylinder, and embodiments having a cylinder with needles, have had an identical number of 56 needles, with the cylinder needles spaced alternately between the dial needles. The invention may also be practiced in other embodiments having different numbers of needles, and differing numbers of needles in the cylinder and the dial. Also, both the dial and the cylinder in the first and second exemplary embodiments 100, 200 described above utilized only a single cam track in both the dial and the cylinder. In other embodiments of the invention, multiple cam tracks may be utilized.

Figure 26:
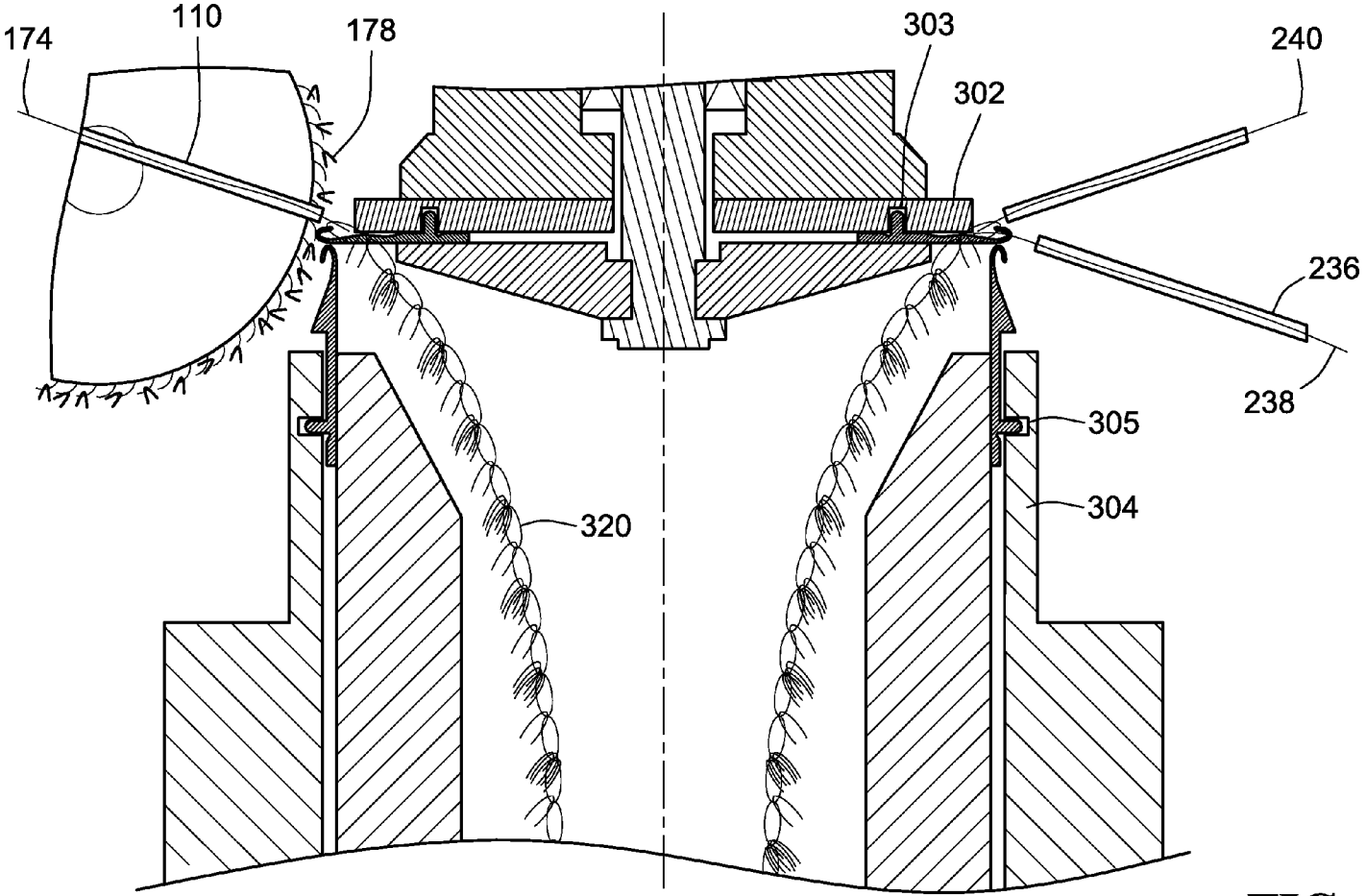
FIG. 26 is an enlarged cross-sectional illustration of a third exemplary embodiment of a knitting apparatus, according to the invention, which uses a combination of the feeders shown with regard to the first and second exemplary embodiments in combination with a dial knitting arrangement and a cylinder knitting arrangement to produce a third exemplary embodiment of a roller covering fabric having a pile fiber formed from short segments of face yarn locked into a backing yarn.
Figure 27:
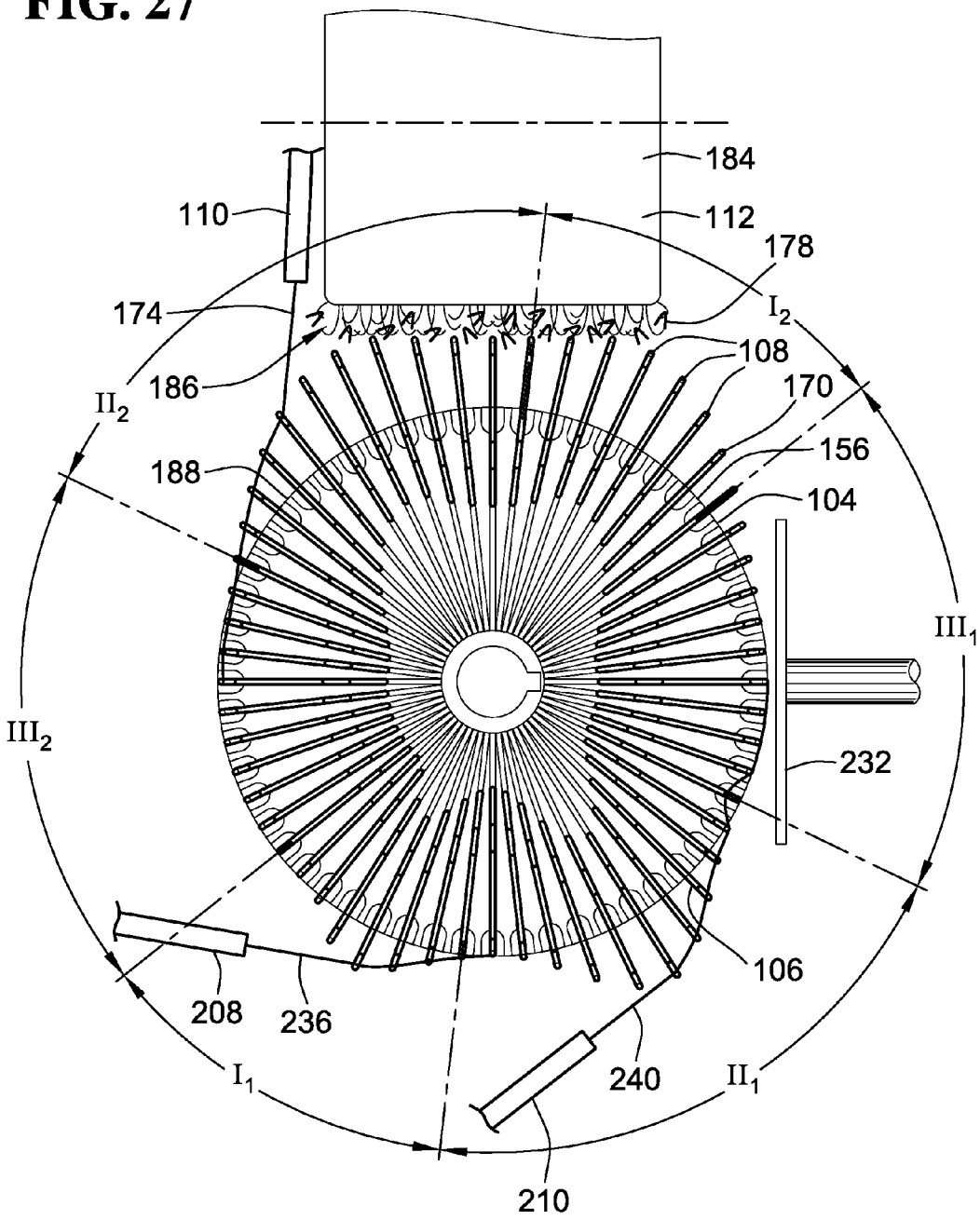
FIG. 27 is a schematic illustration looking down on the dial knitting arrangement of the third exemplary embodiment of the knitting apparatus shown in FIG. 26.
Figure 28:
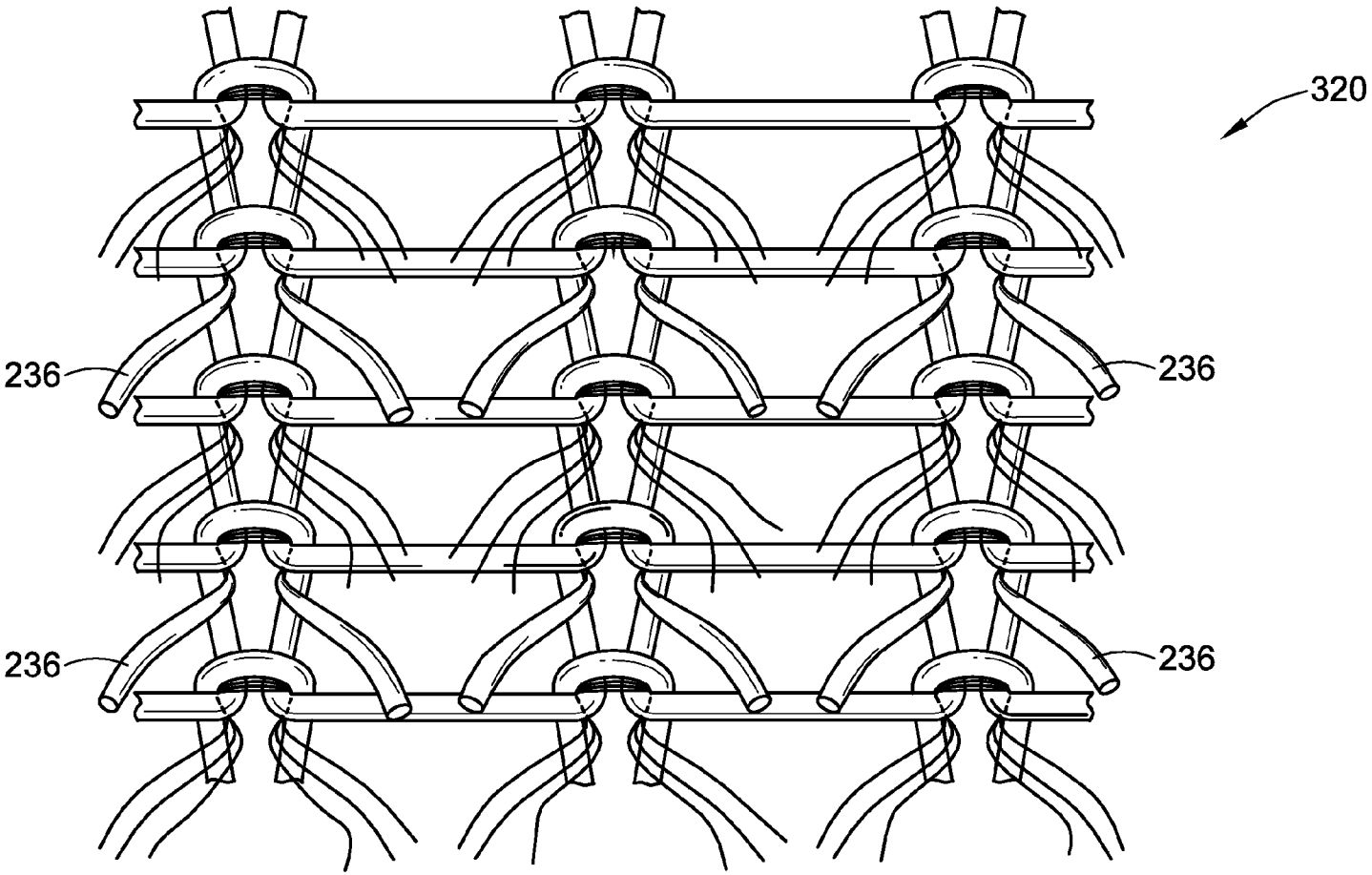
FIG. 28 is an enlarged schematic illustration of a section of the third exemplary embodiment of the roller covering as fabricated using the apparatus and methods of FIGS. 26 and 27.

FIGS. 26 and 27 illustrate a third exemplary embodiment of the invention, in which a combination of the first and second embodiments 100, 200 are utilized for forming a tubular-shaped knitted roller covering 320, as shown in FIG. 28, having multiple successively knitted courses, with two adjacent courses being knitted simultaneously, and the pile yarn being sliver fibers in one course of the two simultaneously knitted courses and the pile yarn being a single strand of face yarn in the other course of the two simultaneously knitted courses. As shown in FIGS. 26 and 27, this is accomplished by reconfiguring the knitting apparatus to include one doffer-type pile feeding apparatus 112, and one pile yarn feeding apparatus 208, of the type described above, in the manner shown in FIGS. 26 and 27. The dial and cylinder 302, 304 of the third exemplary embodiment of the invention also differ somewhat from their corresponding counterparts in the first two exemplary embodiments 100, 104 in that the cam tracks 303, 305 in the dial and cylinder, respectively, have a different shape than the cam tracks in either of the first two exemplary embodiments 100, 200. Such a roller covering is not currently available in the industry, and is believed to provide desirable texture effects.

Figure 29:
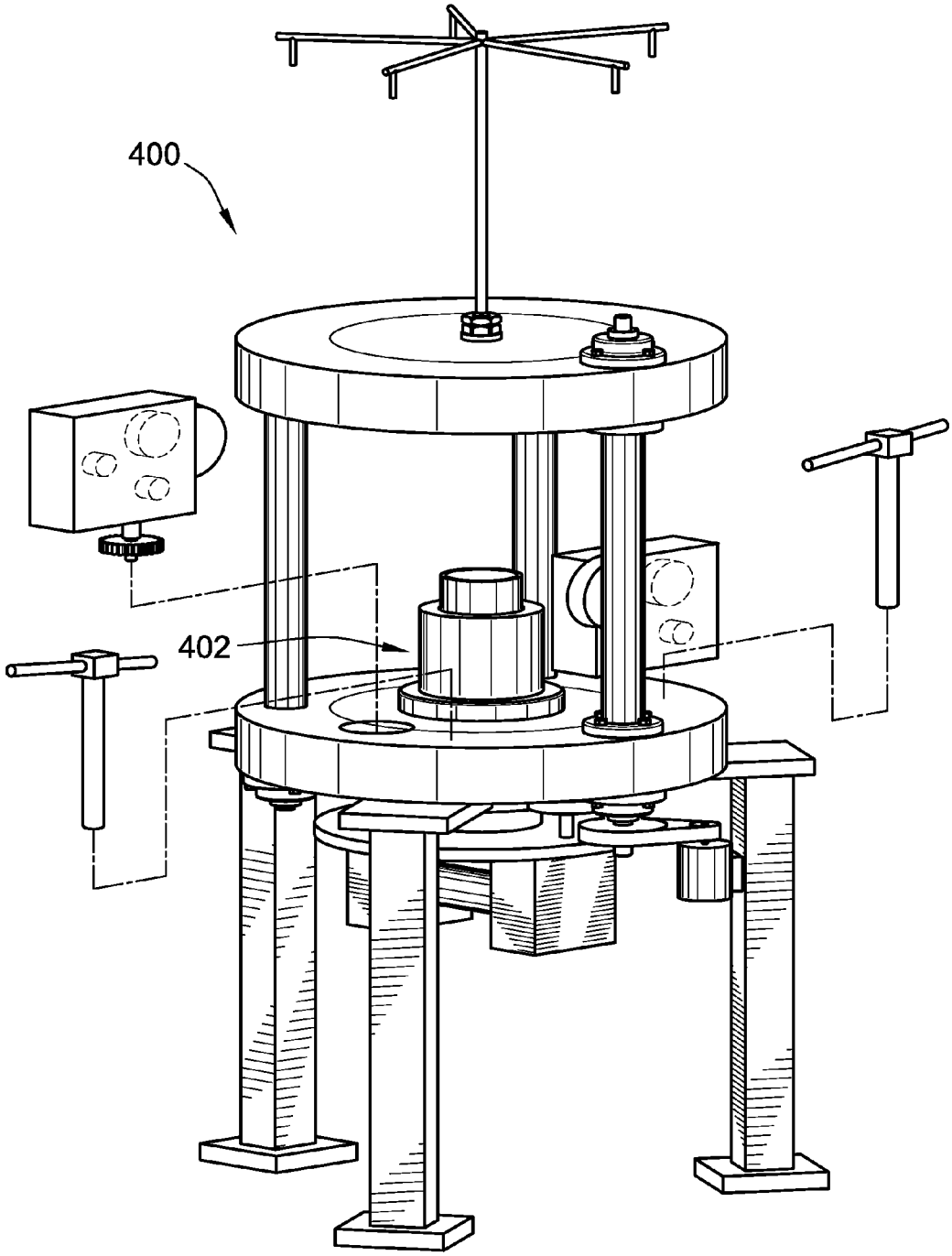
FIG. 29 illustrates a fourth exemplary embodiment of a knitting apparatus, according to the invention, having the dial knitting arrangement removed for operation only with a cylinder knitting arrangement.

Although the invention has been described herein with relation to several exemplary embodiments of knitting machines 100, 200, 300, the variations described above are by no means exhaustive. FIG. 29 illustrates yet another exemplary embodiment of a knitting apparatus, according to the invention, in which the dial knitting arrangement 102 has been removed so that knitting may be accomplished solely using a cylinder knitting arrangement 402. Such a knitting arrangement may be used in combination, in various embodiments, with a pile yarn feed arrangement, such as the doffer units shown in FIG. 29, a pile yarn feeding arrangement as shown in FIG. 29, or any other appropriate type of feeding arrangement.

Figures 31, 32, 33:
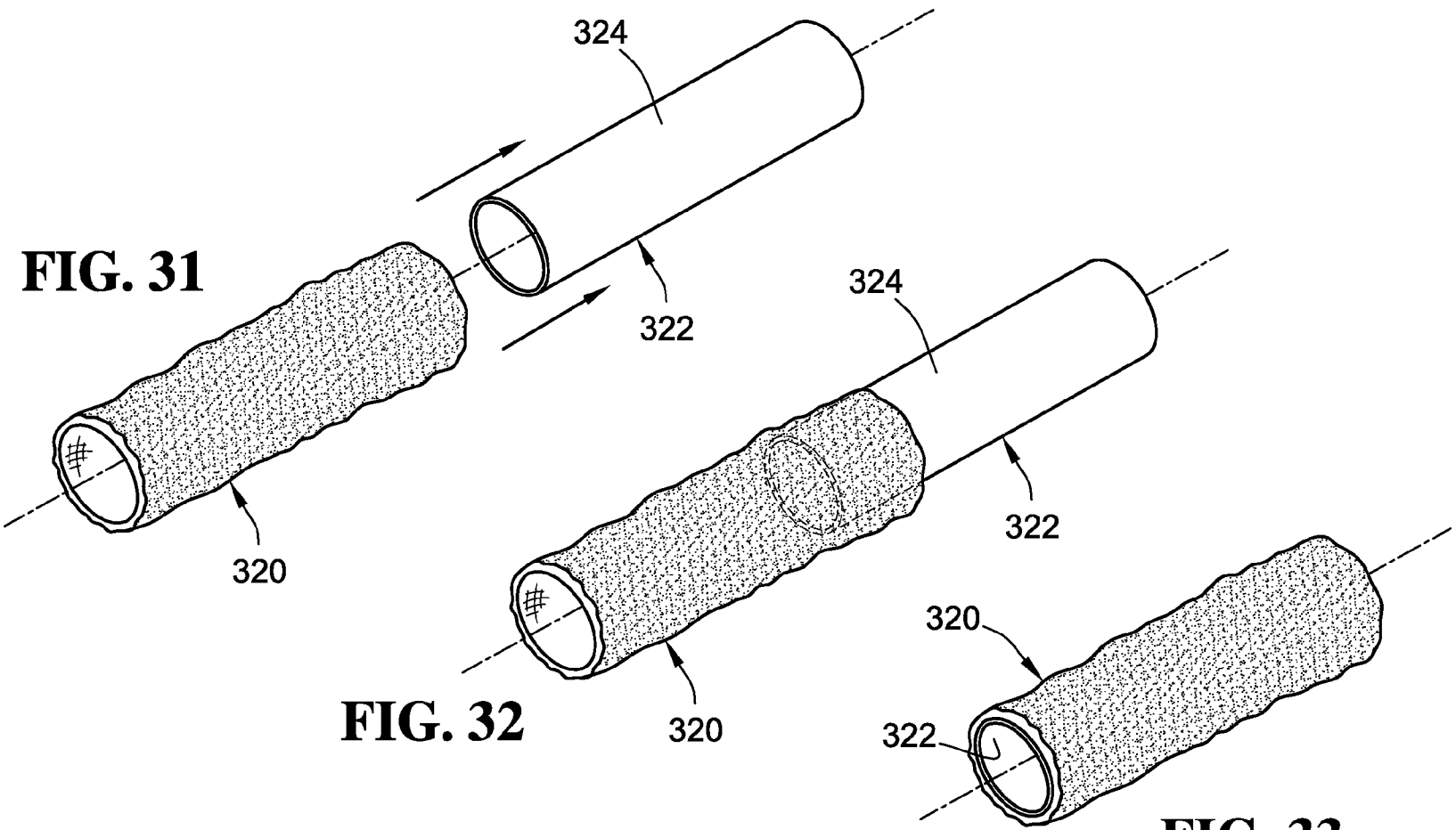
FIGS. 31-33 are sequential perspective illustrations of installation of a tubular knit roller cover onto a roller core for producing a paint roller cover in accordance with the invention.
Figure 34:
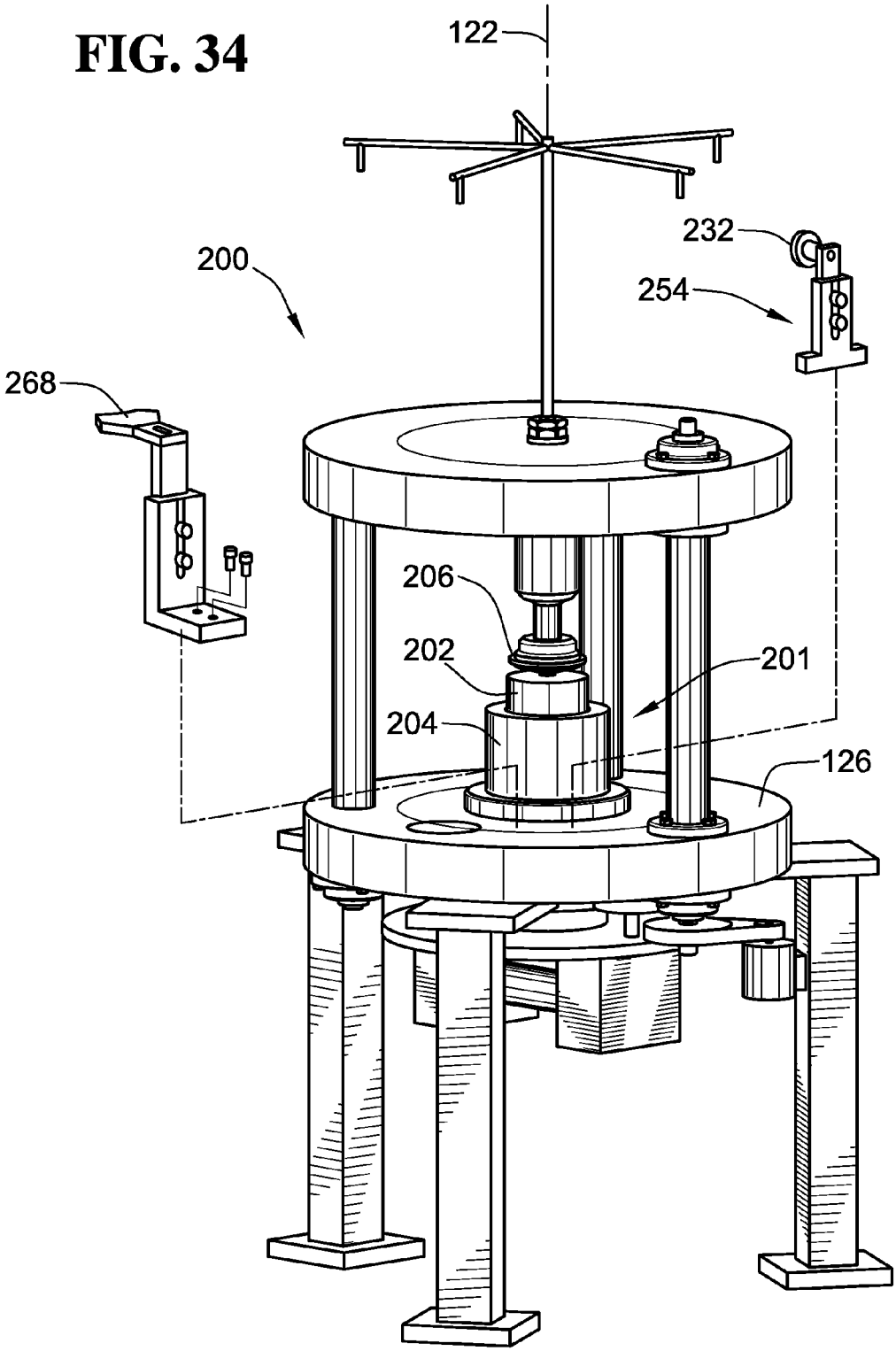
FIG. 34 is a perspective, partially exploded, illustration showing alternate embodiments of an apparatus, according to the invention, for producing a tubular knit covering for a paint roller having a pile extending from an outward surface thereof formed at least partially by cut pile fibers.

Moving now to FIGS. 31 through 33, the installation of the tubular-shaped knitted combination sliver and cut pile roller covering 320 onto a paint roller cover core 322 is schematically illustrated. The installation method depicted in FIGS. 31 through 33 is fully disclosed in copending U.S. patent application Ser. No. 12/100,050, filed on Apr. 9, 2008, entitled "Method of Manufacturing Paint Roller Covers From a Tubular Fabric Sleeve," which patent application is assigned to the assignee of the present invention, and which patent application is hereby incorporated herein by reference in its entirety. Alternately, other installation methods can be used as well, including those disclosed in copending U.S. patent application Ser. No. 12/015,612, filed on Jan. 17, 2008, entitled "Method of Manufacturing Paint Roller Covers From a Tubular Fabric Sleeve," which patent application is assigned to the assignee of the present invention, and which patent application is hereby incorporated herein by reference in its entirety.

It will be appreciated by those skilled in the art that the paint roller cover core 322 may constitute plastic tubular core stock that has been cut to single paint roller size (typically nine inches (229 millimeters)). (Alternately, it may be cut to a longer length, such as, for example, sixty-four inches (1625 millimeters); if such a longer length is used, following installation of the tubular cut pile knit segment 320 onto the plastic tubular core stock, it may be cut into the desired size shorter paint roller covers, such as, for example, seven nine inch (229 millimeters) paint roller covers.) Finishing the paint roller covers typically will include the steps of combing the combination sliver and cut pile knit fabric on the paint roller cover and, in some embodiments, shearing the pile to the desired length. These finishing steps may occur either before or after cutting longer segments to the desired length. Finally, the edges of the paint roller covers are beveled, and any loose yarn fibers may be vacuumed off.

Referring now to FIG. 31, the paint roller cover core 322 covered with a non-tacky adhesive 324 is illustrated. The tubular knit segment 320 is shown as it is about to be pulled onto the exterior surface of the paint roller cover core 322. The tubular knit segment 320 has an inner diameter that is approximately the same size as or slightly smaller than the outer diameter of the paint roller cover core 322, which outer diameter is typically approximately one and five-eights inches (41 millimeters) to one and three-quarters inches (44 millimeters) (the inner diameter of the core member 90 is approximately one and one-half inches (38 millimeters), although alternative sizes such as inner diameters of one and three-quarters inches (44 millimeters) and two inches (51 millimeters) could be used as well). The tubular knit segment 320 may be sized to require that it be stretched slightly when it is placed onto the paint roller cover core 322 in order to achieve the correct density and/or positioning. Alternately, the tubular knit segment 320 could also be slightly larger than the outer diameter of the paint roller cover core 322 onto which it is to be installed and shrunk slightly to closely fit the paint roller cover core 322.

The tubular knit segment 320 is of a length that corresponds to the length of the paint roller cover core 322. For purposes of the example discussed herein, it will be assumed that the paint roller cover core 320 is approximately nine inches (229 millimeters) long and that the tubular knit segment 320 is approximately nine to nine and one-quarter inches (235 millimeters) long, which are lengths that are selected to allow the paint roller cover core 322 and the tubular knit segment 320 to be used for the manufacture of a single nine inch (229 millimeter) long paint roller cover. It will be appreciated by those skilled in the art that the paint roller cover core 322 and the tubular knit segment 320 could alternately be sized for use in manufacturing a plurality of paint roller covers of any of several different lengths. For example, the paint roller cover core 322 and the tubular knit segment 320 could each be approximately sixty-four inches (1625 millimeters) long, which is a sufficient length to allow them to be used for the manufacture of seven nine inch (229 millimeter) long paint roller covers.

Since inner diameter of the tubular knit segment 320 is approximately the same as the paint roller cover core 322, the tubular knit segment 320 need not be capable of substantial stretching when it is pulled onto the paint roller cover core 322. The tubular knit segment 320 taught herein is resilient and will closely fit the outer diameter of the paint roller cover core 322.

In FIG. 31, the tubular knit segment 320 is shown about to be pulled over the paint roller cover core 322. FIG. 32 shows the tubular knit segment 320 partly pulled onto the paint roller cover core 322, and FIG. 33 shows the tubular knit segment 320 fully pulled onto the paint roller cover core 322. The tubular knit segment 320 is subsequently adhesively secured to the paint roller cover core 322 by the application of heat to cause the non-tacky adhesive 324 to melt, thereby adhering the tubular knit segment 320 the paint roller cover core 322, as fully described in U.S. patent application Ser. No. 12/100,050, filed on Apr. 9, 2008.

Finishing the paint roller covers may include the steps of combing the pile on the paint roller cover and shearing the pile knit fabric to the desired length. Finally, the edges of the paint roller covers are beveled, and any loose yarn fibers may be vacuumed off.

In some embodiments of the invention, an apparatus and/or method according to the invention may be utilized for forming a tubular knit segment including low melt yarns for the backing material. Such tubular knit segments having low melt yarns may then be utilized in accordance with commonly assigned U.S. patent application Ser. No. 12/132,774, the teachings of which are incorporated herein in their entirety.

The use of low melt yarns for the base of a sliver knit fabric is discussed in U.S. Pat. No. 6,766,668, to Sinykin, which patent is assigned to the assignee of the present invention, and which patent is hereby incorporated herein by reference in its entirety. This patent used heat to activate the low melt material in the base, heating the sliver knit fabric to a temperature for a sufficient period of time to permit the low melt material to melt about the central and/or intermediate portions of the sliver fibers. The sliver knit fabric was then cooled so that the low melt material returned to a hardened state and captured a portion of the sliver fibers to lock them to the base of the fabric. This represents a substantially different use of bicomponent fibers than that made by the present invention, as will become evident below.

In accordance with some embodiments of the present invention, low melt yarn together with either the sliver fibers or cut pile segments formed from a pile yarn (or both) are knitted into the tubular knitted pile fabric segment. The manufacture of a tubular knitted pile fabric with sliver fibers is disclosed in the above-incorporated by reference U.S. patent application Ser. No. 11/740,119, which produces a tubular knitted sliver pile fabric with the pile side facing outwardly and with a diameter suitable for conversion into a paint roller cover (paint roller covers typically have an inner diameter of approximately one and one-half inches (38 millimeters)). The manufacture of a tubular knitted pile fabric with cut pile segments formed from a pile yarn is disclosed in the above-incorporated by reference U.S. patent application Ser. No. 12/116,022, which produces a tubular knitted cut pile fabric with the pile side facing outwardly and with a diameter suitable for conversion into a paint roller cover (paint roller covers typically have an inner diameter of approximately one and one-half inches (38 millimeters)). Alternately, either of the tubular knitted pile fabric segments could be either slightly larger or slightly smaller than the inner diameter of a paint roller cover.

The tubular knitted pile fabric is then placed onto a cylindrical mandrel which is the approximate size of the inner diameter of a paint roller cover (typically approximately one and one-half inches (38 millimeters)). The cylindrical mandrel may be made, for example, of steel (which may optionally have a non-stick coating such as PTFE or silicone) and has a heating mechanism contained inside which is capable of rapidly heating the outside of the mandrel to a desired temperature. The cylindrical mandrel is heated to the desired temperature, which is less than 343 degrees Centigrade (less than 650 degrees Fahrenheit) or any temperature suitable for activating the low melt yarn. One temperature range that may be acceptable is between approximately 190 and 218 degrees Centigrade (between 375 and 425 degreed Fahrenheit). This temperature is sufficient to melt the lower melting point component of the low melt yarn used in the backing or base of the tubular knitted pile fabric, and is maintained for a period of between approximately five seconds and approximately ninety seconds, preferably approximately five to approximately sixty seconds.

The melted lower melting point component of the low melt yarn used in the backing or base of the tubular knitted pile fabric flows into the cylindrical form of the outside of the cylindrical mandrel. The melted lower melting point component also flows between the backing loops and the central and/or intermediate portions of the sliver fibers or the loops of the cut pile yarn segments, and locks the sliver fibers or cut pile yarn segments into the tubular knitted pile fabric. This greatly reducing the degree of shedding of pile fibers from the tubular knitted pile fabric. It also converts the backing from a fabric into a unitary cylindrical assembly which, when cooled, will become substantially rigid. The mandrel is then cooled or allowed to cool, after which the rigid, cylindrical pile fabric assembly is removed from the mandrel.

In an alternate embodiment, one or more layers of a dry adhesive film may be first wound on a non-stick mandrel, following which the tubular knitted pile fabric segment is placed over the dry adhesive film. The mandrel is then heated to cause the dry adhesive film and the lower melting point component of the low melt yarn used in the backing or base of the tubular knitted pile fabric to melt together with the adhesive bonding material to create an even more rigid cylindrical assembly having a pile surface.

The rigid, cylindrical pile fabric assembly is finished by combing and shearing the pile fabric to the desired length. The edges of the unfinished paint roller covers are beveled, and any loose sliver fibers are then vacuumed off.

It may therefore be appreciated from the above detailed description of the preferred embodiment of the present invention that it provides a tubular pile knit paint roller cover fabric having pile that is suitable for use in the manufacture of a paint roller cover. The tubular knit paint roller cover fabric of the present invention is manufactured with the pile side facing outwardly rather than inwardly, thereby obviating the need to invert it prior to mounting it on a paint roller cover core. The tubular knit paint roller cover fabric of the present invention is of a size suitable for mounting on a paint roller cover core in a seamless manner, without cutting it except for cutting it to a length fitting the length of paint roller cover core material on which the tubular knit paint roller cover fabric is to be mounted.

The tubular knit paint roller cover fabric of the present invention is well suited for use in its application on a paint roller cover, and will not experience any significant degradation of the tubular knit paint roller cover fabric due to its contact with a wide variety of paints, enamels, stains, etc. The tubular knit paint roller cover fabric of the present invention is manufactured in a manner in which the pile loops and/or sliver fibers are securely retained by the knit base material such that the shedding of pile fibers from the tubular knit paint roller cover fabric is minimized. The tubular knit paint roller cover fabric of the present invention is also manufacturable in extended length segments that may later be cut to tubular segments of any desired length.

The tubular knit paint roller cover fabric of the present invention is of a construction which is both durable and long lasting when it has been secured to a paint roller cover core, and the resulting paint roller cover will provide the user with an acceptably long lifetime. The tubular knit paint roller cover fabric of the present invention is also inexpensive to manufacture, thereby enhancing its market appeal and to affording it the broadest possible market. In addition, it is believed that utilizing a pile having a combination sliver fiber and cut pile in alternating courses on a paint roller has not heretofore been known. This new pattern provides desirable decorative effects and performance characteristics. Finally, all of the aforesaid advantages and objectives of the tubular knit paint roller cover fabric of the present invention are achieved without incurring any substantial relative disadvantage.

FIGS. 34-36 and 15 illustrate several variations of the second exemplary embodiment of a knitting apparatus, according to the invention, for use in fabricating tubular knit segments having cut pile elements of the type shown in FIGS. 18 and 28.

Figure 35:
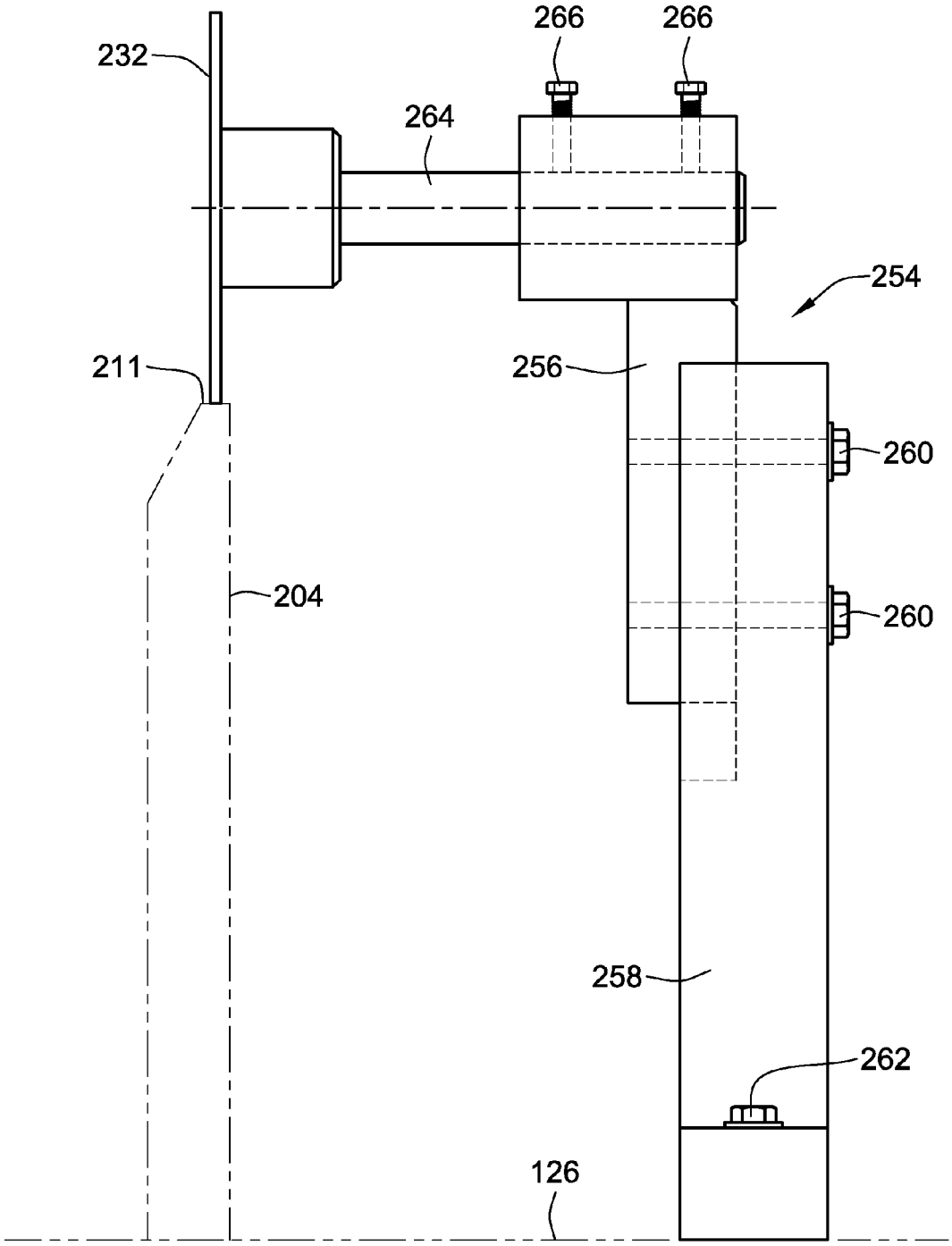
FIG. 35 is a schematic illustration of a cutting wheel mounting arrangement, in accordance with the invention, as shown in the embodiment of FIG. 34.

Specifically, as shown in FIG. 35, in some embodiments of the invention it may be desirable to mount one or more pile yarn cutting wheels 232 (or 234) on a bed-mounted adjustable cutting wheel mounting arrangement 254, which is configured to allow proper positioning of the periphery of the cutting wheel 232 in contact with the upper end 211 of the cylinder 202. The cutting wheel mounting arrangement 254 shown in FIG. 35 includes upper and lower stand sections 256, 258, which are joined to one another by a sliding joint arrangement that allows the vertical position of the cutting wheel 232 to be adjusted upward or downward and locked in place with vertical adjustment screws 260. The lower section 258 of the mounting stand is fixedly attached to the lower main bed 126 by a pair of mounting screws 262. The cutting wheel 232 is mounted on a shaft 264 and slidingly attached to the upper stand section 256 in such a manner that the position of the cutting wheel can be adjusted substantially in a radial direction toward and away from the cylinder 202 and locked in place by a pair of radial adjustment set screws 266. Given the compact size of an apparatus, according to the invention, in some embodiments it may be more advantageous to mount the cutting wheels 232 (or 234) in the manner shown in FIG. 35, using the mounting arrangement 254, rather than mounting the cutting wheels directly onto the cylinder in the manner shown in FIG. 15.

As shown in FIG. 17, in embodiments of the invention utilizing pile made from cut pile yarns as shown in FIGS. 18 and 28, it may be advantageous to add pile yarn retainers 268 positioned in close proximity to the edge of the dial, to resist the tendency observed in some embodiments of the invention for the pile yarn to follow the dial needles radially outward as the dial needles move outward to engage the backing fibers 240, 242. Such pile fiber retainers 268 may take any appropriate form, such as the flat plates illustrated in FIGS. 17, 34 and 36. Such pile fiber retainers may also be mounted in any appropriate manner.

Figure 36:
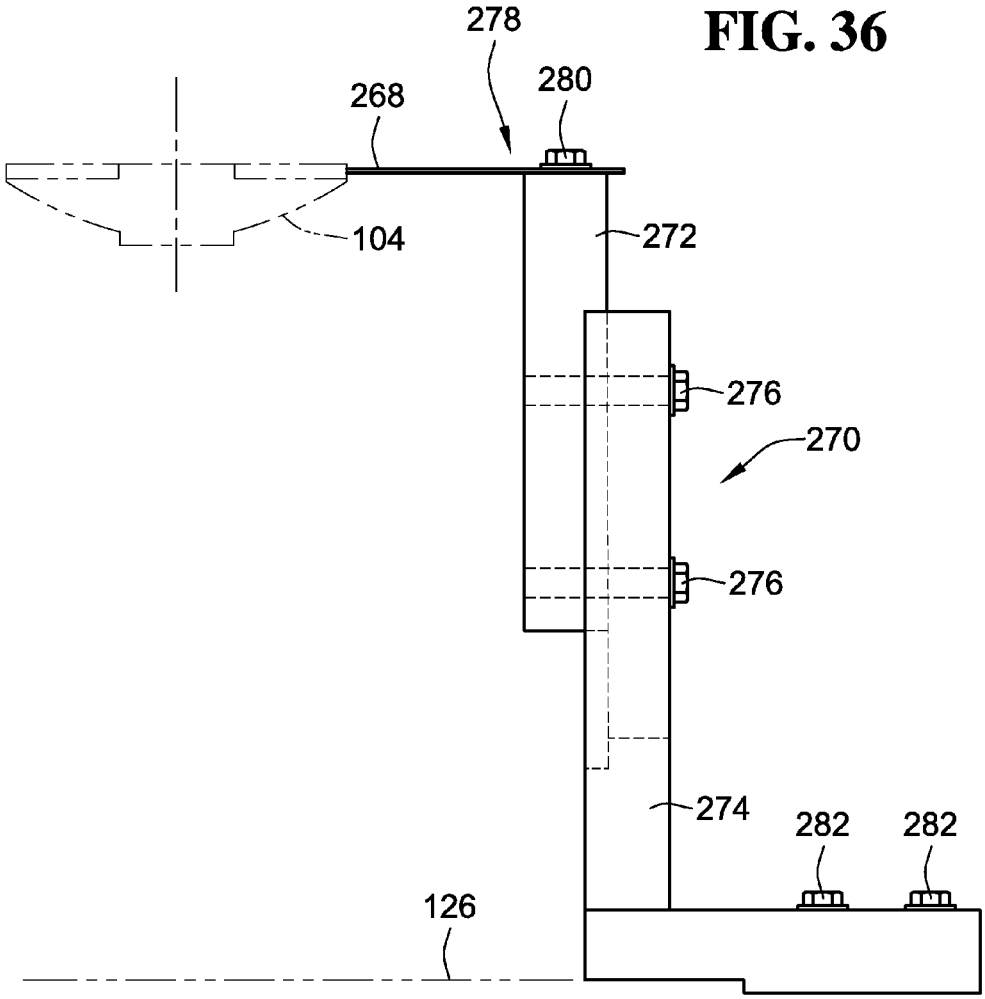
FIG. 36 is a schematic illustration of an exemplary embodiment of a pile fiber retainer and mounting arrangement, as shown in FIG. 34.

FIG. 36 illustrates one form of a bed-mounted adjustable pile fiber retainer mounting arrangement 270 having upper and lower mount portions 272, 274 joined in a slotted manner and lockable vertically by two vertical locking screws 276. The embodiment of the pile fiber retainer 268 shown in FIGS. 17, 34 and 36 includes a slot 278 therein, which is oriented to allow substantially radial adjustment of the position of a working edge of the pile fiber retainer 268 adjacent the edge of the dial. The top end of the upper portion 272 of the pile fiber retainer mounting arrangement 270 includes a slot therein which provides retention and guidance of the pile fiber retainers 268 in a substantially radial direction. The pile fiber retainer mounting arrangement 270 also includes a radial set screw 280 for locking the pile fiber retainer 268 in a desired location relative to the dial. The pile fiber retaining mounting arrangement 270 is secured on the lower main bed 126 by a pair of mounting screws 282.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A knitting apparatus for forming a tubular-shaped knitted covering for a paint roller having pile extending from an outer surface of the covering, the apparatus comprising:

a dial needle knitting arrangement having a dial, a plurality of dial needles operatively disposed in the dial, a dial cam box disposed adjacent to the dial and operatively connected to the dial needles, a backing yarn feeding arrangement, and a pile yarn feeding arrangement;

the dial being rotatably mounted for rotation about a vertical axis of rotation, having a periphery thereof disposed about the axis of rotation, and having a plurality of substantially radially directed dial needle slots opening in an upward direction;

the dial cam box being non-rotatably mounted above the dial, and having a downwardly facing and opening dial needle cam track therein;

the dial needles each having a body thereof disposed in a respective dial needle slot of the plurality of dial needle slots, a hooked end thereof that is outwardly extendable beyond the periphery of the dial, and a dial needle cam lobe extending upward from the dial needle body beyond the dial needle slot and into sliding engagement with the dial needle cam track, such that rotation of the dial causes the dial needles to be selectively movable radially within the dial needle slots through interaction of the dial needle cam lobes with the dial needle cam track;

the backing yarn and pile yarn feeding arrangements being operatively disposed adjacent the periphery of the dial and adapted for feeding the backing yarn and pile yarn to the dial needles along selected segments of the periphery of the dial.

2. The knitting apparatus of claim 1, wherein, the pile yarn is a sliver fiber and the pile yarn feeding arrangement comprises a doffer arrangement having a doffer wheel having a sliver feeding surface thereof operatively disposed adjacent to a sliver-feed segment of the periphery of the dial in such a manner that the hooked ends of the dial needles are adapted to receive sliver fiber from the sliver feeding surface of the doffer wheel during operation of the knitting apparatus.

3. The knitting apparatus of claim 2, wherein, the dial needles are movable radially to a tuck position in which the hooks of the dial needles are extended beyond the periphery of the dial, but the previous loop of the backing is not cast off, and the sliver feeding surface is disposed such that the hooks of the dial needles can receive the sliver fiber from the sliver feeding surface while the dial needles are in the tuck position.

4. The knitting apparatus of claim 1, wherein, the pile yarn is a face yarn and the pile yarn feeding arrangement is a face yarn feeder having an output thereof operatively disposed adjacent to a face-yarn-feed segment of the periphery of the dial in such a manner that the hooked ends of the needles are adapted to pull loops of the face yarn fiber from the output of the face yarn feeder during operation of the knitting apparatus.

5. The knitting apparatus of claim 4, further comprising, a cutting arrangement operatively disposed for cutting the loops of face yarn to form the pile on the outside of the tubular-shaped knitted covering.

6. The knitting apparatus of claim 1, wherein, the covering includes multiple successively knitted courses, with two adjacent courses being knitted simultaneously, and the pile yarn being sliver fibers in one course of the two simultaneously knitted courses and the pile yarn being a face yarn in the other course the two simultaneously knitted courses, and the pile yarn feeding arrangement further comprises:

a doffer arrangement including a doffer wheel having a sliver feeding surface thereof operatively disposed adjacent to a sliver-feed segment of the periphery of the dial in such a manner that the hooked ends of the dial needles can receive sliver fiber from the sliver feeding surface of the doffer wheel during operation of the knitting apparatus for knitting the one of the two simultaneously knitted courses; and a face yarn feeder having an output thereof operatively disposed adjacent to a face-yarn-feed segment of the periphery of the dial in such a manner that the hooked ends of the dial needles can pull loops of the face yarn fiber from the output of the face yarn feeder during operation of the knitting apparatus.

7. The knitting apparatus of claim 6, further comprising, a cutting arrangement for cutting the loops of face yarn to form a portion of the pile on the outside of the tubular-shaped knitted covering.

8. The knitting apparatus of claim 1, wherein:

the covering includes multiple successively knitted courses, with two or more adjacent courses being knitted simultaneously, and the pile yarn being sliver fibers in the two or more simultaneously knitted courses; and the pile yarn feeding arrangement further comprises, a separate doffer arrangement for each of the two or more simultaneously knitted courses;

with each doffer arrangement including a doffer wheel having a sliver feeding surface thereof operatively disposed adjacent to a sliver-feed segment of the periphery of the dial in such a manner that the hooked ends of the dial needles can receive sliver fiber from the sliver feeding surface of the doffer wheel during operation of the knitting apparatus for knitting the one of the two simultaneously knitted courses.

9. The knitting apparatus of claim 8, wherein, the backing yarn feeding arrangement includes a first and a second backing yarn feeder operatively disposed adjacent the periphery of the dial and adapted for feeding the backing yarn to the dial needles along selected segments of the periphery of the dial for supplying backing yarn for each of the two simultaneously knitted courses.

10. The knitting apparatus of claim 1, further comprising, a take-down arrangement disposed below the dial for urging the tubular-shaped knitted covering with outwardly extending pile to move substantially downward along the rotational axis from the dial.

11. The knitting apparatus of claim 10, wherein:

the apparatus further comprises a main bed disposed below and supporting the dial, the dial cam box, and the take-down arrangement; and the take-down arrangement is disposed below the main bed.

12. The knitting apparatus of claim 11, wherein, the take-down arrangement includes a powered drive roller for urging movement of the tubular-shaped knitted covering with outwardly extending pile, with the powered drive roller being operatively connected to be driven in synchronization with the dial by a common drive motor.

13. The knitting apparatus of claim 12, wherein, the take-down arrangement rotates about the axis of rotation in synchronization with the dial, and is operatively connected to be rotated about the rotational axis by the common drive motor.

14. The knitting apparatus of claim 13, further comprising, a cylinder needle knitting arrangement having a cylinder, a plurality of cylinder needles operatively disposed in the cylinder, a cylinder cam box disposed adjacent to the cylinder and operatively connected to the cylinder needles;

the cylinder being rotatably mounted for rotation about the vertical axis of rotation, having a radially outer periphery thereof disposed about the axis of rotation, and having a plurality of substantially axially directed needle slots opening radially outward and also in an upward direction at an upper end of the cylinder;

the cylinder cam box being non-rotatably mounted about the cylinder, and having a radially inward facing and opening cylinder needle cam track therein;

the cylinder needles each having a body thereof disposed in a respective cylinder needle slot of the plurality of cylinder needle slots, a hooked end thereof that is upwardly extendable beyond the upper end of the cylinder, and a cylinder needle cam lobe extending radially outward beyond the cylinder needle slot and into sliding engagement with the cylinder needle cam track, such that rotation of the cylinder causes the cylinder needles to be selectively movable axially within the cylinder needle slots through interaction of the cylinder needle cam lobes with the cylinder needle cam track;

the cylinder and dial being operatively connected for synchronized rotation with respect to one another about the axis of rotation;

the dial being disposed axially along the axis of rotation above the upper end of the cylinder; and the dial knitting arrangement, a cylinder knitting arrangement, and take-down arrangement all being operatively interconnected to the common drive motor to be rotated about the axis of rotation by the common drive motor.

15. The knitting apparatus of claim 1, further comprising, a cylinder needle knitting arrangement having a cylinder, a plurality of cylinder needles operatively disposed in the cylinder, and a cylinder cam box disposed adjacent to the cylinder and operatively connected to the cylinder needles;

the cylinder being rotatably mounted for rotation about the vertical axis of rotation, having a radially outer periphery thereof disposed about the axis of rotation, and having a plurality of substantially axially directed needle slots opening in an upward direction at an upper end of the cylinder;

the cylinder cam box being non-rotatably mounted about the cylinder, and having a radially inward facing and opening cylinder needle cam track therein;

the cylinder needles each having a body thereof disposed in a respective cylinder needle slot of the plurality of cylinder needle slots, a hooked end thereof that is upwardly extendable beyond the upper end of the cylinder, and a cylinder needle cam lobe extending radially outward beyond the cylinder needle slot and into sliding engagement with the cylinder needle cam track, such that rotation of the cylinder causes the cylinder needles to be selectively movable axially within the cylinder needle slots through interaction of the cylinder needle cam lobes with the cylinder needle cam track;

the cylinder and dial being operatively connected for synchronized rotation with respect to one another about the axis of rotation; and the dial being disposed axially along the axis of rotation above the upper end of the cylinder.

16. The knitting apparatus of claim 15, wherein, the cylinder, cylinder needles and cylinder cam box are removable, to allow operation of the knitting machine with only the dial, dial needles and dial cam box.

17. The knitting apparatus of claim 15, wherein, the dial, dial needles and dial cam box are removable, to allow operation of the knitting machine with only the cylinder, cylinder needles and cylinder cam box.

18. The knitting machine of claim 15, wherein:

the covering includes multiple successively knitted courses, with two adjacent courses being knitted simultaneously, and the pile yarn being sliver fibers in one course of the two simultaneously knitted courses and the pile yarn being a face yarn in the other course the two simultaneously knitted courses; and a face yarn feeder having an output thereof operatively disposed adjacent to a face-yarn-feed segment of the periphery of the dial in such a manner that the hooked ends of the dial needles can pull loops of the face yarn fiber from the output of the face yarn feeder during operation of the knitting apparatus; and the knitting apparatus is configured such that knitting of the base fabric and sliver fibers is carried out totally by the dial knitting arrangement, with both the dial and cylinder knitting arrangements being utilized for knitting in the face yarn.

19. A knitting apparatus for forming a tubular-shaped knitted covering for a paint roller having pile extending from an outer surface of the covering, the apparatus comprising:

a dial needle knitting arrangement having a dial, a plurality of dial needles operatively disposed in the dial, a dial cam box disposed adjacent to the dial and operatively connected to the dial needles, a backing yarn feeding arrangement, a pile yarn feeding arrangement, and a take-down arrangement, all operatively mounted on a frame and driven through a drive arrangement by a common drive motor;

the frame defining a main vertical axis of rotation and including an upper main bed and a lower main bed connected to and spaced axially from one another by a main bed support;

the drive arrangement including an upper rotatable plate operatively attached to the upper main bed for rotation about the main axis of rotation, a lower rotatable plate operatively attached to the lower main bed for rotation about the main axis of rotation and a main drive shaft rotatably mounted for rotation about a second axis of rotation extending substantially parallel to the main axis of rotation, with the main drive shaft being operatively connected to the upper and lower rotatable plated for urging synchronized rotation of the upper and lower rotatable plates with one another in a fixed relationship to rotation of the main drive shaft, with the common drive motor being operatively coupled to the main drive shaft for rotatably driving the main drive shaft about the second axis of rotation;

the dial being attached to and axially disposed below the upper rotatable plate for rotation about the main axis of rotation, and having a periphery thereof disposed about the main axis of rotation, and having a plurality of substantially radially directed dial needle slots opening in an upward direction;

the dial cam box being non-rotatably mounted to the upper main bed above the dial, and having a downwardly facing and opening dial needle cam track therein;

the dial needles each having a body thereof disposed in a respective dial needle slot of the plurality of dial needle slots, a hooked end thereof that is outwardly extendable beyond the periphery of the dial, and a dial needle cam lobe extending upward beyond the dial needle slot and into sliding engagement with the dial needle cam track, such that rotation of the dial causes the dial needles to be selectively movable radially within the dial needle slots through interaction of the dial needle cam lobes with the dial needle cam track;

the backing yarn and pile yarn feeding arrangements being operatively disposed adjacent the periphery of the dial and adapted for feeding the backing yarn and pile yarn to the dial needles along selected segments of the periphery of the dial;

the take-down arrangement being mounted to and axially disposed below the lower rotatable plate and lower main bed, and including a take-down drive roller operatively connected to be rotated by relative rotation between the lower rotatable element and the lower main bed.

20. The knitting apparatus of claim 19, wherein, the pile yarn is a sliver fiber and the pile yarn feeding arrangement comprises a doffer arrangement having a doffer wheel having a sliver feeding surface thereof operatively disposed adjacent to a sliver-feed segment of the periphery of the dial in such a manner that the hooked ends of the dial needles are adapted to receive sliver fiber from the sliver feeding surface of the doffer wheel during operation of the knitting apparatus, the doffer arrangement further being configured for operative engagement with the lower rotatable plate in such a manner that rotation of the lower rotatable plate causes a corresponding rotation of the doffer wheel.

21. The knitting machine of claim 19, further comprising:

a cylinder needle knitting arrangement having a cylinder, a plurality of cylinder needles operatively disposed in the cylinder, a cylinder cam box disposed adjacent to the cylinder and operatively connected to the cylinder needles;

the cylinder being rotatably mounted on and above the rotatable plate and lower bed for rotation about the main axis of rotation, having a radially outer periphery thereof disposed about the main axis of rotation, and having a plurality of substantially axially directed needle slots opening in an upward direction at an upper end of the cylinder;

the cylinder cam box being non-rotatably mounted to the lower bed about the cylinder, and having a radially inward facing and opening cylinder needle cam track therein;

the cylinder needles each having a body thereof disposed in a respective cylinder needle slot of the plurality of cylinder needle slots, a hooked end thereof that is upwardly extendable beyond the upper end of the cylinder, and a cylinder needle cam lobe extending radially outward beyond the cylinder needle slot and into sliding engagement with the cylinder needle cam track, such that rotation of the cylinder causes the cylinder needles to be selectively movable axially within the cylinder needle slots through interaction of the cylinder needle cam lobes with the cylinder needle cam track;

the cylinder and dial being operatively connected by the drive arrangement for synchronized rotation with respect to one another about the main axis of rotation; and the dial being disposed axially along the main axis of rotation above the upper end of the cylinder.

22. The knitting apparatus of claim 21, wherein, the cylinder, cylinder needles and cylinder cam box are removable, to allow operation of the knitting machine with only the dial, dial needles and dial cam box.

23. The knitting apparatus of claim 21, wherein, the dial, dial needles and dial cam box are removable, to allow operation of the knitting machine with only the cylinder, cylinder needles and cylinder cam box.

24. A method for forming a tubular-shaped knitted covering for a paint roller having pile extending from an outer surface of the covering, using an apparatus comprising a dial needle knitting arrangement having a dial, a plurality of dial needles operatively disposed in the dial, a dial cam box disposed adjacent to the dial and operatively connected to the dial needles, a backing yarn feeding arrangement, and a pile yarn feeding arrangement, wherein the method comprises, knitting a length of tubular-shaped fabric with the dial needles in such a manner that the backing yarn is exposed on an interior surface of the length of tubular-shaped fabric and the pile extends outward from an exterior surface of the length of tubular-shaped fabric.

25. The method of claim 24, wherein:

the dial is rotatably mounted for rotation about a vertical axis of rotation, having a periphery thereof disposed about the axis of rotation, and having a plurality of substantially radially directed dial needle slots opening in an upward direction;

the dial cam box is non-rotatably mounted above the dial, and having a downwardly facing and opening dial needle cam track therein;

the dial needles each having a body thereof disposed in a respective dial needle slot of the plurality of dial needle slots, a hooked end thereof that is outwardly extendable beyond the periphery of the dial, and a dial needle cam lobe extending upward beyond the dial needle slot and into sliding engagement with the dial needle cam track, such that rotation of the dial causes the dial needles to be selectively movable radially within the dial needle slots through interaction of the dial needle cam lobes with the dial needle cam track;

the backing yarn and pile yarn feeding arrangements are operatively disposed adjacent the periphery of the dial and adapted for feeding the backing yarn and pile yarn to the dial needles along selected segments of the periphery of the dial;

the covering includes multiple successively knitted courses, with two adjacent courses being knitted simultaneously, and the pile yarn being sliver fibers in one course of the two simultaneously knitted courses and the pile yarn being a face yarn in the other course the two simultaneously knitted courses, and the pile yarn feeding arrangement further comprises;

a doffer arrangement including a doffer wheel having a sliver feeding surface thereof operatively disposed adjacent to a sliver-feed segment of the periphery of the dial in such a manner that the hooked ends of the dial needles can receive sliver fiber from the sliver feeding surface of the doffer wheel during operation of the knitting apparatus for knitting the one of the to simultaneously knitted courses; and a face yarn feeder having an output thereof operatively disposed adjacent to a face-yarn-feed segment of the periphery of the dial in such a manner that the hooked ends of the dial needles can pull loops of the face yarn fiber from the output of the face yarn feeder during operation of the knitting apparatus; and the method further comprises manipulating the base fabric and sliver fibers solely with the dial knitting arrangement, and manipulating the face yarn with both the dial and cylinder knitting arrangements to form the covering having multiple successively knitted courses, with two adjacent courses being knitted simultaneously, and the pile yarn being sliver fibers in one course of the two simultaneously knitted courses and the pile yarn being a face yarn in the other course the two simultaneously knitted courses, and the pile yarn feeding arrangement.

26. A method for forming a tubular-shaped knitted covering for a paint roller having pile extending from an outer surface of the covering, using an apparatus comprising a cylinder knitting arrangement having a cylinder defining an upper end thereof and a dial needle knitting arrangement having a dial, a plurality of dial needles operatively disposed in the dial, a dial cam box disposed adjacent to the dial and operatively connected to the dial needles, a backing yarn feeding arrangement, and a pile yarn feeding arrangement, wherein the method comprises, knitting a length of tubular-shaped fabric with the dial needles in such a manner that the backing yarn is exposed on an interior surface of the length of tubular-shaped fabric and the pile extends outward from an exterior surface of the length of tubular-shaped fabric.

27. The method of claim 26, further comprising, adjusting a distance between the dial and the upper end of the cylinder knitting arrangement to thereby adjust a length of the pile extending outward from the exterior surface of the length of tubular-shaped fabric.

28. The method of claim 26, wherein:

the dial is rotatably mounted for rotation about a vertical axis of rotation, having a periphery thereof disposed about the axis of rotation, and having a plurality of substantially radially directed dial needle slots opening in an upward direction;

the dial cam box is non-rotatably mounted above the dial, and having a downwardly facing and opening dial needle cam track therein;

the dial needles each having a body thereof disposed in a respective dial needle slot of the plurality of dial needle slots, a hooked end thereof that is outwardly extendable beyond the periphery of the dial, and a dial needle cam lobe extending upward beyond the dial needle slot and into sliding engagement with the dial needle cam track, such that rotation of the dial causes the dial needles to be selectively movable radially within the dial needle slots through interaction of the dial needle cam lobes with the dial needle cam track;

the backing yarn and pile yarn feeding arrangements are operatively disposed adjacent the periphery of the dial and adapted for feeding the backing yarn and pile yarn to the dial needles along selected segments of the periphery of the dial;

the covering includes multiple successively knitted courses, with two adjacent courses being knitted simultaneously, and the pile yarn being sliver fibers in one course of the two simultaneously knitted courses and the pile yarn being a face yarn in the other course the two simultaneously knitted courses, and the pile yarn feeding arrangement further comprises;

a doffer arrangement including a doffer wheel having a sliver feeding surface thereof operatively disposed adjacent to a sliver-feed segment of the periphery of the dial in such a manner that the hooked ends of the dial needles can receive sliver fiber from the sliver feeding surface of the doffer wheel during operation of the knitting apparatus for knitting the one of the to simultaneously knitted courses; and the method further comprises manipulating the base fabric and sliver fibers solely with the dial knitting arrangement, and manipulating the face yarn with both the dial and cylinder knitting arrangements to form the covering having multiple successively knitted courses, with two adjacent courses being knitted simultaneously, and the pile yarn being sliver fibers in one course of the two simultaneously knitted courses and the pile yarn being a face yarn in the other course the two simultaneously knitted courses, and the pile yarn feeding arrangement.

29. The method of claim 28, further comprising, mounting the dial at a distance vertically above the upper end of the cylinder, and adjusting the distance between the dial and the upper end of the cylinder knitting arrangement to thereby adjust a length of the pile extending outward from the exterior surface of the length of tubular-shaped fabric.

30. The method of claim 29, further comprising, adjusting the distance between the dial and the upper end of the cylinder by moving the dial along the vertical axis of rotation.

31. The method of claim 28, further comprising retaining the face yarn adjacent the dial with a face yarn retainer operatively disposed adjacent to a backing-yarn-feed segment of the periphery of the dial in such a manner that face yarn slides along the dial needles as the hooked ends of the dial needles move outward to engage and pull loops of the backing yarn fiber from the output of the face backing yarn feeder during operation of the knitting apparatus.

32. The method of claim 31, further comprising, mounting the face yarn retainer for movement radially with respect to the vertical axis of rotation and for movement vertically along the vertical axis of rotation.

33. The method of claim 32, wherein:

the knitting apparatus includes a frame defining the main vertical axis of rotation and having an upper main bed and a lower main bed connected to and spaced axially from one another by a main bed support with the dial being operatively mounted on the upper main bed and the cylinder being operatively mounted on the lower main bed; and the method further comprises mounting the face yarn retainer on the lower main bed.

34. The method of claim 32, wherein:

the knitting apparatus includes a frame defining the main vertical axis of rotation and having an upper main bed and a lower main bed connected to and spaced axially from one another by a main bed support with the dial being operatively mounted on the upper main bed and the cylinder being operatively mounted on the lower main bed;

the cylinder knitting arrangement includes a cutting wheel having a periphery thereof operatively disposed adjacent the upper end of the cylinder for retaining a portion of the face yarn adjacent the upper end of the cylinder; and the method further comprises mounting the face cutting wheel on the lower main bed.

35. The method of claim 26, wherein:

the dial is rotatably mounted for rotation about a vertical axis of rotation, having a periphery thereof disposed about the axis of rotation, and having a plurality of substantially radially directed dial needle slots opening in an upward direction;

the dial cam box is non-rotatably mounted above the dial, and having a downwardly facing and opening dial needle cam track therein;

the dial needles each having a body thereof disposed in a respective dial needle slot of the plurality of dial needle slots, a hooked end thereof that is outwardly extendable beyond the periphery of the dial, and a dial needle cam lobe extending upward beyond the dial needle slot and into sliding engagement with the dial needle cam track, such that rotation of the dial causes the dial needles to be selectively movable radially within the dial needle slots through interaction of the dial needle cam lobes with the dial needle cam track;

the backing yarn and pile yarn feeding arrangements are operatively disposed adjacent the periphery of the dial and adapted for feeding the backing yarn and pile yarn to the dial needles along selected segments of the periphery of the dial;

the covering includes multiple successively knitted courses, with two adjacent courses being knitted simultaneously, and the pile yarn being a face yarn in each course of the two simultaneously knitted courses, and the pile yarn feeding arrangement further comprises; and the method further comprises manipulating the backing fabric solely with the dial knitting arrangement, and manipulating the face yarn with both the dial and cylinder knitting arrangements to form the covering having multiple successively knitted courses, with two adjacent courses being knitted simultaneously with the pile yarn being a face yarn each course of the two simultaneously knitted courses.

36. The method of claim 35, further comprising, mounting the dial at a distance vertically above the upper end of the cylinder, and adjusting the distance between the dial and the upper end of the cylinder knitting arrangement to thereby adjust a length of the pile extending outward from the exterior surface of the length of tubular-shaped fabric.

37. The method of claim 36, further comprising, adjusting the distance between the dial and the upper end of the cylinder by moving the dial along the vertical axis of rotation.

38. The method of claim 35, further comprising retaining the face yarn adjacent the dial with a face yarn retainer operatively disposed adjacent to a backing-yarn-feed segment of the periphery of the dial in such a manner that face yarn slides along the dial needles as the hooked ends of the dial needles move outward to engage and pull loops of the backing yarn fiber from the output of the face backing yarn feeder during operation of the knitting apparatus.

39. The method of claim 38, further comprising, mounting the face yarn retainer for movement radially with respect to the vertical axis of rotation and for movement vertically along the vertical axis of rotation.

40. The method of claim 39, wherein:

the knitting apparatus includes a frame defining the main vertical axis of rotation and having an upper main bed and a lower main bed connected to and spaced axially from one another by a main bed support with the dial being operatively mounted on the upper main bed and the cylinder being operatively mounted on the lower main bed; and the method further comprises mounting the face yarn retainer on the lower main bed.

41. The method of claim 39, wherein:

the knitting apparatus includes a frame defining the main vertical axis of rotation and having an upper main bed and a lower main bed connected to and spaced axially from one another by a main bed support with the dial being operatively mounted on the upper main bed and the cylinder being operatively mounted on the lower main bed;

the cylinder knitting arrangement includes a cutting wheel having a periphery thereof operatively disposed adjacent the upper end of the cylinder for retaining a portion of the face yarn adjacent the upper end of the cylinder; and the method further comprises mounting the face cutting wheel on the lower main bed.

42. A knitting apparatus for forming a tubular-shaped knitted covering for a paint roller having pile extending from an outer surface of the covering, the apparatus comprising:

a cylinder knitting arrangement having a cylinder defining an upper end thereof and a dial needle knitting arrangement;

the dial knitting arrangement having a dial, a plurality of dial needles operatively disposed in the dial, a dial cam box disposed adjacent to the dial and operatively connected to the dial needles, a backing yarn feeding arrangement, and a pile yarn feeding arrangement;

the dial being rotatably mounted for rotation about a vertical axis of rotation at a distance above the upper end of the cylinder and having a periphery thereof disposed about the axis of rotation, and having a plurality of substantially radially directed dial needle slots opening in an upward direction;

the dial cam box being non-rotatably mounted above the dial, and having a downwardly facing and opening dial needle cam track therein;

the dial needles each having a body thereof disposed in a respective dial needle slot of the plurality of dial needle slots, a hooked end thereof that is outwardly extendable beyond the periphery of the dial, and a dial needle cam lobe extending upward from the dial needle body beyond the dial needle slot and into sliding engagement with the dial needle cam track, such that rotation of the dial causes the dial needles to be selectively movable radially within the dial needle slots through interaction of the dial needle cam lobes with the dial needle cam track;

the backing yarn and pile yarn feeding arrangements being operatively disposed adjacent the periphery of the dial and adapted for feeding the backing yarn and pile yarn to the dial needles along selected segments of the periphery of the dial.

43. The knitting apparatus of claim 42, wherein, the pile yarn is a face yarn and the pile yarn feeding arrangement is a face yarn feeder having an output thereof operatively disposed adjacent to a face-yarn-feed segment of the periphery of the dial in such a manner that the hooked ends of the needles are adapted to pull loops of the face yarn fiber from the output of the face yarn feeder during operation of the knitting apparatus.

44. The knitting apparatus of claim 43, further comprising, a cutting arrangement operatively disposed for cutting the loops of face yarn to form the pile on the outside of the tubular-shaped knitted covering.

45. The knitting apparatus of claim 42, wherein, the covering includes multiple successively knitted courses, with two adjacent courses being knitted simultaneously, and the pile yarn being sliver fibers in one course of the two simultaneously knitted courses and the pile yarn being a face yarn in the other course the two simultaneously knitted courses, and the pile yarn feeding arrangement further comprises:

a doffer arrangement including a doffer wheel having a sliver feeding surface thereof operatively disposed adjacent to a sliver-feed segment of the periphery of the dial in such a manner that the hooked ends of the dial needles can receive sliver fiber from the sliver feeding surface of the doffer wheel during operation of the knitting apparatus for knitting the one of the two simultaneously knitted courses; and a face yarn feeder having an output thereof operatively disposed adjacent to a face-yarn-feed segment of the periphery of the dial in such a manner that the hooked ends of the dial needles can pull loops of the face yarn fiber from the output of the face yarn feeder during operation of the knitting apparatus.

46. The knitting apparatus of claim 45, further comprising, a cutting arrangement for cutting the loops of face yarn to form a portion of the pile on the outside of the tubular-shaped knitted covering.

47. The apparatus of claim 42, further comprising, operatively mounting the dial above the upper end of the cylinder in such a manner that the distance between the dial and the upper end of the cylinder knitting arrangement is adjustable to thereby adjust a length of the pile extending outward from the exterior surface of the length of tubular-shaped fabric.

48. The apparatus of claim 47, wherein, moving the dial along the vertical axis of rotation adjusts the distance between the dial and the upper end of the cylinder.

49. The apparatus of claim 42, further comprising, a face yarn retainer operatively disposed adjacent to a backing-yarn-feed segment of the periphery of the dial in such a manner that face yarn slides along the dial needles as the hooked ends of the dial needles move outward to engage and pull loops of the backing yarn fiber from the output of the backing yarn feeder during operation of the knitting apparatus.

50. The apparatus of claim 49, wherein, the face yarn retainer is operatively mounted for movement radially with respect to the vertical axis of rotation and for movement vertically along the vertical axis of rotation.

51. The apparatus of claim 49, wherein:

the knitting apparatus includes a frame defining the main vertical axis of rotation and having an upper main bed and a lower main bed connected to and spaced axially from one another by a main bed support with the dial being operatively mounted on the upper main bed and the cylinder being operatively mounted on the lower main bed; and the face yarn retainer is operatively mounted on the lower main bed.

52. The apparatus of claim 49, wherein:

the knitting apparatus includes a frame defining the main vertical axis of rotation and having an upper main bed and a lower main bed connected to and spaced axially from one another by a main bed support with the dial being operatively mounted on the upper main bed and the cylinder being operatively mounted on the lower main bed;

the cylinder knitting arrangement includes a cutting wheel having a periphery thereof operatively disposed adjacent the upper end of the cylinder for retaining a portion of the face yarn adjacent the upper end of the cylinder; and the face cutting wheel is operatively mounted on the lower main bed.

53. The apparatus of claim 42, wherein:

the dial is rotatably mounted for rotation about a vertical axis of rotation, and has a periphery thereof disposed about the axis of rotation, and also has a plurality of substantially radially directed dial needle slots opening in an upward direction;

the dial cam box is non-rotatably mounted above the dial, and having a downwardly facing and opening dial needle cam track therein;

the dial needles each having a body thereof disposed in a respective dial needle slot of the plurality of dial needle slots, a hooked end thereof that is outwardly extendable beyond the periphery of the dial, and a dial needle cam lobe extending upward beyond the dial needle slot and into sliding engagement with the dial needle cam track, such that rotation of the dial causes the dial needles to be selectively movable radially within the dial needle slots through interaction of the dial needle cam lobes with the dial needle cam track;

the backing yarn and pile yarn feeding arrangements are operatively disposed adjacent the periphery of the dial and adapted for feeding the backing yarn and pile yarn to the dial needles along selected segments of the periphery of the dial;

the covering includes multiple successively knitted courses, with two adjacent courses being knitted simultaneously, and the pile yarn being a face yarn in each course of the two simultaneously knitted courses, and the pile yarn feeding arrangement further comprises; and the apparatus is configured for manipulating the backing fabric solely with the dial knitting arrangement, and manipulating the face yarn with both the dial and cylinder knitting arrangements to form the covering having multiple successively knitted courses, with two adjacent courses being knitted simultaneously with the pile yarn being a face yarn each course of the two simultaneously knitted courses.

54. The apparatus of claim 53, wherein, the dial is operatively mounted at a distance vertically above the upper end of the cylinder in such a manner that the distance between the dial and the upper end of the cylinder knitting arrangement is adjustable to thereby adjust a length of the pile extending outward from the exterior surface of the length of tubular-shaped fabric.

55. The apparatus of claim 54, further comprising a face yarn retainer operatively disposed adjacent the dial with a face yarn retainer adjacent to a backing-yarn-feed segment of the periphery of the dial in such a manner that face yarn slides along the dial needles as the hooked ends of the dial needles move outward to engage and pull loops of the backing yarn fiber from the output of the face backing yarn feeder during operation of the knitting apparatus.

56. The apparatus of claim 55, wherein, the face yarn retainer is mounted for movement radially with respect to the vertical axis of rotation and for movement vertically along the vertical axis of rotation.

57. The apparatus of claim 56, wherein:

the knitting apparatus includes a frame defining the main vertical axis of rotation and having an upper main bed and a lower main bed connected to and spaced axially from one another by a main bed support with the dial being operatively mounted on the upper main bed and the cylinder being operatively mounted on the lower main bed; and the face yarn retainer is mounted on the lower main bed.

58. The apparatus of claim 56, wherein:

the knitting apparatus includes a frame defining the main vertical axis of rotation and having an upper main bed and a lower main bed connected to and spaced axially from one another by a main bed support with the dial being operatively mounted on the upper main bed and the cylinder being operatively mounted on the lower main bed;

the cylinder knitting arrangement includes a cutting wheel having a periphery thereof operatively disposed adjacent the upper end of the cylinder for retaining a portion of the face yarn adjacent the upper end of the cylinder; and the cutting wheel is mounted on the lower main bed.

* * * * *